US011142997B2

(12) United States Patent
Akkerman

(10) Patent No.: US 11,142,997 B2
(45) Date of Patent: Oct. 12, 2021

(54) FLOW TRANSPORTED OBTURATING TOOL AND METHOD

(71) Applicant: ABD TECHNOLOGIES LLC, Houston, TX (US)

(72) Inventor: Neil Akkerman, Houston, TX (US)

(73) Assignee: ABD Technologies LLC, Houston, TX (US)

( * ) Notice: Subject to any disclaimer, the term of this patent is extended or adjusted under 35 U.S.C. 154(b) by 1 day.

(21) Appl. No.: 16/702,215

(22) Filed: Dec. 3, 2019

(65) Prior Publication Data

US 2020/0173255 A1 Jun. 4, 2020

Related U.S. Application Data

(60) Provisional application No. 62/774,678, filed on Dec. 3, 2018.

(51) Int. Cl.

| | |
|---|---|
| ***E21B 34/14*** | (2006.01) |
| ***E21B 43/26*** | (2006.01) |
| ***E21B 43/14*** | (2006.01) |

(52) U.S. Cl.
CPC ..... *E21B 34/14* (2013.01); *E21B 43/14* (2013.01); *E21B 43/26* (2013.01); *E21B 2200/06* (2020.05)

(58) Field of Classification Search
CPC ..... E21B 34/14; E21B 43/14; E21B 43/26; E21B 2200/06
See application file for complete search history.

(56) References Cited

U.S. PATENT DOCUMENTS

2014/0174746 A1* 6/2014 George ..... E21B 34/14 166/308.1
2017/0030168 A1* 2/2017 Akkerman ..... E21B 17/22

* cited by examiner

*Primary Examiner* — Dany E Akakpo
(74) *Attorney, Agent, or Firm* — Conley Rose, P.C.

(57) ABSTRACT

A flow transported obturating tool for actuating a valve in a wellbore includes a housing including a radially translatable engagement assembly, a core slidably disposed in the housing, an interrupt member disposed radially between the core and the housing, a bore sensor disposed in the housing and in engagement with the interrupt member, and a biasing member disposed in the housing and in engagement with the interrupt member.

17 Claims, 34 Drawing Sheets

FIG. 9

FIG. 10

FIG. 11

FIG. 13

FIG. 12

FIG. 14

FLOW TRANSPORTED OBTURATING TOOL AND METHOD

CROSS-REFERENCE TO RELATED APPLICATIONS

The present application claims benefit of U.S. provisional patent application No. 62/774,678 filed Dec. 3, 2018, and entitled "Flow Transported Obturating Tool and Method," which is incorporated herein by reference in its entirety.

STATEMENT REGARDING FEDERALLY SPONSORED RESEARCH OR DEVELOPMENT

Not applicable.

BACKGROUND

This disclosure relates generally to well servicing and completion systems for the production of hydrocarbons. More particularly, the disclosure relates to actuatable downhole tools including slideable sleeves for providing selectable access to open (uncased) and cased wellbores during completion, wellbore servicing, and production operations, such as hydraulically fracturing open and cased wellbores and perforating cased wellbores. The disclosure also relates to tools for selectively actuating slideable sleeves of downhole tools for providing selectable access to open and cased wellbores in wellbore servicing and production operations. Further, the disclosure regards tools for hydraulically fracturing a subterranean formation from multiple zones of a wellbore extending through the formation. The disclosure also relates to tools for selectably perforating components of a well string in preparation for hydraulically fracturing a subterranean formation.

Hydraulic fracturing and stimulation may improve the flow of hydrocarbons from one or more production zones of a wellbore extending into a subterranean formation. Particularly, formation stimulation techniques such as hydraulic fracturing may be used with deviated or horizontal wellbores that provide additional exposure to hydrocarbon bearing formations, such as shale formations. The horizontal wellbore includes a vertical section extending from the surface to a "heel" where the wellbore transitions to a horizontal or deviated section that extends horizontally through a hydrocarbon bearing formation, terminating at a "toe" of the horizontal section of the wellbore.

An array of completion strategies and systems that incorporate hydraulic fracturing operations have been developed to economically enhance production from subterranean formations. In particular, a "plug and perf" completion strategy has been developed that includes pumping a bridge plug tethered through a wellbore (typically having a cemented liner) along with one or more perforating tools to a desired zone near the toe of the wellbore. The plug is set and the zone is perforated using the perforating tools. Subsequently, the tools are removed and high pressure fracturing fluids are pumped into the wellbore and directed against the formation by the set plug to hydraulically fracture the formation at the selected zone through the completed perforations. The process may then be repeated moving in the direction of the heel of the horizontal section of the wellbore (i.e., moving "bottom-up"). Thus, although plug and perf operations provide for enhanced flow control into the wellbore and the creation of a large number of discrete production zones, extensive time and a high volume of fluid is required to pump down and retrieve the various tools required to perform the operation.

Another completion strategy incorporating hydraulic fracturing includes ball-actuated sliding sleeves (also known as "frac sleeves") and isolation packers run inside of a liner or in an open hole wellbore. Particularly, this system includes ported sliding sleeves installed in the wellbore between isolation packers on a single well string. The isolation packers seal against the inner surface of the wellbore to segregate the horizontal section of the wellbore into a plurality of discrete production zones, with one or more sliding sleeves disposed in each production zone. A ball is pumped into the well string from the surface until it seats within the sliding sleeve nearest the toe of the horizontal section of the wellbore. Hydraulic pressure acting against the ball causes hydraulic pressure to build behind the seated ball, causing the sliding sleeve to shift into an open position to hydraulically fracture the formation at the production zone of the actuated sliding sleeve via the high pressure fluid pumped into the well string.

The process may be subsequently repeated moving towards the heel of the horizontal section of the wellbore (i.e., moving "bottom-up") using progressively larger-sized balls to actuate the remaining sliding sleeves nearer the heel of the horizontal section of the wellbore. The balls and ball seats of the sliding sleeves may be drilled out using coiled tubing. The use of sliding sleeves and isolation packers disposed along a well string may streamline the hydraulic fracturing operation compared with the plug-and-perf system, but the use of varying size balls and ball seats to actuate the plurality of sliding sleeves may limit the total number of production zones while restricting the flow of fluid to the formation during fracturing, necessitating the use of high pressure and low viscosity fluids to provide adequate flow rates to the formation. Moreover, the use of multiple balls of varying sizes may also complicate the fracturing operation and increase the possibility of issues in performing the operation, such as balls getting stuck during pumping and failing to successfully actuate their intended sliding sleeve.

SUMMARY OF THE DISCLOSURE

A flow transported obturating tool for actuating a valve in a wellbore comprises a housing comprising a radially translatable engagement assembly; a core slidably disposed in the housing; an interrupt member disposed radially between the core and the housing; a bore sensor disposed in the housing and in engagement with the interrupt member; and a biasing member disposed in the housing and in engagement with the interrupt member. In some embodiments, the interrupt member includes a first position permitting relative movement between the core and the housing, and a second position that restricts relative movement between the core and the housing. In some embodiments, a central axis of the interrupt member is offset from a central axis of the bore when the interrupt member is disposed in the first position, and wherein the central axis of the interrupt member is aligned with the central axis of the core when the interrupt member is in the second position. In certain embodiments, the biasing member is configured to bias the interrupt member towards the first position. In certain embodiments, the core comprises a shoulder configured to engage a shoulder of the interrupt member when the interrupt member is in the first position. In some embodiments, the interrupt member comprises an interrupt ring disposed about the core. In some embodiments, the engagement assembly is configured to shift the valve from a first closed position to an open position when the core is in a first position relative to the housing; and the engagement assembly is configured to shift the valve from the open position to a second closed position in response to the core being displaced from the first position to a second position that is spaced from the first position in a first axial direction. In some embodiments, the interrupt member is configured to prevent the obturating tool from unlocking from the valve until the valve enters the second closed position. In certain embodiments, the obturating tool further comprises an actuation assembly configured to control the position of the core in the housing, wherein the actuation assembly comprises an electronically actuated solenoid valve. In certain embodiments, the interrupt member comprises a C-ring having a pair of terminal ends matingly received in slots of the bore sensor.

An embodiment of a flow transported obturating tool for actuating a valve in a wellbore comprises a housing comprising a radially translatable engagement assembly; a core slidably disposed in the housing; an interrupt member disposed radially between the core and the housing; and a bore sensor disposed in the housing and in engagement with the interrupt member; wherein the interrupt member includes a radially offset position permitting relative movement between the core and the housing, and a radially centralized position that restricts relative movement between the core and the housing. In some embodiments, the obturating tool further comprises a biasing member disposed in the housing and in engagement with the interrupt member. In some embodiments, the biasing member is configured to bias the interrupt member towards the radially offset position. In certain embodiments, a central axis of the interrupt member is offset from a central axis of the bore when the interrupt member is disposed in the radially offset position, and wherein the central axis of the interrupt member is aligned with the central axis of the core when the interrupt member is in the radially centralized position. In some embodiments, the core comprises a shoulder configured to engage a shoulder of the interrupt member when the interrupt member is in the radially offset position. In some embodiments, the interrupt member comprises an interrupt ring disposed about the core. In certain embodiments, the engagement assembly is configured to shift the valve from a first closed position to an open position when the core is in a first position relative to the housing; and the engagement assembly is configured to shift the valve from the open position to a second closed position in response to the core being displaced from the first position to a second position that is spaced from the first position in a first axial direction. In certain embodiments, the interrupt member is configured to prevent the obturating tool from unlocking from the valve until the valve enters the second closed position. In some embodiments, the obturating tool further comprises an actuation assembly configured to control the position of the core in the housing, wherein the actuation assembly comprises an electronically actuated solenoid valve. In some embodiments, the interrupt member comprises a C-ring having a pair of terminal ends matingly received in slots of the bore sensor.

BRIEF DESCRIPTION OF THE DRAWINGS

For a more detailed description of embodiments of the invention, reference will now be made to the accompanying drawings, wherein:

FIG. 9 is a section view along lines 9-9 of the obturating tool shown in FIG. 3C;

FIG. 10 is a section view along lines 10-10 of the obturating tool shown in FIG. 3C;

FIG. 11 is a section view along lines 11-11 of the obturating tool shown in FIG. 3C;

FIG. 12 is a section view along lines 12-12 of the obturating tool shown in FIG. 3C;

FIG. 13 is a section view along lines 13-13 of the obturating tool shown in FIG. 3C;

FIG. 14 is a section view along lines 14-14 of the actuation assembly shown in FIG. 4B;

DETAILED DESCRIPTION

Figure 1:
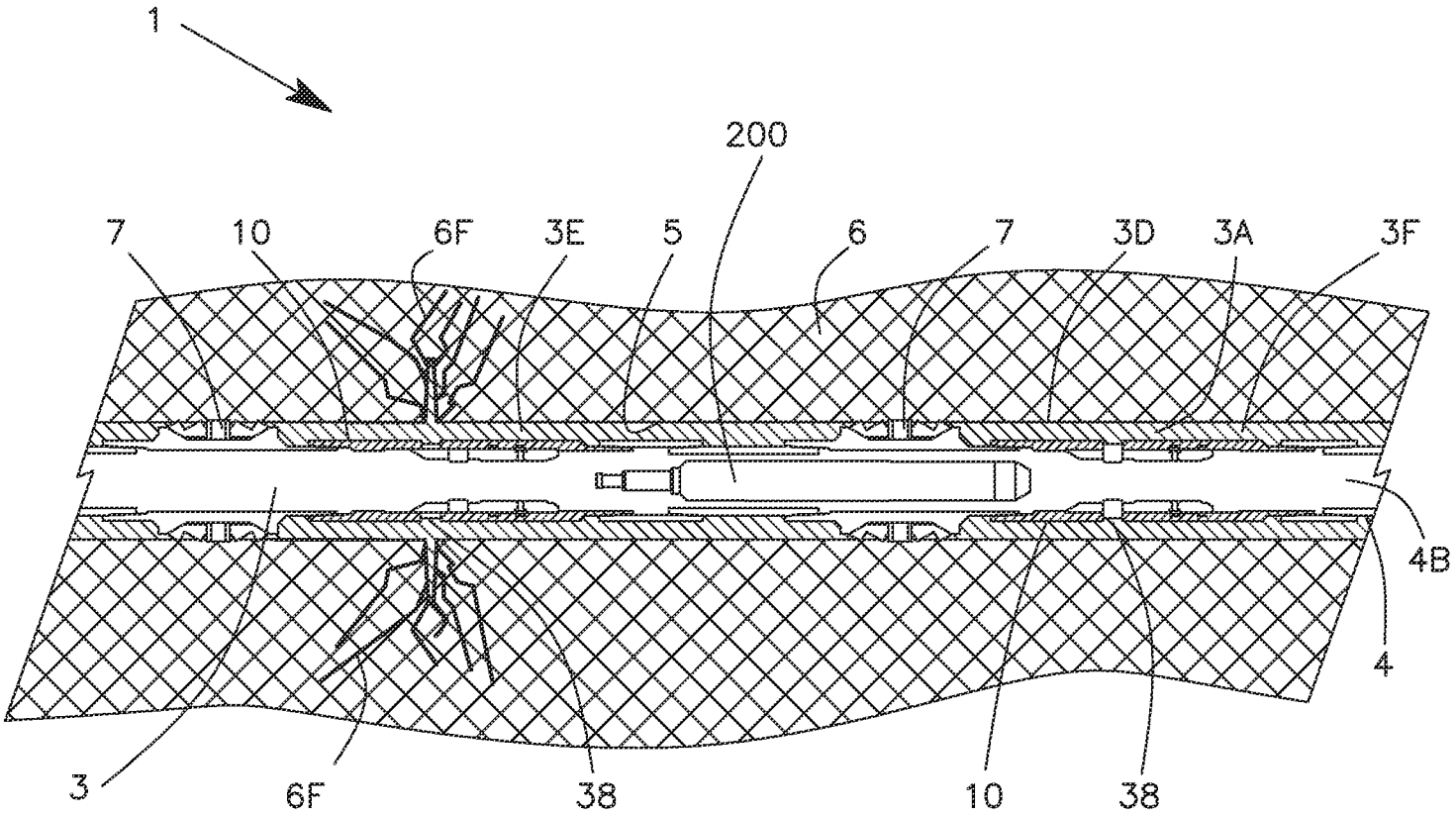
FIG. 1 is a schematic view of an embodiment of a well system in accordance with principles disclosed herein.

The following description is exemplary of embodiments of the disclosure. These embodiments are not to be interpreted or otherwise used as limiting the scope of the disclosure, including the claims. One skilled in the art will understand that the following description has broad application, and the discussion of any embodiment is meant only to be exemplary of that embodiment, and is not intended to suggest in any way that the scope of the disclosure, including the claims, is limited to that embodiment. The drawing figures are not necessarily to scale. Certain features and components disclosed herein may be shown exaggerated in scale or in somewhat schematic form, and some details of conventional elements may not be shown in the interest of clarity and conciseness. In some of the figures, one or more components or aspects of a component may be not displayed or may not have reference numerals identifying the features or components that are identified elsewhere in order to improve clarity and conciseness of the figure.

The terms "including" and "comprising" are used herein, including in the claims, in an open-ended fashion, and thus should be interpreted to mean "including, but not limited to . . . ." Also, the term "couple" or "couples" is intended to mean either an indirect or direct connection. Thus, if a first component couples or is coupled to a second component, the connection between the components may be through a direct engagement of the two components, or through an indirect connection that is accomplished via other intermediate components, devices and/or connections. If the connection transfers electrical power or signals, the coupling may be through wires or through one or more modes of wireless electromagnetic transmission, for example, radio frequency, microwave, optical, or another mode. In addition, as used herein, the terms "axial" and "axially" generally mean along or parallel to a given axis (e.g., central axis of a body or a port), while the terms "radial" and "radially" generally mean perpendicular to the axis. For instance, an axial distance refers to a distance measured along or parallel to the axis, and a radial distance means a distance measured perpendicular to the axis.

Referring to FIG. 1, an embodiment of a well system 1 is schematically illustrated. Well system 1 generally includes a wellbore 3 extending through a subterranean formation 6, where the wellbore 3 includes a generally cylindrical inner surface 5, a vertical section extending from the surface (not shown) and a deviated section 3D extending horizontally through the formation 6. The deviated section 3D of wellbore 3 extends from a heel (not shown) disposed at the lower end of vertical section and a toe (not shown) disposed at a terminal end of wellbore 3. In the embodiment of well system 1, the wellbore 3 is an open hole wellbore, and thus, the inner surface 5 of wellbore 3 is not lined with a cemented casing or liner, allowing for fluid communication between formation 6 and wellbore 3.

Well system 1 also includes a well string 4 disposed in wellbore 3 having a bore 4B extending therethrough, forming an annulus 3A in wellbore 3 between the inner surface 5 of wellbore 3 and an outer surface of well string 4. Well string 4 includes a plurality of isolation packers 7 and sliding sleeve valves 10. Specifically, each sliding sleeve 10 of well string 4 is disposed between a pair of isolation packers 7. Each isolation packer 7 is configured to seal against the inner surface 5 of the wellbore 3, forming discrete production zones 3E and 3F in wellbore 3, where fluid communication between production zones 3E and 3F is restricted. Although not shown in FIG. 1, well string 4 includes additional isolation packers 7, sliding sleeve valves 10, and discrete production zones extending to the toe of the deviated section 3D of the wellbore 3. As will be described further herein, sliding sleeve valves 10 are configured to provide selectable fluid communication to the wellbore 3 via a plurality of circumferentially spaced ports 38 in response to actuation from an actuation or obturating tool.

As will be discussed further herein, each sliding sleeve valve 10 in the embodiment of FIG. 1 includes an upper-closed position, an open position, and a lower-closed position. Well system 1 includes an obturating tool 200 configured to actuate each sliding sleeve valve 10 between the upper-closed, open, and lower-closed positions. Although in the embodiment of FIG. 1 sliding sleeve valves 10 include three positions, in other embodiments, the valves 10 of well system 1 may include two position valves. In the embodiment of FIG. 1, each sliding sleeve valve 10 is disposed in the upper-closed position prior to the insertion of obturating tool 200 into the bore 4B of well string 4. FIG. 1 illustrates well system 1 following the production of fractures 6F in formation 6 at production zone 3E via obturating tool 200. FIG. 1 also illustrates the sliding sleeve valve 10 of production zone 3E actuated into the lower-closed position by obturating tool 200, with the obturating tool 200 being displaced from the sliding sleeve valve 10 of production zone 3E towards the sliding sleeve valve 10 of production zone 3F, which is disposed in the upper-closed position. In this manner, the formation 6 at production zone 3F may be hydraulically fractured, and each production zone proceeding towards the toe of wellbore 3 may be successively fractured. Once the formation 6 at each production zone (e.g., production zones 3E, 3F, etc.) has been hydraulically fractured using obturating tool 200, and the obturating tool 200 is disposed proximal the toe of wellbore 3, where obturating tool 200 may be fished and removed from the well string 4.

Referring to FIGS. 2A-5, an embodiment of a sliding sleeve valve 10 is illustrated. Lockable sliding sleeve valve 10 is generally configured to provide selectable fluid communication to a desired portion of a wellbore. For instance, in a hydraulic fracturing operation a plurality of sliding sleeve valves 10 may be incorporated into a completion string disposed in an open hole wellbore, where one or more sliding sleeve valves 10 are isolated via a plurality set packers in a series of discrete production zones. In this arrangement, sliding sleeve valve 10 is configured to provide selective fluid communication with a chosen production zone of the wellbore, thereby allowing the chosen production zone to be individually hydraulically fractured or produced.

Figure 2A:
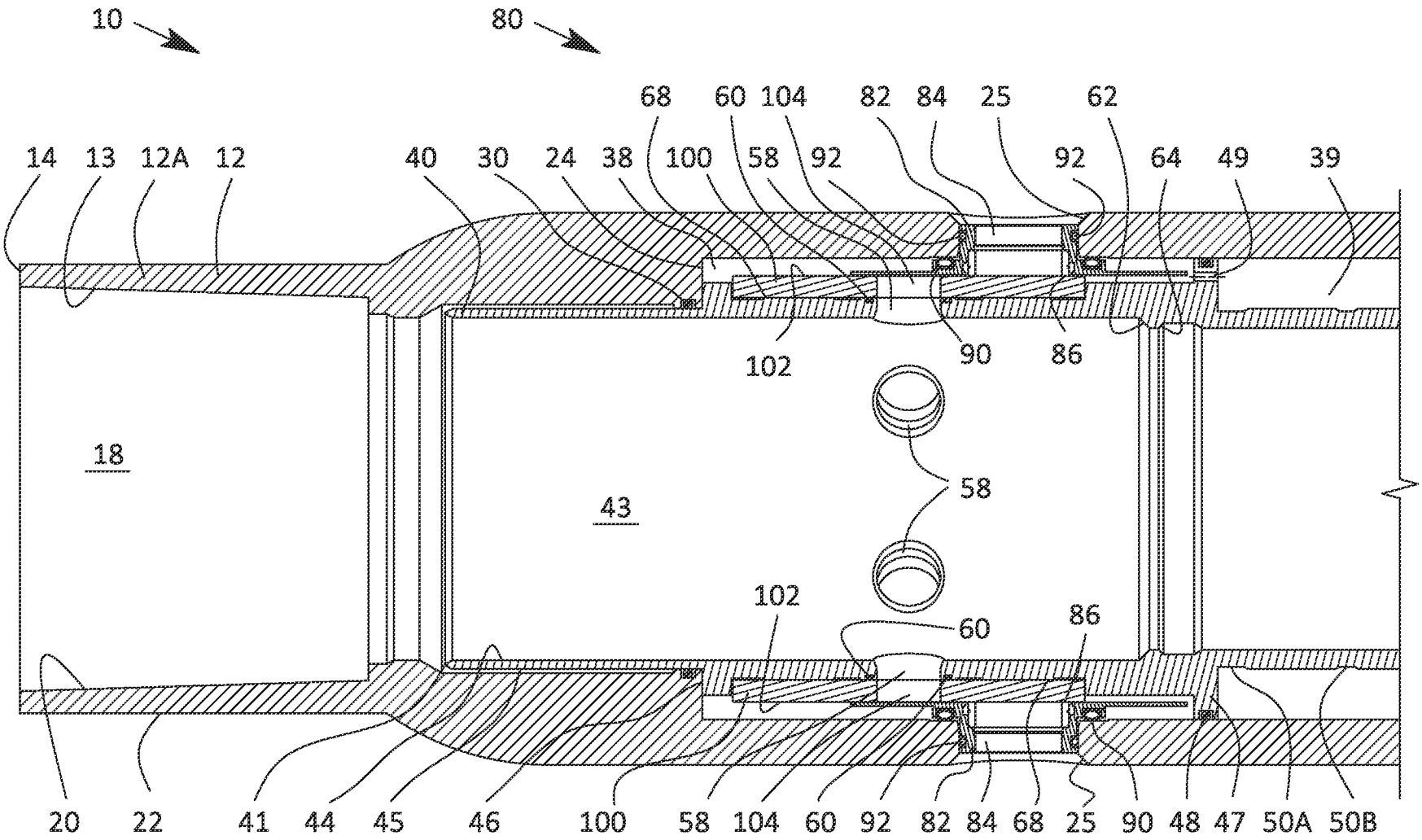
FIG. 2A is a section view of the uppermost end of an embodiment of a sliding sleeve valve in accordance with principles disclosed herein.
Figure 2B:
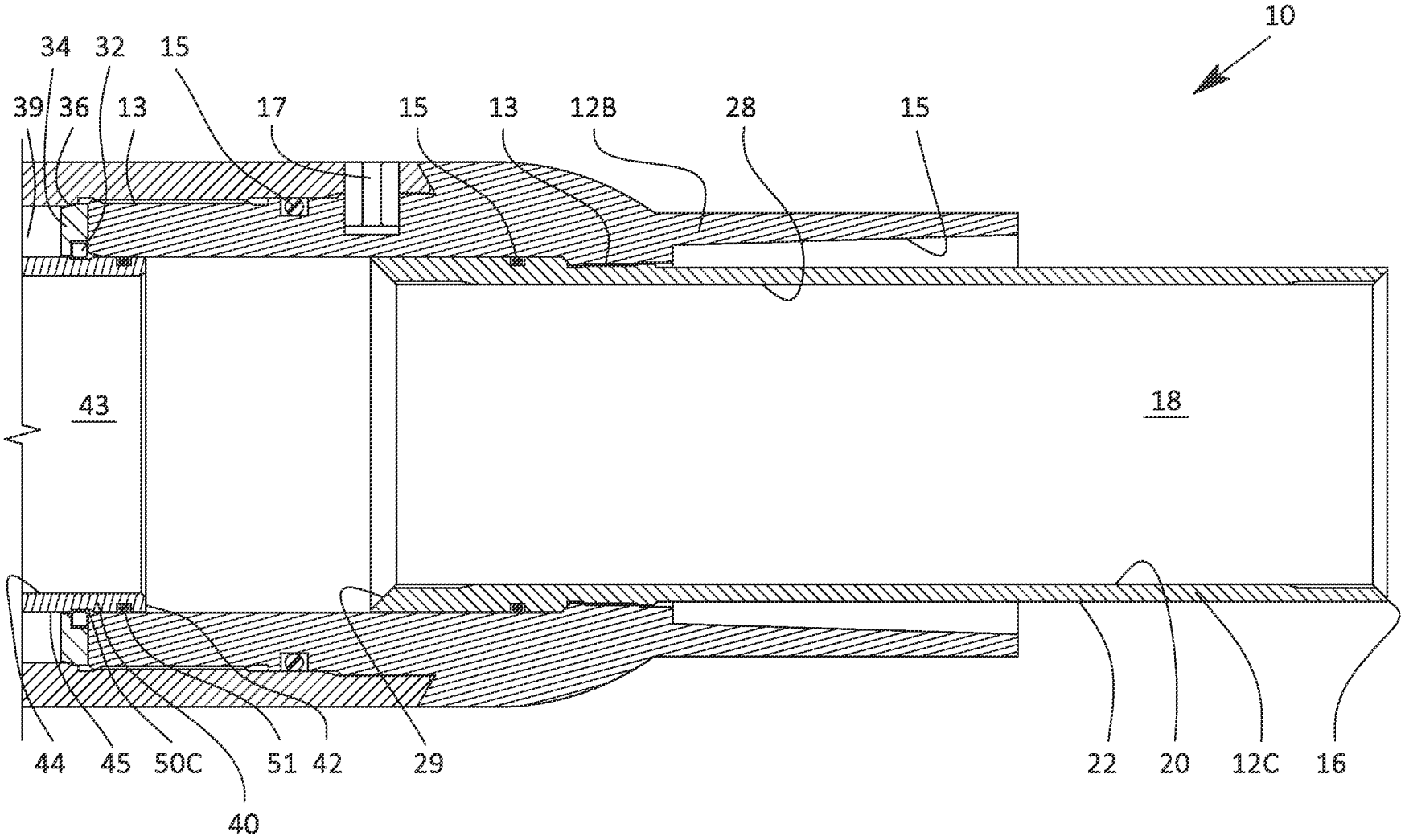
FIG. 2B is a section view of the lowermost end of the sliding sleeve valve shown in FIG. 2A.
Figure 3A:
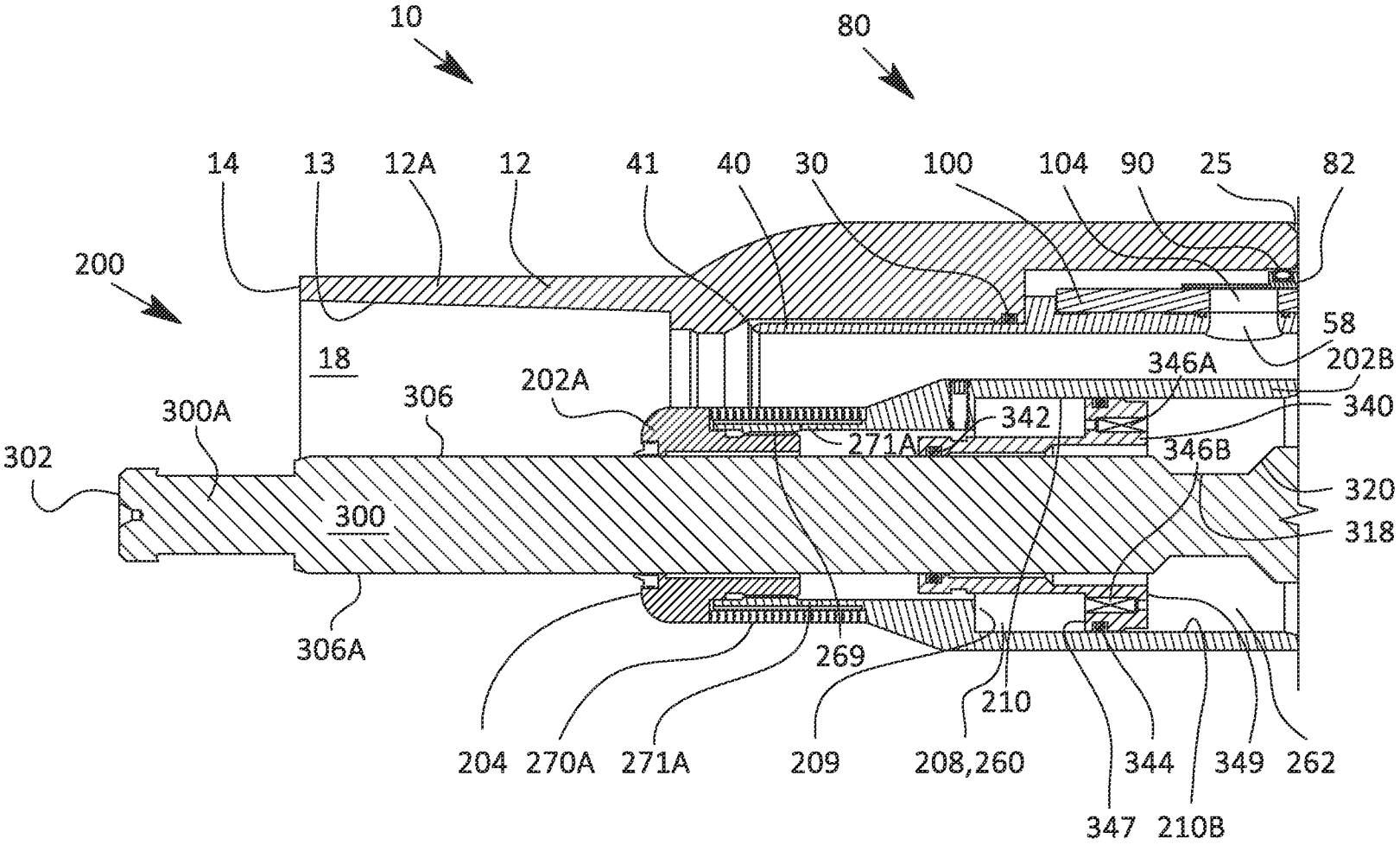
FIG. 3A is a section view of an uppermost end of an embodiment of a flow transported obturating tool disposed in a first position for actuating the sliding sleeve valve shown in FIGS. 2A, 2B in accordance with principles disclosed herein.
Figure 3B:
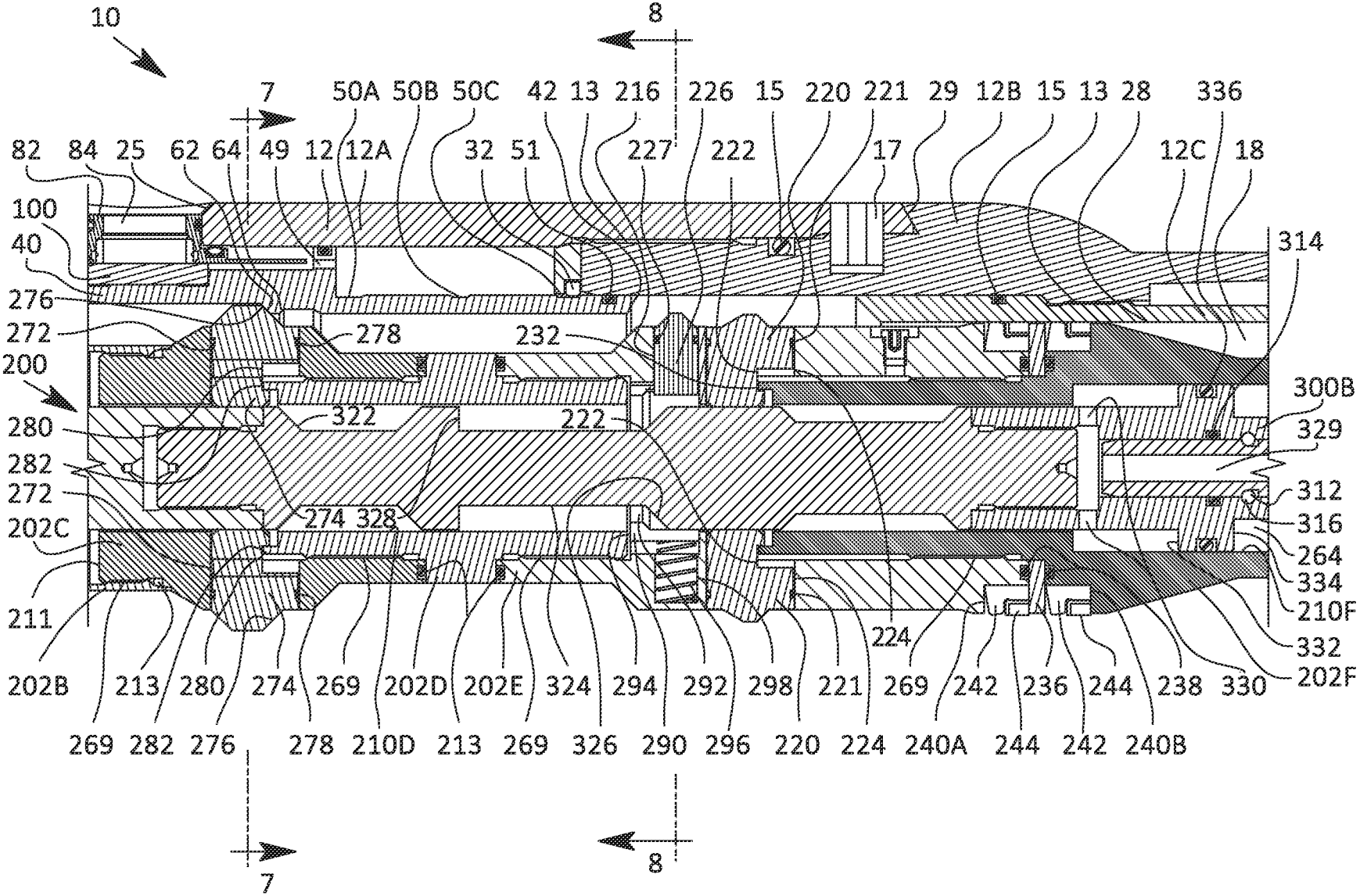
FIG. 3B is a section view of an intermediate section of the obturating tool shown in FIG. 3A.
Figure 3C:
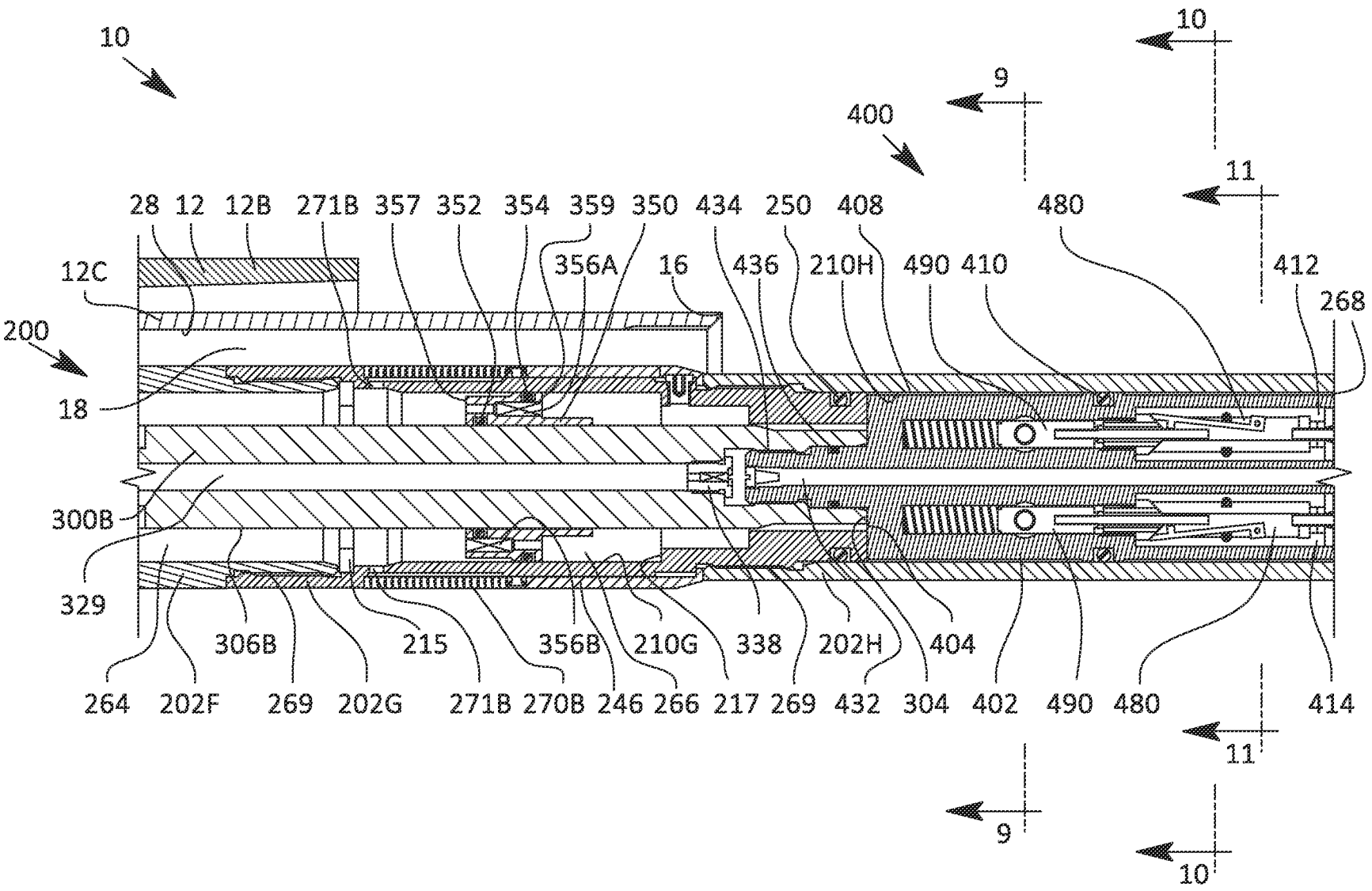
FIG. 3C is a section view of another intermediate section of the obturating tool shown in FIG. 3A.
Figure 3D:
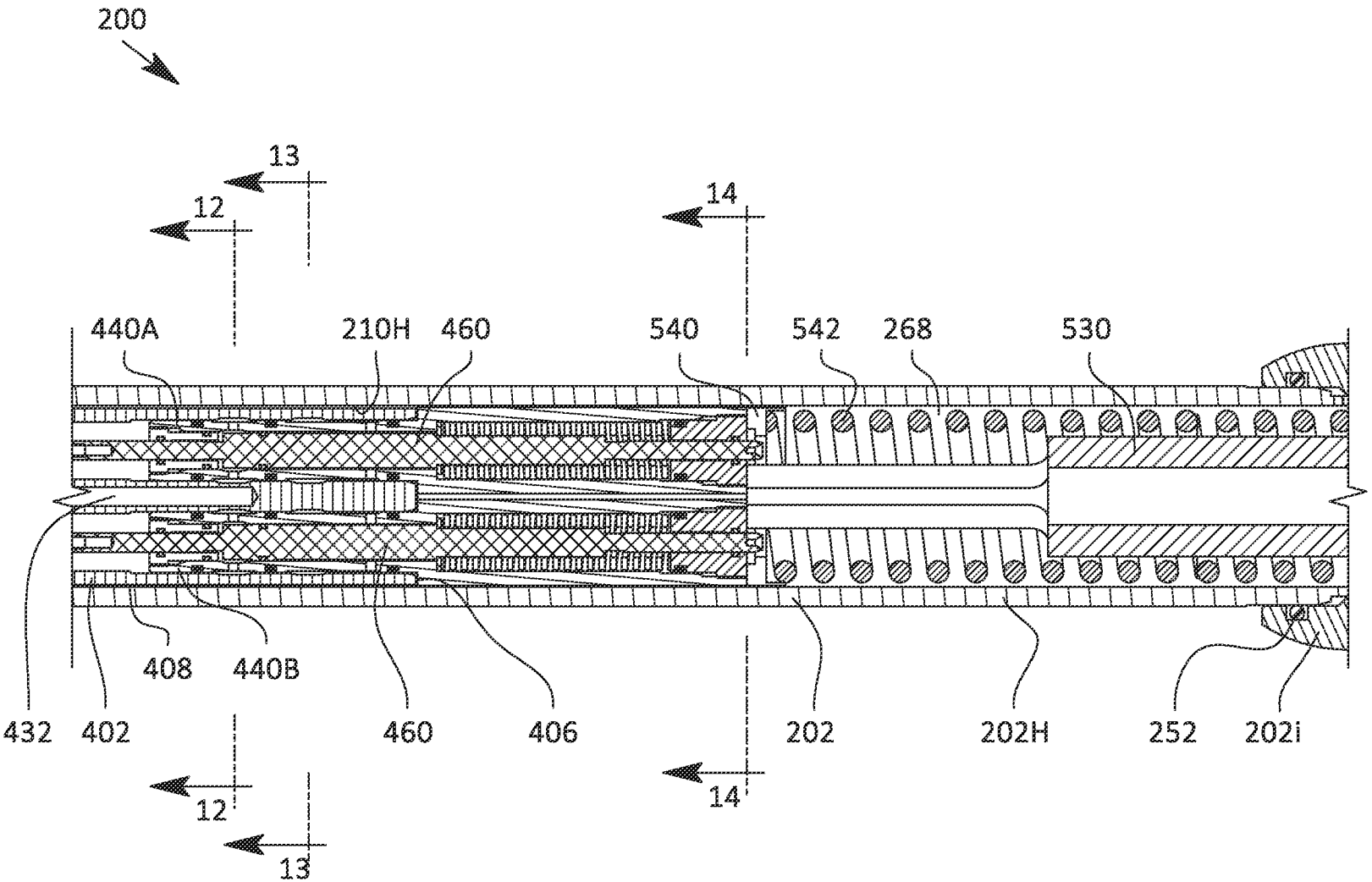
FIG. 3D is a section view of another intermediate section of the obturating tool shown in FIG. 3A.
Figure 3E:
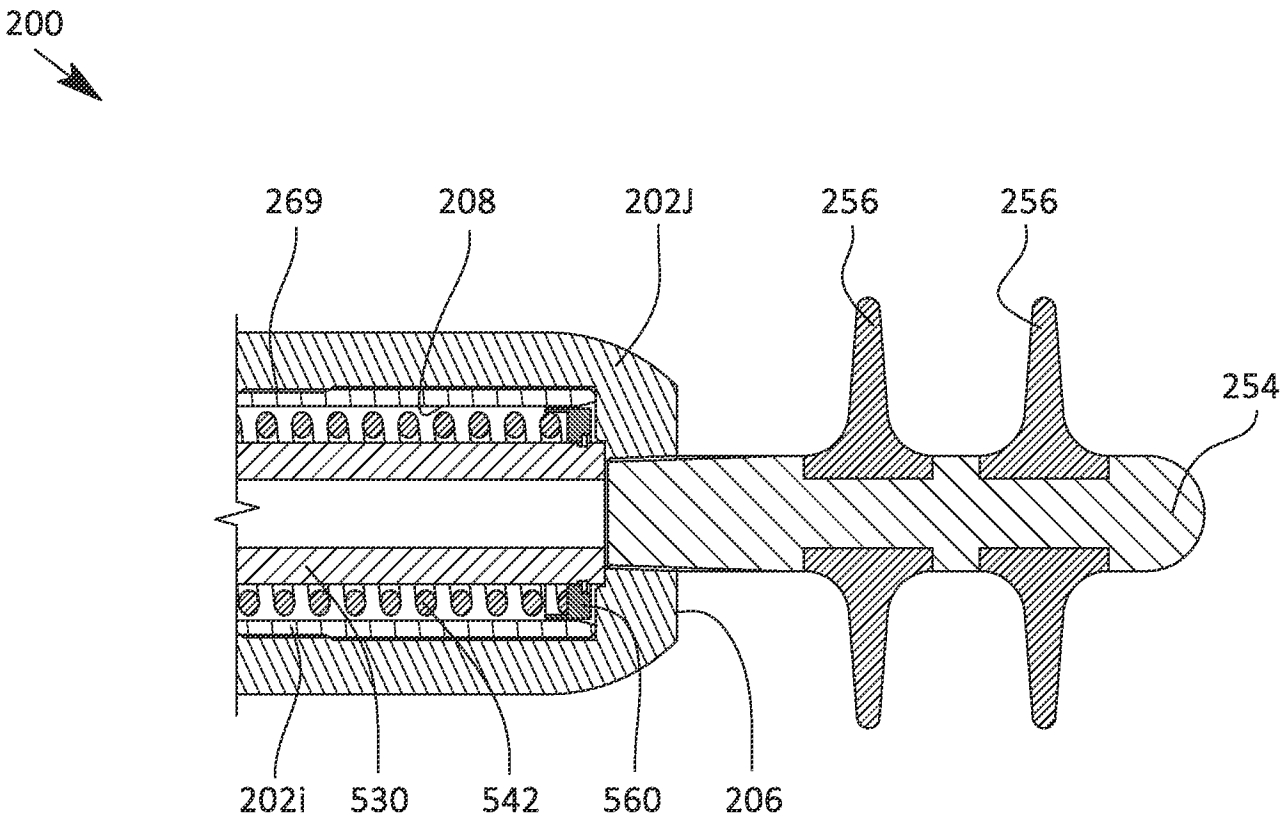
FIG. 3E is a section view of the lowermost end of the obturating tool shown in FIG. 3A.
Figure 4A:
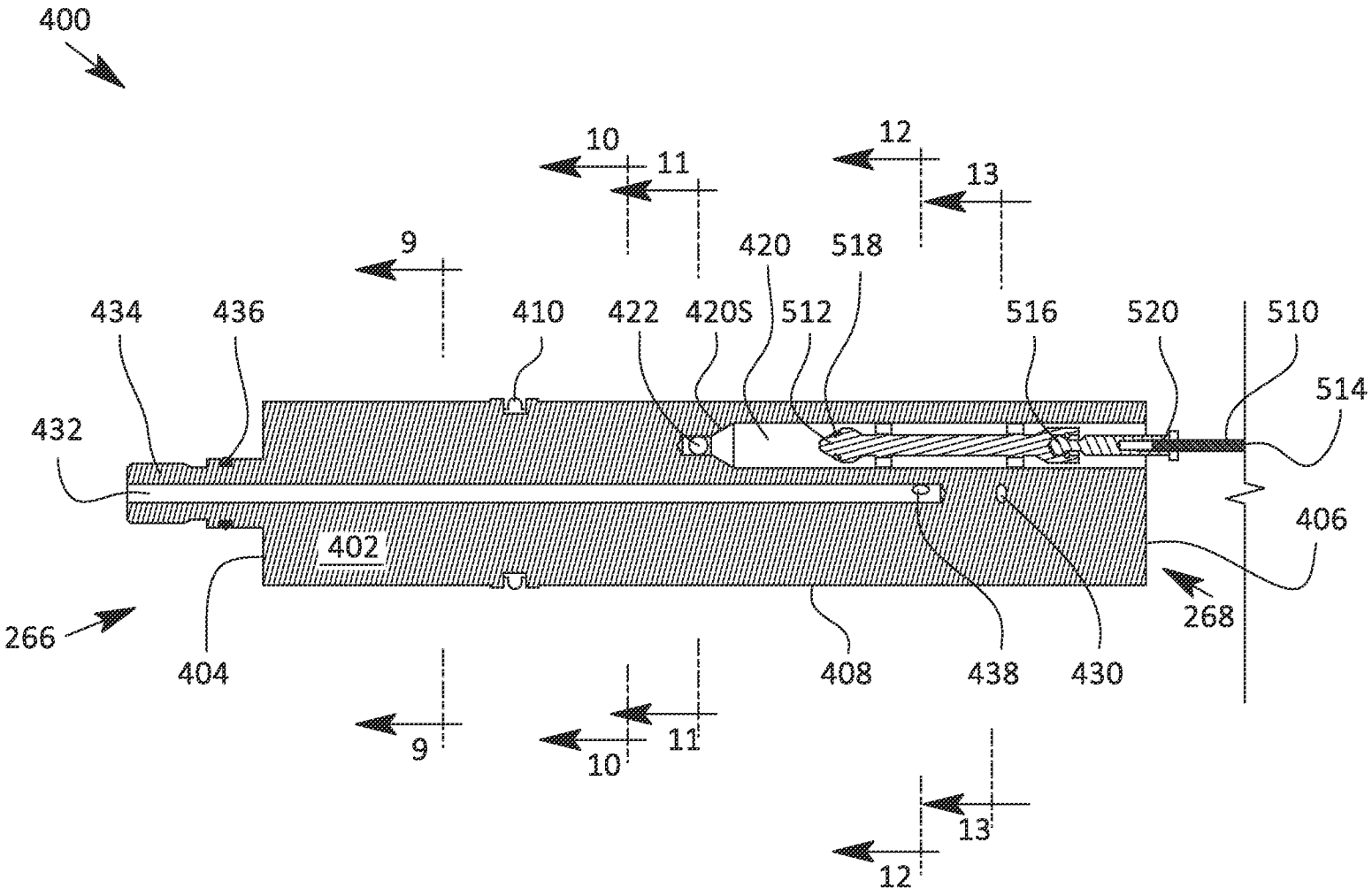
FIG. 4A is a section view along lines 4-4 of FIG. 14 of an uppermost end of an embodiment of an actuation assembly of the obturating tool of FIGS. 3A-3E in accordance with principles disclosed herein.
Figure 4B:
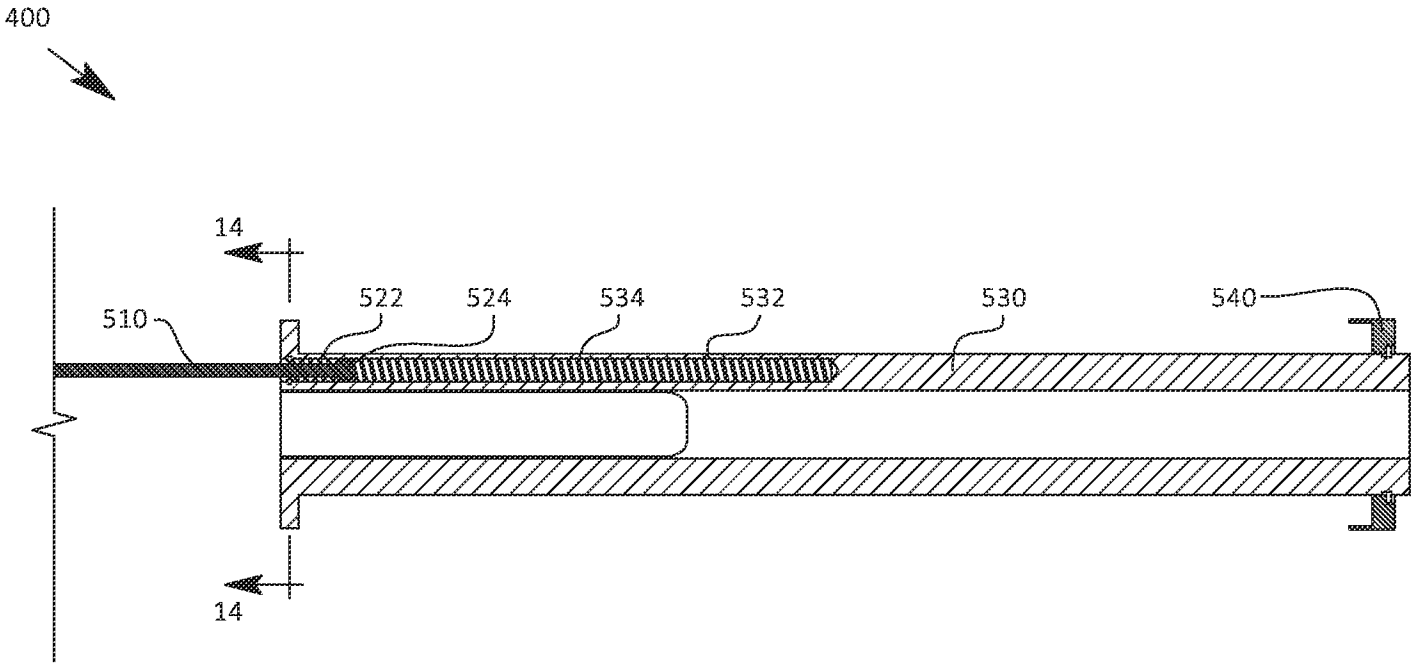
FIG. 4B is a section view along lines 4-4 of FIG. 14 of a lowermost end of the actuation assembly of FIG. 53A.
Figure 5:
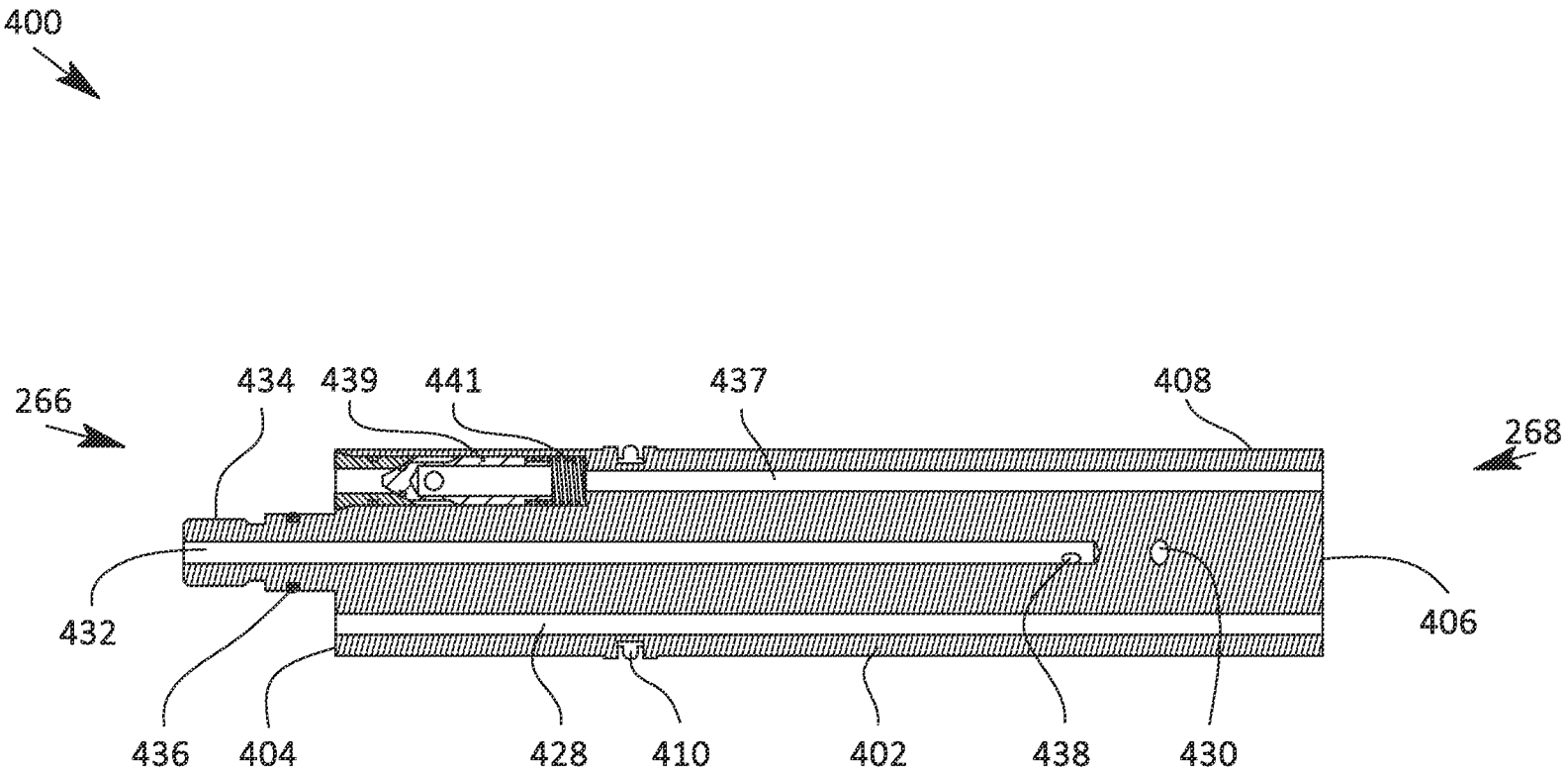
FIG. 5 is a section view along lines 5-5 of FIG. 14 of the actuation assembly of FIGS. 4A, 4B.
Figure 6:
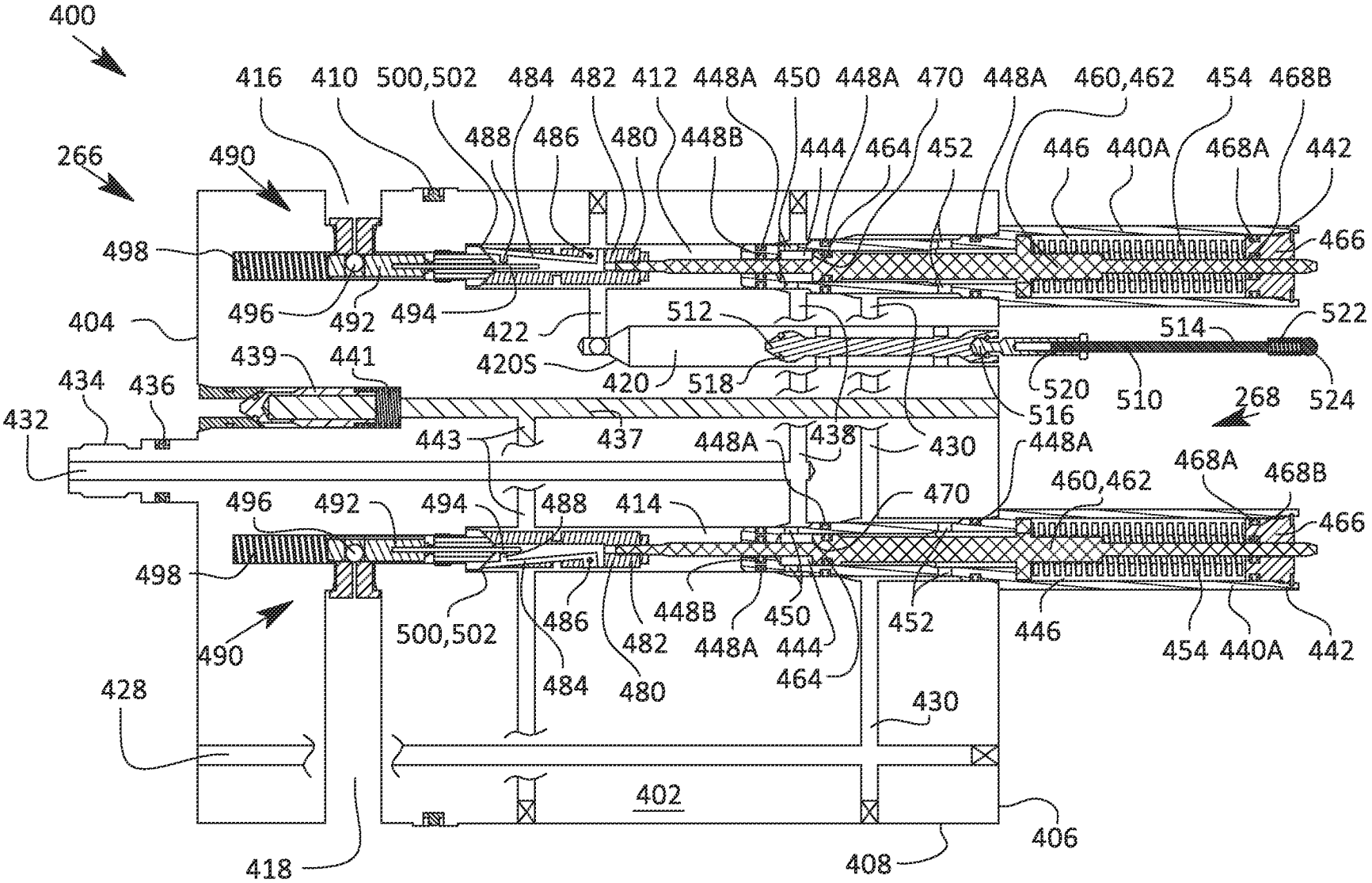
FIG. 6 is a top view of the actuation assembly of FIGS. 4A, 4B (shown as unrolled for clarity)
Figure 8:
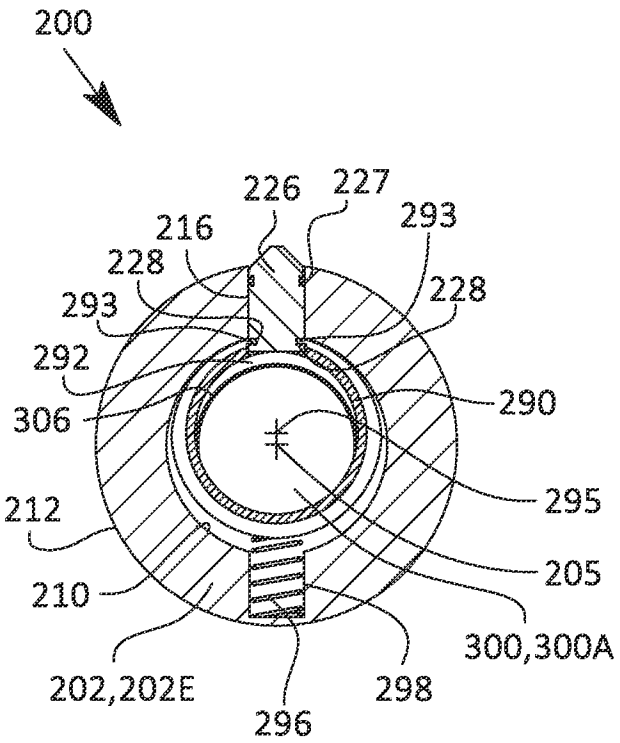
FIG. 8 is a section view along lines 8-8 of the obturating tool shown in FIG. 3B.

In the embodiment of FIGS. 2A, 2B, sliding sleeve valve 10 has a central or longitudinal axis and includes a housing 12, a sliding sleeve or carrier member 40, and seal assembly 80. Tubular housing 12 includes a first or upper box end 14, a second or lower end 16, a central bore or passage 18 extending between first end 14 and second end 16 that is defined by a generally cylindrical inner surface 20, and a generally cylindrical outer surface 22 extending between ends 14 and 16.

In this embodiment, housing 12 is made up of a series of segments including a first or upper segment 12A, a second or intermediate segment 12B, and a third or lower segment 12C releasably coupled to upper segment 12A. Segments 12A-12C of housing 12 are releasably coupled via a plurality of releasable or threaded connector 13. The connections between segments 12A-12C of housing 12 are sealed via annular seals 15 disposed therebetween. Additionally, in this embodiment, relative rotation between upper segment 12A and intermediate segment 12B is restricted via a radially extending member or pin 17 positioned therebetween; however, in other embodiments, housing 12 may not include pin 17. In this embodiment, the inner surface 20 of the upper segment 12A of housing 12 includes a releasable or threaded connector 13 while the inner surface 20 of intermediate segment 12B also includes an additional threaded connector 13. Threaded connectors 13 are configured to couple sliding sleeve valve 10 with well string 4. In this embodiment, housing 12 includes a plurality of circumferentially spaced ports 25, where each port 25 extends radially between inner surface 20 and outer surface 22.

The inner surface 20 of housing 12 includes an annular first or upper shoulder 24, and an annular second or lower shoulder 26. Additionally, inner surface 20 includes a seal bore 28 and an annular landing profile or "no-go" shoulder 29, where seal bore 28 extends axially between landing profile 29 and the lower end 16 of housing 12. In this embodiment, an annular seal 30 is positioned in an annular groove formed in inner surface 20 and positioned adjacently upward from upper shoulder 24. In this embodiment, a detent ring 32 is positioned radially between housing 12 and carrier 40, adjacent lower shoulder 26. Detent ring 32 is axially locked with housing 12 via a retainer ring 34 that is pinned between an upper end of the lower segment 12B of housing 12 and an annular shoulder 36 of upper segment 12A. Detent ring 32 comprises a solid, continuous ring that extends 360 degrees about carrier 40. In this embodiment, detent ring 32 comprises Beryllium copper; however, in other embodiments, detent ring 32 may comprise various materials.

The carrier 40 of sliding sleeve valve 10 has a first or upper end 41, a second or lower end 42, a central bore or passage 43 defined by a generally cylindrical inner surface 44 extending between ends 41, 42, and a generally cylindrical outer surface 45 extending between ends 41, 42. In this embodiment, the outer surface 45 of carrier 40 includes an annular, radially outwards extending shoulder 46 and a radially outwards extending flange 47. The flange 47 of carrier 45 includes an annular outer groove that receives an annular first or upper seal 48 that sealingly engages the inner surface 20 of housing 12. Flange 45 additionally includes at least one axial port 49 extending therethrough. In this embodiment, the outer surface 45 of carrier 40 also includes a plurality of axially spaced, annular grooves 50A, 50B, 50C, respectively, located between flange 47 and the lower end 42 of carrier 40, and an annular second or lower seal 51 located proximal lower end 42.

The seal 30 of housing 12 sealingly engages the outer surface 45 of carrier 40 while the lower seal 51 of carrier 40 sealingly engages the inner surface 20 of housing 12. In this configuration, a first or upper annular chamber 38 is formed in housing 12 between inner surface 20 and the outer surface 45 of carrier 40, where upper chamber 38 extends between seal 30 of housing 12 and upper seal 48 of carrier 40. Additionally, a second or lower annular chamber 39 is formed in housing 12 between inner surface 20 and the outer surface 45 of carrier 40, where lower chamber 39 extends between upper seal 48 and lower seal 51 of carrier 40. Fluid communication between chambers 38 and 39 is permitted only through axial passage 48, which acts as a fluid restriction or flow restrictor for damping relative axial movement between carrier 40 and housing 12. In other words, as carrier 40 travels axially relative to housing 12, fluid is forced through the flow restriction provided by axial passage 48, thereby damping or resisting the relative motion between carrier 40 and housing 12.

In this embodiment, carrier 40 of sliding sleeve valve 10 includes a plurality of circumferentially spaced ports 58, with each port 58 extending radially between the inner surface 44 and outer surface 45. Carrier 40 also includes a plurality of circumferentially spaced annular seals 60 disposed in outer surface 56. Particularly, each seal 60 is disposed about or encircles a corresponding port 58 of carrier 40; however, in other embodiments, carrier 40 may not include seals 60. The inner surface 44 of carrier 40 includes an annular first or upper shoulder 62 and an annular second or lower shoulder 64 disposed directly adjacent upper shoulder 62. Additionally, the outer surface 45 of carrier 40 includes a plurality of circumferentially spaced, elongate slots 68, where each elongate slot 68 comprises a planar or flat surface.

Seal assembly 80 of sliding sleeve valve 10 is configured to provide selective fluid communication between the bore 18 of housing 12 and wellbore 3 depending upon the relative axial position of carrier 50 and housing 12. Each seal assembly 80 generally includes a plurality of circumferentially spaced first sealing members or floating seats 82, and a plurality of circumferentially spaced second sealing or planar members 100. Each floating seat 82 is generally cylindrical and has a central or longitudinal axis disposed orthogonal the central axis of sliding sleeve valve 10. Each floating seat 82 has a central bore or passage 84 extending between a first or outer end and a second or inner end 86, where inner end 86 comprises a first sealing surface 86. Additionally, each floating seat 82 comprises an outer surface that includes an annular shoulder that receives a biasing member 90 therein. In some embodiments, biasing members 90 of floating seats 82 comprise wave springs. Further, the outer surface of each floating seat 82 includes an annular seal 92, such as a T-seal, disposed therein and located proximal the outer end of floating seat 82. The seal 92 of each floating seat 82 sealingly engages the inner surface of a corresponding port 38 of housing 12 in which the floating seat 82 is received. Although the embodiment of floating seats 82 of FIGS. 2A, 2B includes seals 92, in other embodiments, floating seats 82 may not include seals 92.

In this embodiment, planar members 100 each extend axially along the central axis of sliding sleeve valve 10 and include an outer or second sealing surface 102 and a central port or passage 104 extending radially therethrough, where port 104 of each planar member 100 is axially and angularly aligned with a corresponding port 58 of carrier 40, thereby providing fluid communication therebetween. Each planar member 100 is received in a corresponding slot 68 of carrier 40. In this embodiment, the axial length of each planar member 100 is less than the axial length of the corresponding slot 68 of carrier 40, providing for a limited amount of relative axial movement between planar member 100 and carrier 40; however, in other embodiments, relative axial movement between planar members 100 and carrier 40 may be restricted.

A metal-to-metal seal is formed between the first sealing surface 86 of each floating seat 82 and the second sealing surface 102 of a corresponding planar member 100. In some embodiments, floating seats 82 and planar members 100 of seal assembly 80 are formed from or comprise a hardened material, such as beryllium copper; however, in other embodiments, floating seats 82 and planar members 100 may be formed from a variety of materials. In the configuration shown in FIGS. 2A, 2B, biasing members 90 act against the outer shoulder of each port 38 to bias floating seats 82 into sealing engagement with planar members 100. Thus, sealing engagement may be maintained between sealing surfaces 86 and 102 in the event of floating seats 82 or planar members 100 being exposed to a pressure differential or other force acting against the contact formed between first and second sealing surfaces 86 and 102. In some embodiments, an annular seal may be disposed about the central bore 84 of each floating seat 82 in the inner end 86 to sealingly engage the sealing surface 102 of a corresponding planar member 100.

Sliding sleeve valve 10 comprises a three position sliding sleeve valve having an upper-closed position (shown in FIGS. 2A, 2B), an open position, and a lower-closed position. In the upper-closed position of sliding sleeve valve 10, flange 46 of carrier 40 is disposed directly adjacent or engages the upper shoulder 24 of housing 12 and detent ring 32 is disposed in a radially inner position received at least partially in the lower groove 50C of carrier 40. Additionally, in the upper-closed position, floating seats 82 are in sealing engagement with planar members 100 to thereby restrict fluid communication between bore 18 of housing 12 with the surrounding environment (i.e., annulus 3A of the wellbore 3 shown in FIG. 1).

In the open position of sliding sleeve valve 10, detent ring 32 is disposed in the radially inner position received in the intermediate groove 50B of carrier 40 and each end 41, 42 of carrier 40 is axially spaced from shoulders 24, 26 of housing 12, respectively. Additionally, in the open position of sliding sleeve valve 10, ports 58 of carrier 40 axially align with bores 84 of floating seats 82 to permit fluid communication therebetween, and in-turn, between bore 18 of housing 12 and the surrounding environment. In the lower-closed position of sliding sleeve valve 10, detent ring 32 is disposed in the radially inner position received in the upper groove 50A of carrier 40 while an annular lower surface of flange 47 is disposed directly adjacent or contacts the lower shoulder 26 of housing 12. Additionally, in the lower-closed position, ports 58 of carrier 40 are in sufficient axial misalignment with bores 84 of floating seats 82 to restrict fluid communication therebetween via sealing engagement between sealing surfaces 86 and 102. When sliding sleeve valve 10 is actuated between the upper-closed, open, and lower-closed positions, detent ring 32 is forced to elastically deform into a radially expanded position spaced from grooves 50A, 50B, and 50C to permit relative axial movement between carrier 40 and housing 12. In this manner, detent ring 32 acts to secure sliding sleeve valve 10 into one of its upper-closed, open, and lower-closed positions without the need of locking mechanisms or shear members.

Referring to FIGS. 3A-14, another embodiment of an untethered, flow transported obturating tool 200 of well system 1 is shown in FIGS. 3A-14, where obturating tool 200 is configured to actuate one or more of the sliding sleeve valves described herein (e.g., sliding sleeve valve 10) between their respective upper-closed, open, and lower-closed positions. Obturating tool 200 can be disposed in the bore 4B of well string 4 at the surface of wellbore 3 and pumped downwards through wellbore 3 towards the heel of wellbore 3, where obturating tool 200 can selectively actuate one or more sliding sleeve valves 10 moving from the heel of wellbore 3 to the toe of wellbore 3.

In the embodiment of FIGS. 3A-14, obturating tool 200 generally includes a cylindrical housing 202, a cam or core 300 slidably disposed therein, and an actuation assembly 400 configured to control the actuation or displacement of core 300 in housing 202. Housing 202 has a first or upper end 204, a second or lower end 206, a central bore or passage 208 defined by a generally cylindrical inner surface 210 extending between ends 204 and 206, and a generally cylindrical outer surface 212 extending between ends 204 and 206. Housing 202 includes a first or upper filter 270A and a plurality of circumferentially spaced upper ports 271A configured to permit fluid communication between bore 208 of housing 202 and the surrounding environment. In this embodiment, upper filter 270A comprises a plurality of annular, axially stacked washers.

In this embodiment, housing 202 comprises a plurality of segments releasably coupled together via threaded couplers 269, including an upper segment 202A, intermediate segments 202B-202H, and a lower segment 202I. The connections formed between each segment 202A-2021 of housing 202 is sealed via one or more annular seals, including annular seals 213 positioned between intermediate segments 202B and 202C, 202C and 202D, and 202D and 202E of housing 202, an annular seal 214 positioned between intermediate segments 202C and 202D, an annular seal 250 positioned between intermediate segments 202G and 202H, and an annular seal 252 positioned between intermediate segment 202H and lower segment 202I.

In this embodiment, housing 202 includes a first plurality of circumferentially spaced upper slots 272, a second plurality of circumferentially spaced intermediate slots 216, and a third plurality of circumferentially spaced lower slots 224, where intermediate slots 216 are axially positioned between slots 226 and 224. Upper slots 272 of housing 202 each receive a first or upper key or engagement member 274 therein. Each upper key 274 includes an engagement shoulder 276 and an annular seal 278 that sealingly engages an inner surface of the corresponding upper slot 272. Additionally, each upper key 274 includes a slot 280 configured to receive an axially extending lip 282 that forms the upper end of intermediate segment 202D of housing 202. With lip 282 of intermediate segment 202D received in the slot 280 of each upper key 274, upper keys 274 are permitted to radially translate between radially inner and outer positions while remaining restrained or coupled with housing 202.

Each lower slot 224 receives a radially translatable member or lower key 220. Lower keys 220 are similar to upper keys 274 of obturating tool 200 except that each lower key 220 includes an arcuate slot 222 extending into a lower end thereof. In this embodiment, each lower slot 224 each comprise a cylindrical bore against which seals 221 of lower keys 220 may sealingly engage. As will be described further herein, the radially outer end of each lower key 220 has a smaller radius from the central axis of obturating tool 200 than the radially outer end of each upper key 272. Particularly, in this embodiment, the length extending between the radially inner and outer ends of each lower key 220 is less than the length extending between the radially inner and outer ends of each upper key 274. In this embodiment, an annular extension of the intermediate segment 202F of housing 202 forms an axially extending first or upper lip 232 that extends into the slot 222 of each lower key 220 for retaining lower keys 220 to housing 202 while also permitting relative radial movement between lower keys 220 and housing 202.

Intermediate slots 216, which are positioned between upper slots 272 and lower slots 224, each receive a radially translatable member or bore sensor 226. In this embodiment, intermediate slots 224 each comprise a cylindrical bore against which seals 227 of bore sensor 226 may sealingly engage. In this embodiment, obturating tool 200 includes an interrupt member or ring 290 positioned within bore 208 of housing 202. Particularly, in this embodiment, interrupt ring 290 includes a central bore or passage 292 and comprises a C-ring 290 having a pair of terminal ends 293 (shown in FIG. 8) matingly received in slots 228 (shown in FIG. 8) of bore sensor 226. Obturating tool 200 also includes a radial biasing member 296 that is received in a slot 298 formed in the intermediate segment 202E of housing 202. Radial biasing member 296 is configured to apply a radially directed force against interrupt ring 290 in the direction of bore sensor 226.

Bore sensor 226 is radially locked to interrupt ring 290 such that interrupt ring 290 travels in concert radially with bore sensor 226. Particularly, bore sensor 226 includes a first or radially outer position (shown in FIG. 8) and a second or radially inner position. When bore sensor 226 is in the radially outer position, a central or longitudinal axis 295 (shown in FIG. 8) of interrupt ring 290 is radially offset from a central or longitudinal axis 205 (shown in FIG. 8). When bore sensor 226 is in the radially inner position, the central axis 295 of interrupt ring 290 is substantially aligned or disposed coaxial with central axis 205 of housing 202. Thus, interrupt ring 290 includes a first or radially offset position and a second or radially centralized position. Radial biasing member 296, by applying a radial biasing force to interrupt ring 290, is configured to bias bore sensor 226 into the radially outer position.

A radially outwards extending flange 236 tis positioned axially or trapped between intermediate segments 202E and 202F. A first annular seal 238 is positioned between intermediate segment 202E and flange 236 to seal the connection formed therebetween while a second annular seal 238 is positioned between intermediate segments 202F and flange 236 to seal the connection formed therebetween. In this embodiment, the outer surface 212 of housing 202 includes a first or upper annular groove 240A positioned between intermediate segment 202E and flange 236 and a second or lower annular groove 240B positioned between flange 236 and intermediate segment 202F.

Each groove 240A and 240B receives an annular seal assembly comprising an annular elastomeric seal 242 and an annular, metallic piston ring 244. Each elastomeric seal 242 has an L-shaped cross-sectional profile and sealingly engages its corresponding piston ring 244. The seal assemblies comprising seals 242 and 244 are configured to sealingly engage the seal bore of a sliding sleeve valve, such as the seal bore 28 of sliding sleeve valve 10. While in this embodiment housing 202 of obturating tool 200 is shown as including the seal assemblies comprising seals 242 and 244, in other embodiments, housing 202 may include other means for sealing against the seal bore of the sliding sleeve valve in which it is disposed. In this embodiment, a cylindrical sleeve 246 is positioned about the outer surface 212 of the intermediate segment 202G of housing 202, where sleeve 246 is configured to apply an axial force against a lower filter 270B, which is configured similarly as upper filter 270A, to thereby compress lower filter 270B. Fluid is permitted to flow through lower filter 27B and into bore 208 of housing 202 via a plurality of circumferentially spaced lower ports 271B.

In this embodiment, an axially extending stem 254 is coupled to lower segment 202I of housing 202 at lower end 206. Stem 254 includes a pair of annular fins 256 extending radially outwards therefrom for assisting in the transportation of obturating tool 200 through wellbore 3. Particularly, fins 256 each comprise a flexible material (e.g., an elastomeric material) and have an outer diameter that is larger than a maximum outer diameter of housing 202. As obturating tool 200 is pumped downwards through wellbore 3, fins 256 contact or sealingly engage the inner surface of well string 4, thereby inhibiting fluid flow around obturating tool 200. In this manner, the amount of fluid required to pump obturating tool 200 through wellbore 3 by eliminating or reducing the amount of fluid that flows past obturating tool 200 as obturating tool 200 is transported through wellbore 3.

Core 300 of obturating tool 200 is disposed coaxially with the longitudinal axis of housing 202 and includes a first or upper end 302, second or a lower end 304, and a generally cylindrical outer surface 306 extending between ends 302 and 304. In this embodiment, core 300 comprises a first or upper segment 300A and a second or lower segment 300B, where segments 300A and 300B are releasably connected at a shearable coupling 312. Each segment 300A and 300B of core 300 may comprise multiple segments releasably coupled together or unitary members. Shearable coupling 312 includes an annular seal 314 and a shear member or ring 316 to releasably couple upper segment 300A with lower segment 300B. In this configuration, relative axial movement is restricted between segments 300A and 300B until shear ring 316 is sheared in response to the application of an upwards force on the upper end 302 of core 300, thereby permitting limited relative axial movement between upper segment 300A of core 300 and housing 202. In this embodiment, the outer surface 306 of the upper segment 300A of core 300 includes an annular first or upper groove 318, an annular first or upper shoulder 320, an annular second or intermediate shoulder 322, an annular second or intermediate groove 324, an annular third or lower shoulder 326. Additionally, core 300 includes an annular fourth or intermediate shoulder 328 positioned axially between intermediate shoulder 322 and lower shoulder 326.

When bore sensor 226 of obturating tool 200 is disposed in the radially outer position, an interrupt shoulder 294 of interrupt ring 290 extends radially inwards from the inner surface 210D of the intermediate segment 202D of housing 202 such that interrupt shoulder 294 at least partially radially aligns or overlaps intermediate shoulder 328 of core 300 such that intermediate shoulder 328 may not pass axially through the central passage 292 of interrupt ring 290. However, when bore sensor 226 is disposed in the radially inner position, interrupt shoulder 294 of interrupt 290 does not project radially inwards from the inner surface 210D of intermediate segment 202D. Thus, intermediate shoulder 328 of core 300 is permitted to pass axially through the central passage 292 of interrupt ring 290 when bore sensor 226 is disposed in the radially inner position.

In this embodiment, a plurality of circumferentially spaced ports 330 extend radially into core 300 proximal a lower end of upper segment 300A. Additionally, lower segment 300B includes a central bore or passage 329 extending between an upper end of lower segment 300B and the lower end 304 of core 300, where passage 329 is in fluid communication with ports 330. The lower end of upper segment 300A includes an annular first or upper shoulder 332, an annular second or lower shoulder 334, and an annular seal 336 located axially between shoulders 332 and 334 that sealingly engages an inner surface 210F of the intermediate segment 202F of housing 202. Additionally, a cylindrical pulsation damper 338 is positioned in passage 329 proximal to the lower end of core 300, where pulsation damper 338 is configured to provide a fluid restriction in passage 329 to mitigate or prevent hydraulic shock or vibration. In some embodiments, pulsation damper 338 may comprise a Visco Jet flow restrictor produced by The Lee Company of Westbrook, Conn.

In this embodiment, obturating tool 200 additionally includes a first or upper floating piston 340 and a second or lower floating piston 350, where floating pistons 340 and 350 are each slidably disposed about the outer surface 306 of core 300 within the bore 208 of housing 202. Upper floating piston 340 is generally cylindrical and includes an annular radially inner seal 342 that sealingly engages an outer surface 306A of the upper segment 300A of core 300 and an annular radially outer seal 344 that sealingly engages an inner surface 210B of the intermediate segment 202B of housing 202. Upper floating piston 340 is permitted to move axially relative to housing 202 and core 300 and is positioned generally in housing 202 such that inner seal 342 of upper floating piston 340 seals against the portion of outer surface 306A extending between the upper end 302 of core 300 and an upper end of upper groove 318. In this embodiment, upper floating piston 340 includes a first relief valve 346A and a second relief valve 346B.

The lower floating piston 350 of obturating tool 200 is also generally cylindrical and includes an annular radially inner seal 352 that sealingly engages an outer surface 306B of the lower segment 300B of core 300 and an annular radially outer seal 354 that sealingly engages an inner surface 210G of the intermediate segment 202G of housing 202. Lower floating piston 350 is permitted to move axially relative to housing 202 and core 300 and is positioned generally in intermediate segment 202G of housing 202, proximal to, but positioned axially above actuation assembly 400. In this embodiment, lower floating piston 350 includes a first relief valve 356A and a second relief valve 356B.

In this embodiment, actuation assembly 400 generally includes a cylindrical valve block or body 402, a first valve assembly 440A, a second valve assembly 440B, and a third valve assembly 510. Valve body 402 includes a first or upper end 404, a second or lower end 406, and a generally cylindrical outer surface 300 extending between ends 404 and 406. The outer surface 408 of valve body 402 includes an annular seal 410, such as a T-seal, disposed therein that sealingly engages the inner surface 210 of housing 202.

In this embodiment, bore 208 of housing 202 is divided into a plurality of separate annular chambers 260, 262, 264, 266, and 268, that are fluidically isolated or sealed from each other. Particularly, chamber 260 comprises an upper chamber 260 that is in fluid communication with the surrounding environment via port 220 of housing 202 and is sealed from chamber 262 via seals 342 and 344 of upper floating piston 340. Chamber 262 extends between seals 342 and 344 of upper floating piston 340 and seal 336 of core 300, which isolates chamber 262 from chamber 264. Chamber 264 is in fluid communication with the surrounding environment via port 264 of housing 202 and extends between seal 336 and seals 352 and 354 of lower floating piston 350, which seal chamber 264 from chamber 266. Chamber 266 comprises a first or upper actuation chamber 266 of actuation assembly 400 and extends between seals 242 and 244 of lower floating piston 350 and seal 410 of actuation assembly 400, where seal 410 seals against an inner surface 210H of the intermediate segment 202H of housing 202 to thereby seal upper actuation chamber 266 from chamber 268. Chamber 268 comprises a second or lower actuation chamber 268 of actuation assembly 400 and extends between seal 410 and a lower end of bore 208.

Upper chamber 260 and chamber 264 are each in fluid communication with the surrounding environment, whereas chambers 262, 266, and 268 are each sealed from the surrounding environment. Particularly, when obturating tool 200 is received within the seal bore 28 of a sliding sleeve valve 10 of well string 4, upper chamber 260 is in fluid communication with the portion of the bore 4B of well string 4 disposed above seals 242 and 244 of housing 202 while chamber 264 is in fluid communication with the portion of bore 4B disposed below seals 242 and 244. Thus, when bore 4B of well string 4 is pressurized for hydraulically fracturing formation 6, upper chamber 240 is exposed to the fracturing pressure applied to well string 4 whereas the surrounding environment in fluid communication with chamber 264 is isolated from the fracturing pressure via seals 242 and 244 of housing 202. Additionally, although upper chamber 260 is sealed from chamber 262, upper floating piston 340 transmits or communicates the pressure within upper chamber 260 to chamber 262. Passage 329 of core 300 is in fluid communication with chamber 262, and thus, pressure communicated to chamber 262 from upper chamber 260 is also communicated to passage 329. Further, pressure may also be transmitted or communicated between chambers 264 and 266 via lower floating piston 350.

Although upper floating piston 340 is permitted to travel axially relative to housing 202 and core 300, the upward travel of upper floating piston 340 is limited by engagement between an upper shoulder 347 of upper floating piston 340 and an internal shoulder 209 of the intermediate segment 202B of housing 202. Thus, when upper floating piston 340 is disposed in a maximally upward position with upper shoulder 347 of upper floating piston 340 in engagement with internal shoulder 209, a positive pressure differential may form between upper chamber 260 and intermediate chamber 262 with the pressure in intermediate chamber 262 exceeding pressure in upper chamber 260. In this embodiment, the second relief valve 346B of upper floating piston 340 permits fluid flow from intermediate chamber 262 to upper chamber 260 in response to fluid pressure in intermediate chamber 262 exceeding fluid pressure in upper chamber 260 by a predetermined or threshold amount. Thus, second relief valve 346B may act to relieve pressure in intermediate chamber 262 to prevent an inadvertent overpressurization of intermediate chamber 262 (due to, e.g., changes in temperature of fluid in intermediate chamber 262).

Additionally, downward travel of upper floating piston 340 is limited by engagement between a lower shoulder 349 and an internal shoulder 211 formed by an upper end of the intermediate segment 202C of housing 202. Thus, when upper floating piston 340 is disposed in a maximally downward position with lower shoulder 349 of upper floating piston 340 in engagement with internal shoulder 211, a negative pressure differential may form between upper chamber 260 and intermediate chamber 262 with the pressure in upper chamber 260 exceeding pressure in intermediate chamber 262. In this embodiment, the first relief valve 346A of upper floating piston 340 permits fluid flow from upper chamber 260 to intermediate chamber 262 in response to fluid pressure in upper chamber 260 exceeding fluid pressure in intermediate chamber 262 by a predetermined or threshold amount. Thus, second relief valve 346B may act to relieve pressure in upper chamber 260 and increase pressure in intermediate chamber 262 to prevent an inadvertent over-pressurization of upper chamber 260 and/or an inadvertent under-pressurization of intermediate chamber 262.

Further, although lower floating piston 350 is permitted to travel axially relative to housing 202 and core 300, the upward travel of lower floating piston 350 is limited by engagement between an upper shoulder 357 of lower floating piston 350 and an internal shoulder 215 positioned within the intermediate segment 202G of housing 202. Thus, when lower floating piston 350 is disposed in a maximally upward position with upper shoulder 357 of lower floating piston 350 in engagement with internal shoulder 215, a positive pressure differential may form between intermediate chamber 264 and upper actuation chamber 266 with the pressure in upper actuation chamber 266 exceeding pressure in intermediate chamber 264. In this embodiment, the second relief valve 356B of lower floating piston 350 permits fluid flow from upper actuation chamber 266 to intermediate chamber 264 in response to fluid pressure in upper actuation chamber 266 exceeding fluid pressure in intermediate chamber 264 by a predetermined or threshold amount. Thus, second relief valve 356B may act to relieve pressure in upper actuation chamber 266 to prevent an inadvertent over-pressurization of upper actuation chamber 266 (due to, e.g., changes in temperature of fluid in upper actuation chamber 266).

Additionally, downward travel of lower floating piston 350 is limited by engagement between a lower shoulder 359 and an internal shoulder 217 of the intermediate segment 202G of housing 202. Thus, when lower floating piston 350 is disposed in a maximally downward position with lower shoulder 359 of lower floating piston 350 in engagement with internal shoulder 217, a negative pressure differential may form between intermediate chamber 264 and upper actuation chamber 266 with the pressure in intermediate chamber 264 exceeding pressure in upper actuation chamber 266. In this embodiment, the first relief valve 356A of lower floating piston 350 permits fluid flow from intermediate chamber 264 to upper actuation chamber 266 in response to fluid pressure in intermediate chamber 264 exceeding fluid pressure in upper actuation chamber 266 by a predetermined or threshold amount. Thus, second relief valve 356B may act to relieve pressure in intermediate chamber 264 and increase pressure in upper actuation chamber 266 to prevent an inadvertent over-pressurization of intermediate chamber 264 and/or an inadvertent under-pressurization of upper actuation chamber 266.

In this embodiment, valve body 402 of actuation assembly 400 includes a first valve bore or passage 412, a second valve bore or passage 414, and a third valve bore or passage 420, where valve bores 412, 414, and 420 each extend axially into valve body 402 from lower end 406. In this arrangement, first valve bore 412 receives at least a portion of first valve assembly 440A, second valve bore 414 receives at least a portion of second valve assembly 440B, and third valve bore 420 receives at least a portion of third valve assembly 510. A first radial port or passage 416 extends radially through valve body 402 between outer surface 408 and first valve bore 412, where first radial passage 416 intersects first valve bore 412 proximal an inner terminal end of first valve bore 412. Similarly, a second radial port or passage 418 extends radially through valve body 402 between outer surface 408 and second valve bore 414, where second radial passage 418 intersects second valve bore 414 proximal an inner terminal end of second valve bore 414. Radial passages 416 and 418 are each positioned axially in valve body 402 between seal 410 and upper end 404.

In this arrangement, when fluid communication is permitted either between first valve bore 412 and first radial passage 416 and/or between second valve bore 414 and second radial passage 418, fluid communication is thereby provided between upper actuation chamber 266 and lower actuation chamber 268. Third valve bore 420 of actuation assembly 400 includes a frustoconical sealing surface 420S and is in selective fluid communication with first valve bore 412 via a third radial port or passage 422 extending between first valve bore 412 and an inner terminal end of third valve bore 420. An upper chamber passage 428 extends axially into valve body 402 from upper end 404 and is also in fluid communication with both first valve body 412 and second valve bore 414 via a fifth radial port or passage 430 extending between both first valve bore 412 and second valve bore 414, and upper chamber passage 428.

The valve body 402 of actuation assembly 400 additionally includes an inlet or core bore or passage 432 extending axially into valve body 402 from upper end 404. Additionally, valve body 402 includes a neck 434 configured to releasably couple with the connector 340 of core 300, and an annular seal 436 configured to sealingly engage the inner surface of bore 308 of core 300. In this arrangement, fluid communication is provided between core passage 432 of valve body 402 and bore 308 of core 300 while direct fluid communication is restricted (via seal 436) between core passage 432 and upper actuation chamber 266. In this embodiment, core passage 432 of valve body 402 is in fluid communication with both first valve bore 412 and second valve bore 414 via a sixth radial port or passage 438 extending therebetween. Additionally, valve body 402 includes a bypass bore or passage 437 extending axially between upper end 404 and lower end 406 of valve body 402. Bypass passage 437 includes a check valve 439 biased into sealing engagement with the inner surface of bypass passage 437 via a biasing member 441. In this arrangement, check valve 439 permits fluid flow from upper actuation chamber 266 to lower actuation chamber 268 via bypass passage 437 but restricts fluid flow from lower actuation chamber 268 to upper actuation chamber 266 via bypass passage 437. Bypass passage 437 is in fluid communication with second valve bore 414 via a sixth radial port or passage 443 extending therebetween.

Figure 7:
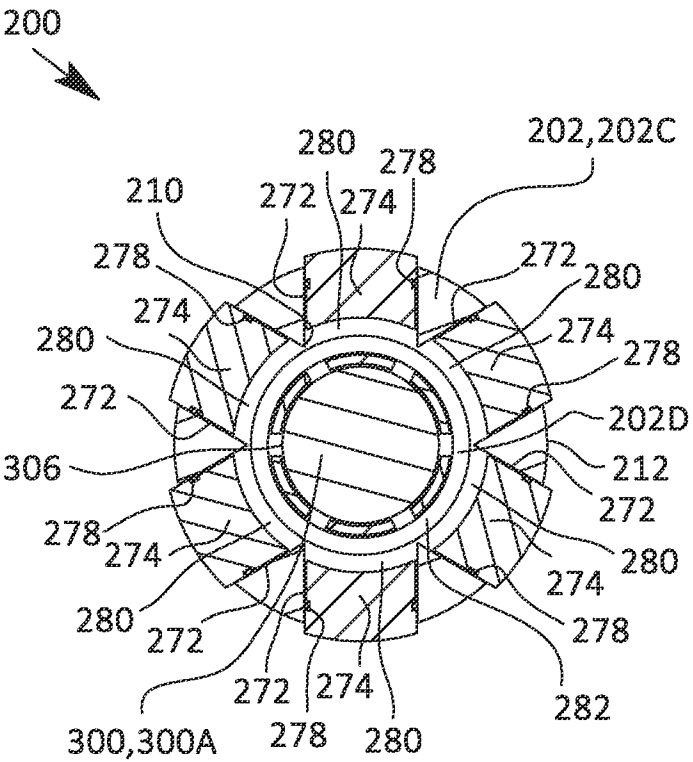
FIG. 7 is a section view along lines 7-7 of the obturating tool shown in FIG. 3B.
Figure 15A:
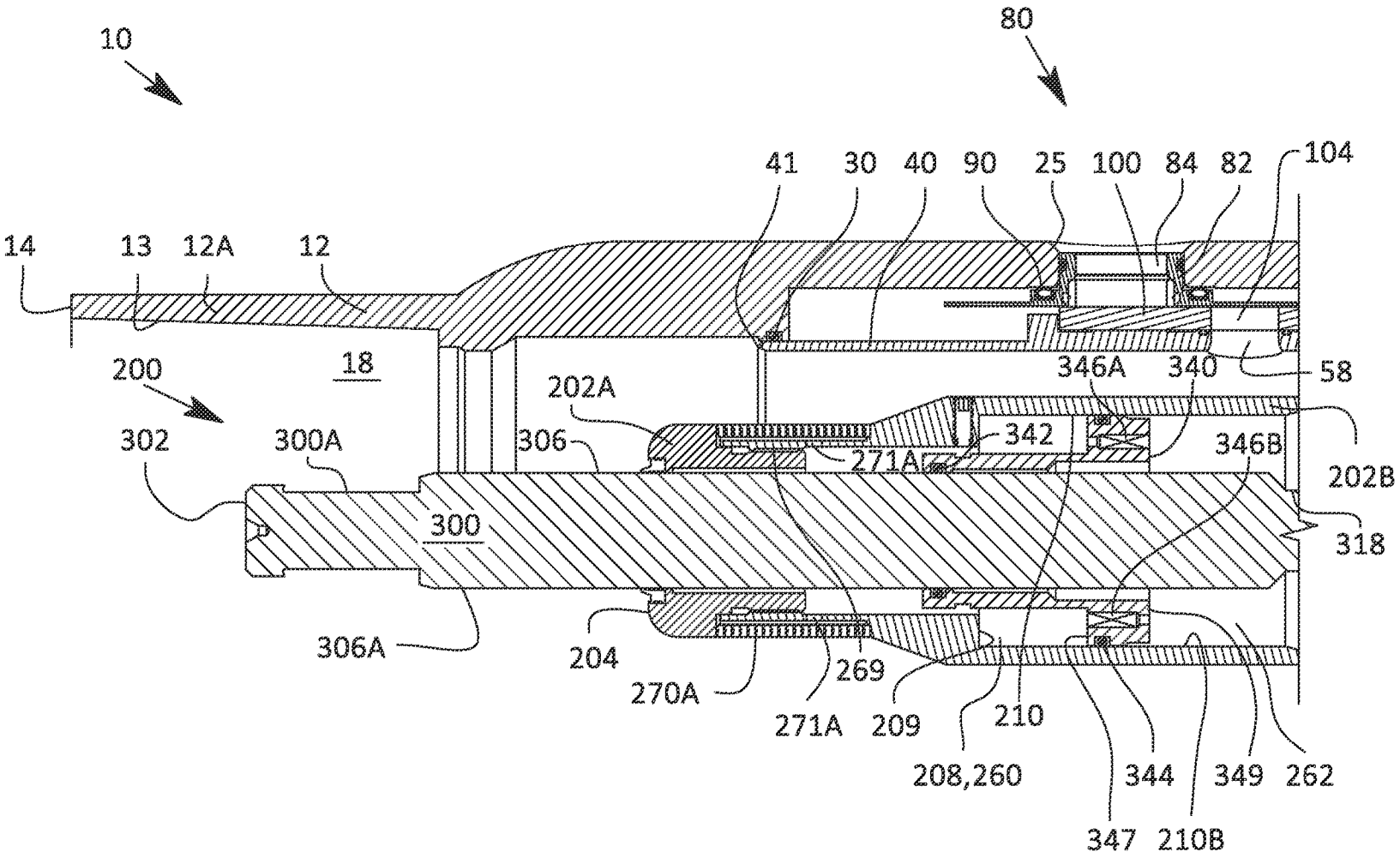
FIG. 15A is a section view of an uppermost end of the obturating tool of FIG. 3A disposed in a second position.
Figure 15B:
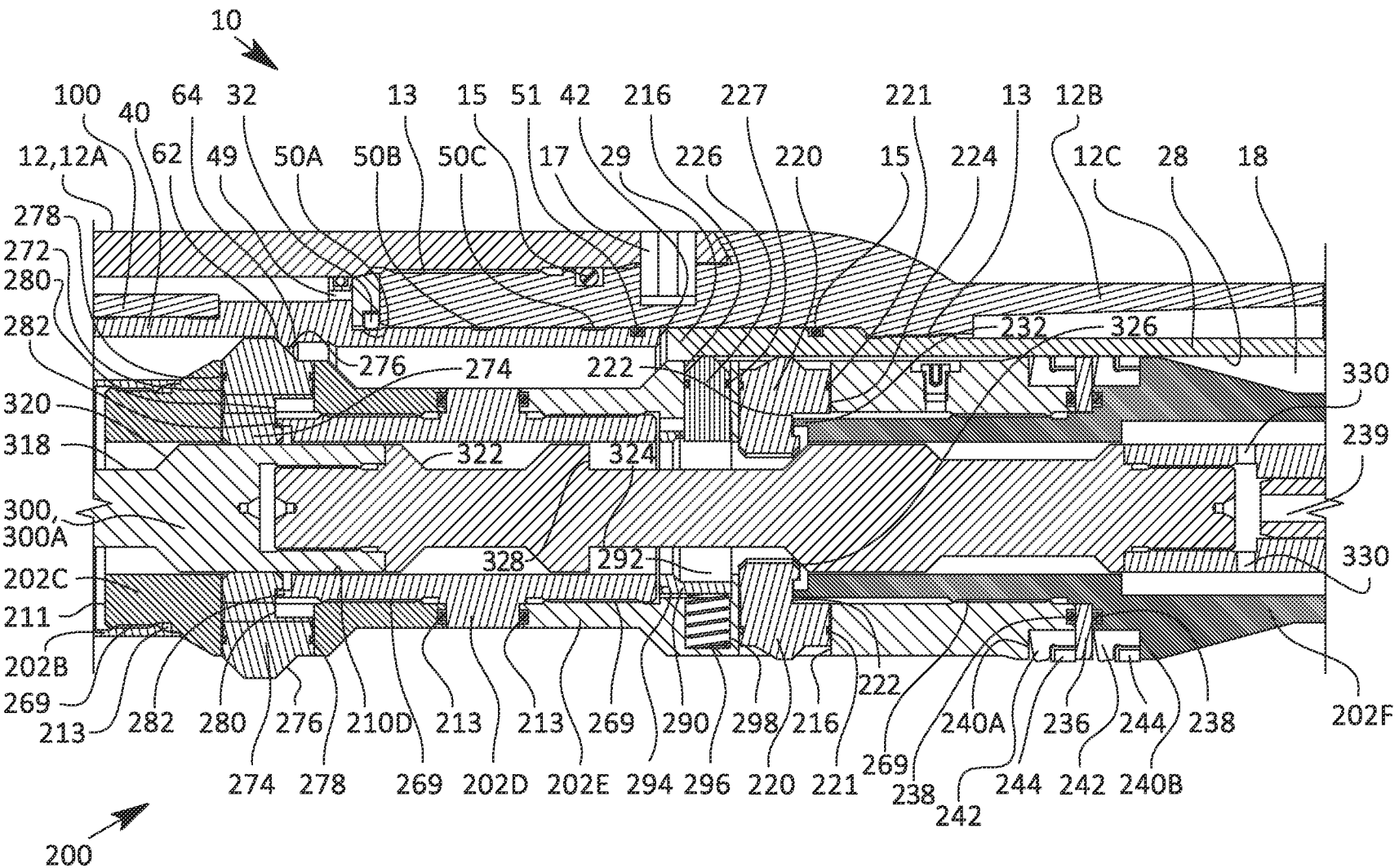
FIG. 15B is a section view of an intermediate section of the obturating tool shown in FIG. 15A.
Figure 15C:
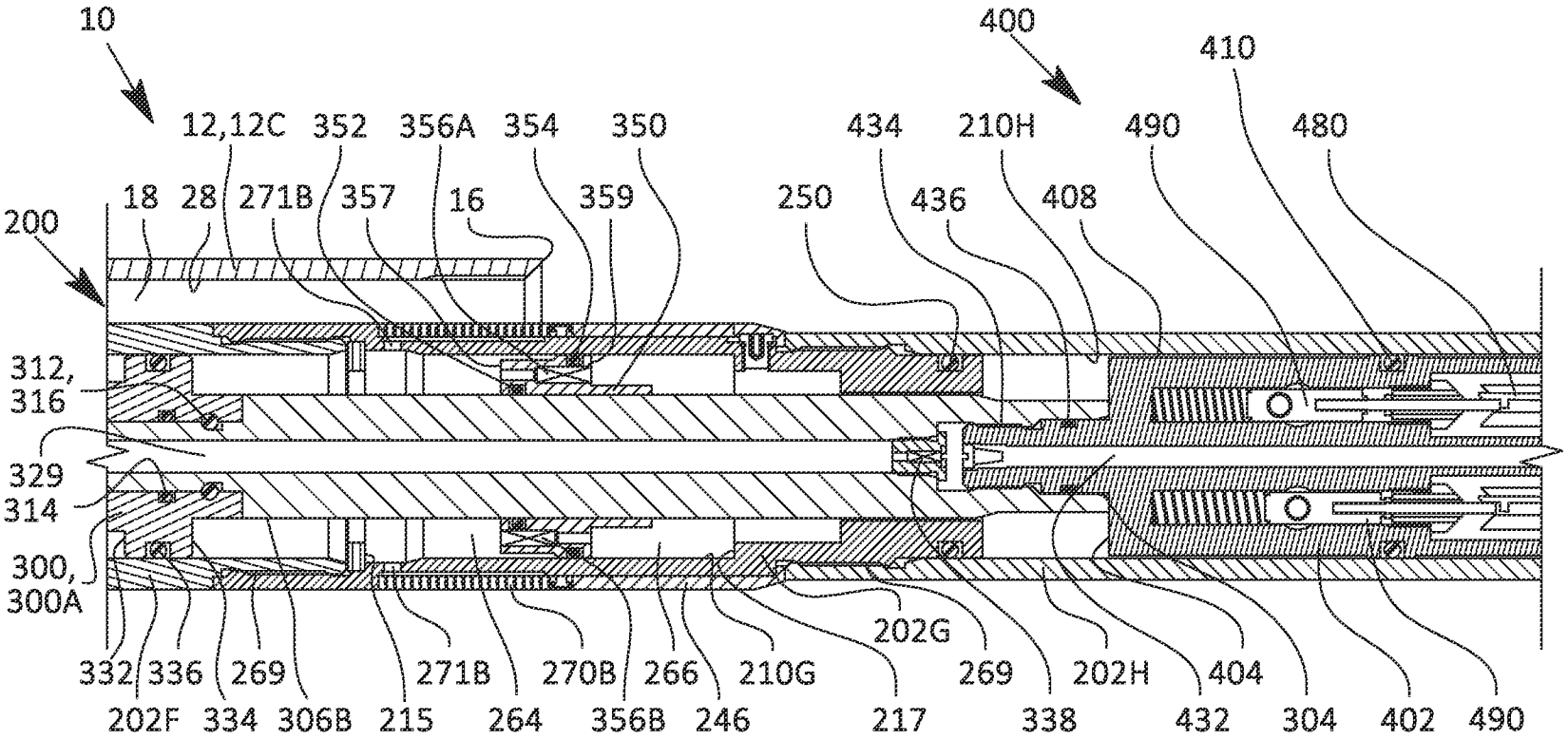
FIG. 15C is a section view of another intermediate section of the obturating tool shown in FIG. 15A.
Figure 15D:
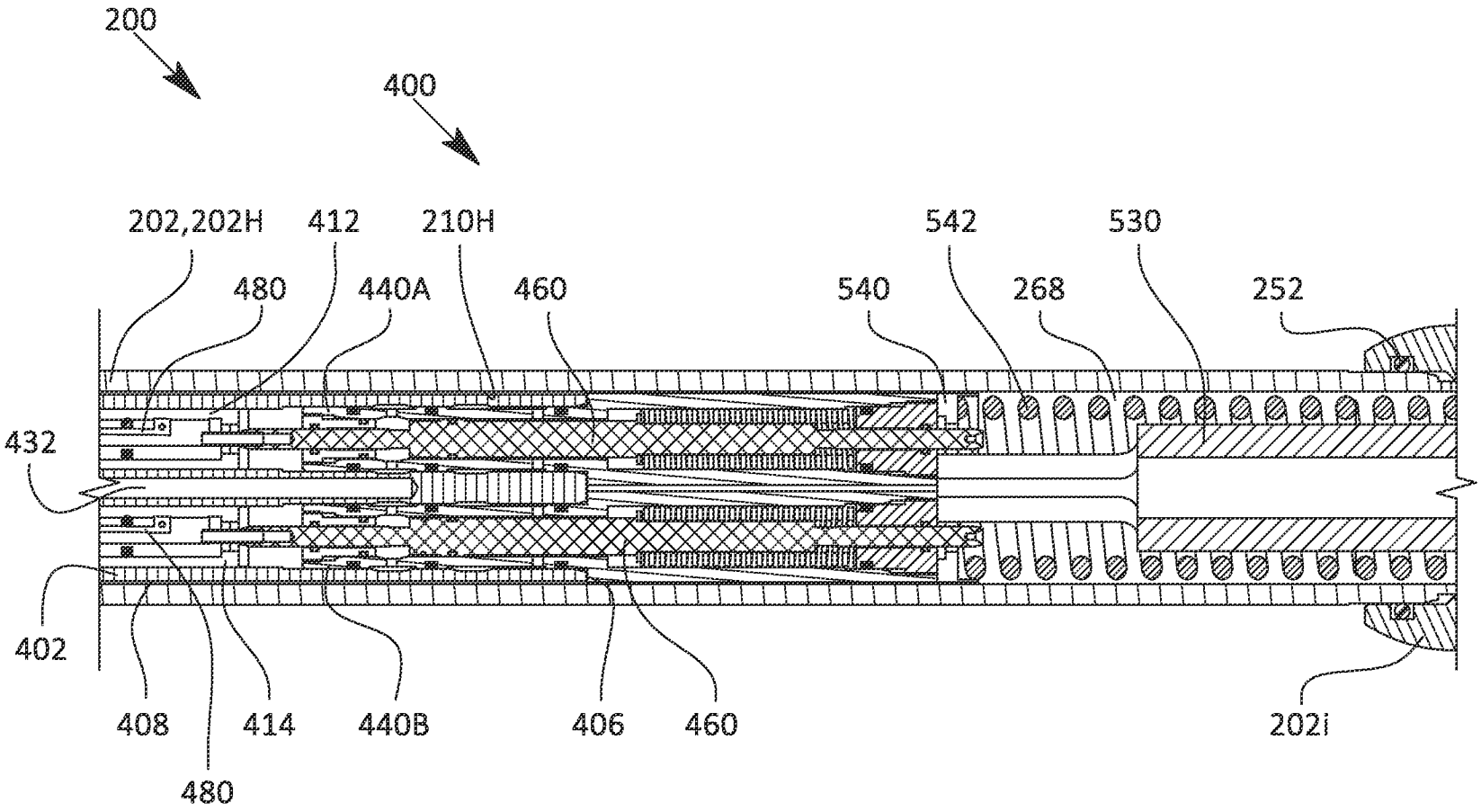
FIG. 15D is a section view of another intermediate section of the obturating tool shown in FIG. 15A.
Figure 16:
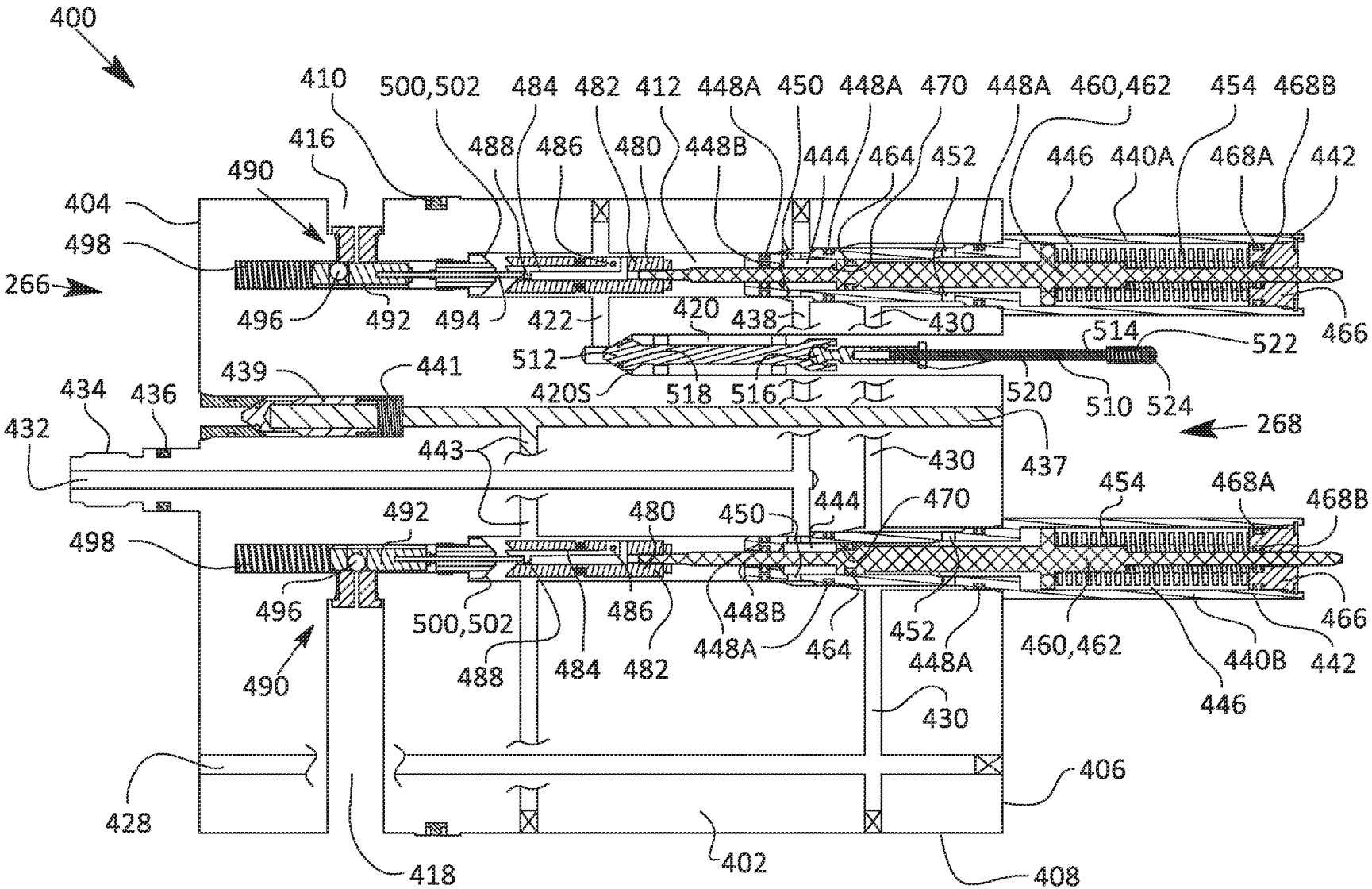
FIG. 16 is a top view of an actuation assembly of the obturating tool of FIG. 15A (shown as unrolled for clarity)
Figure 17A:
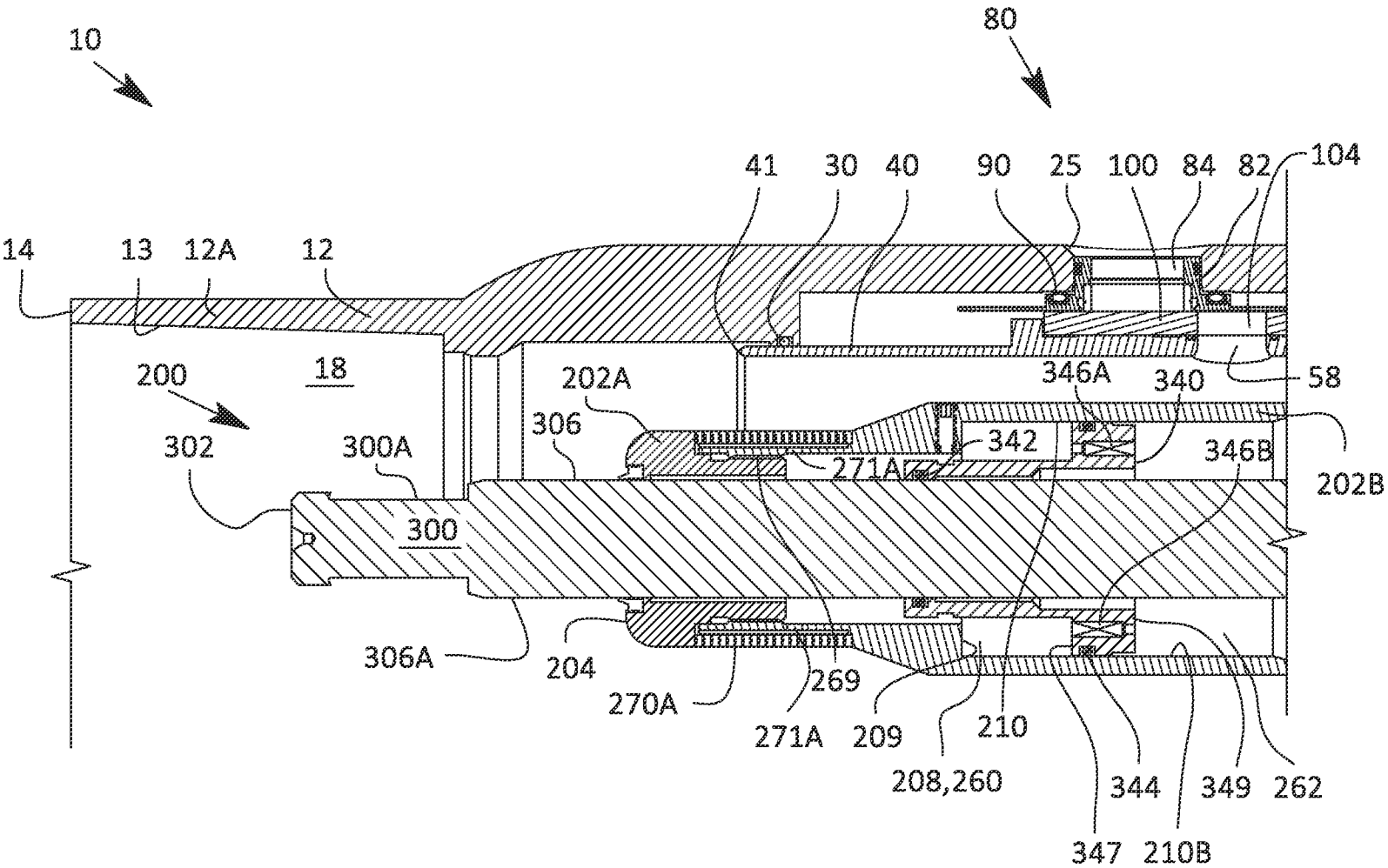
FIG. 17A is a section view of an uppermost end of the obturating tool of FIG. 3A disposed in a third position.
Figure 17B:
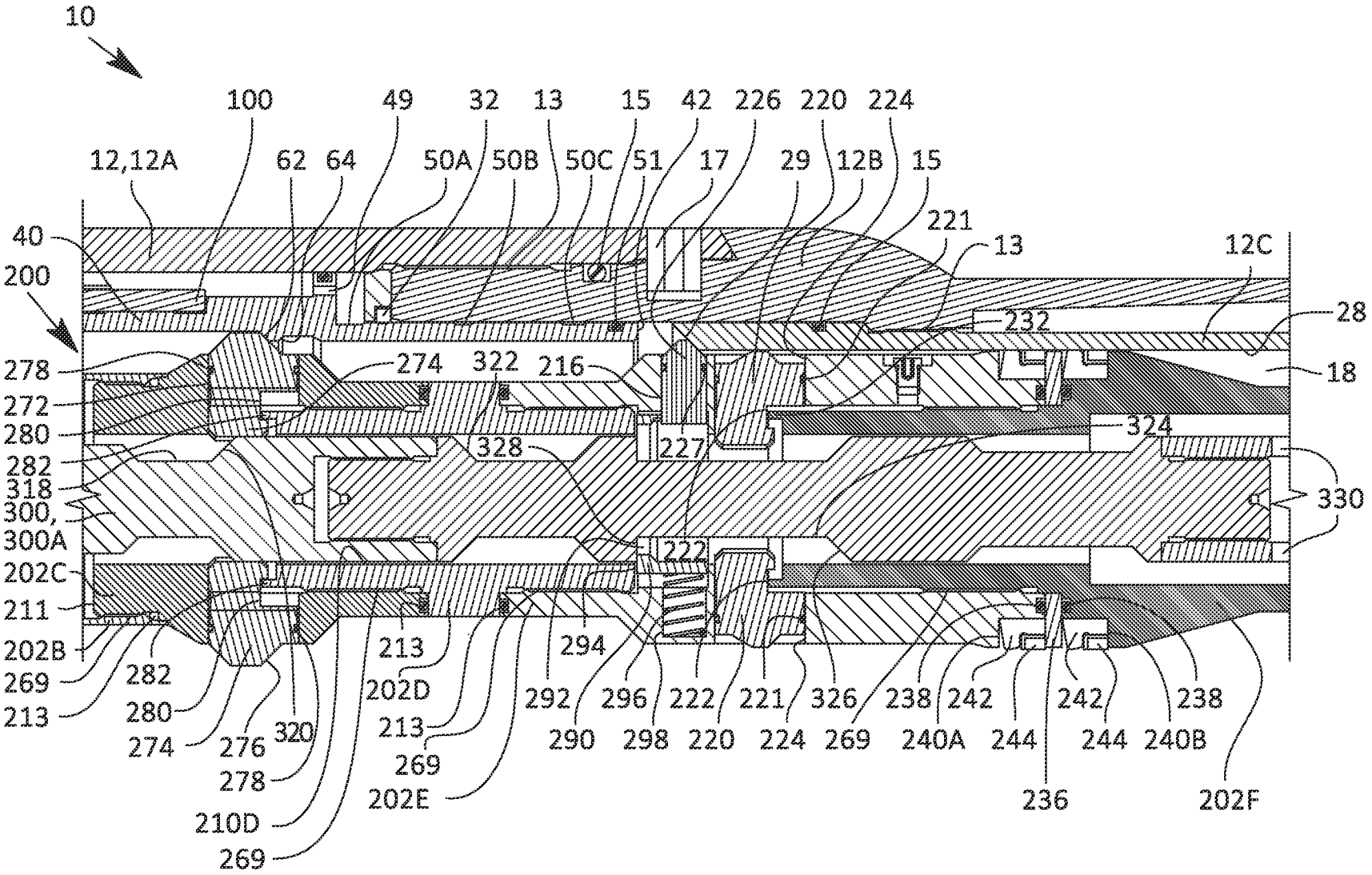
FIG. 17B is a section view of an intermediate section of the obturating tool shown in FIG. 17A.
Figure 17C:
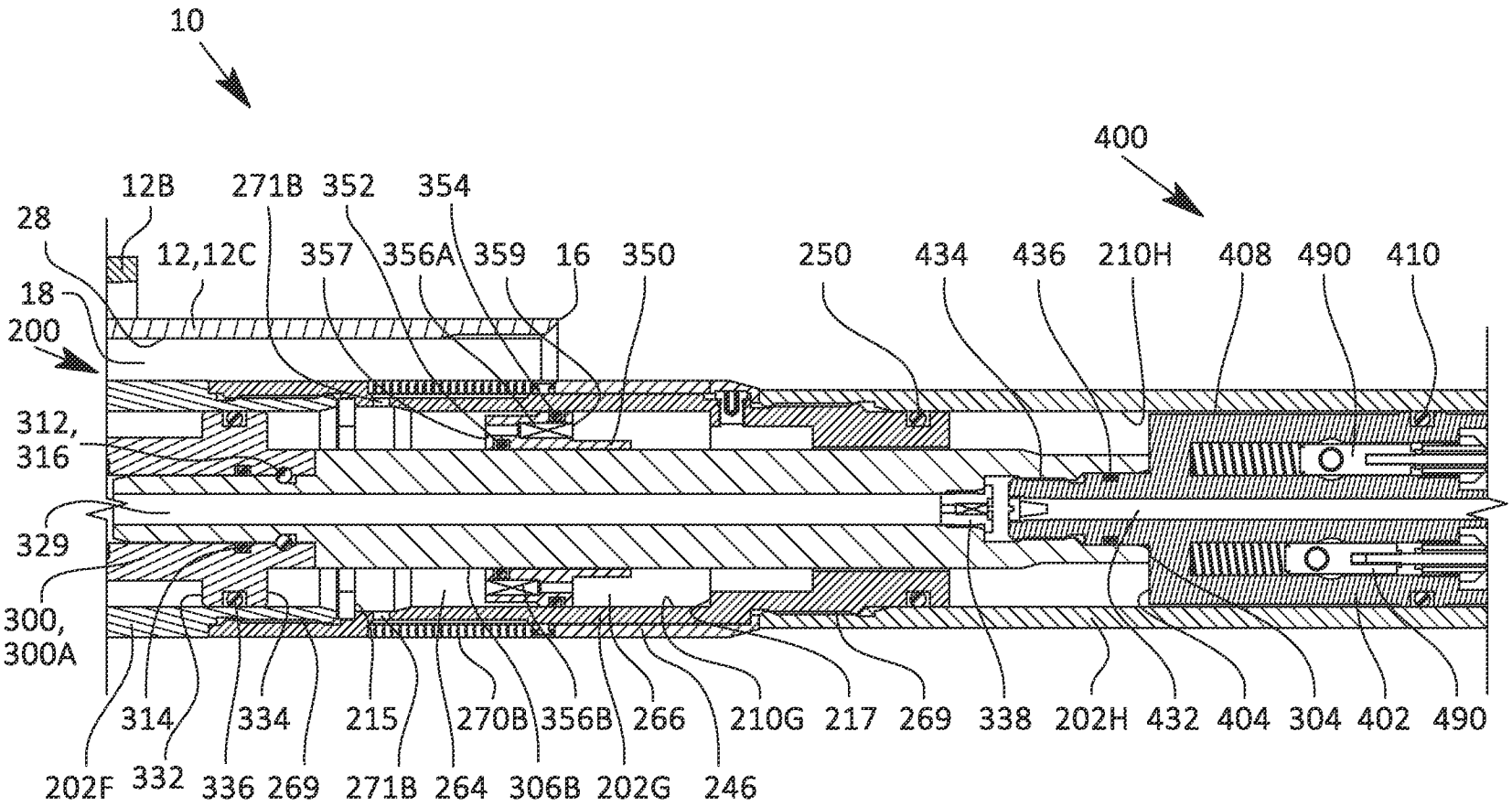
FIG. 17C is a section view of another intermediate section of the obturating tool shown in FIG. 17A.
Figure 17D:
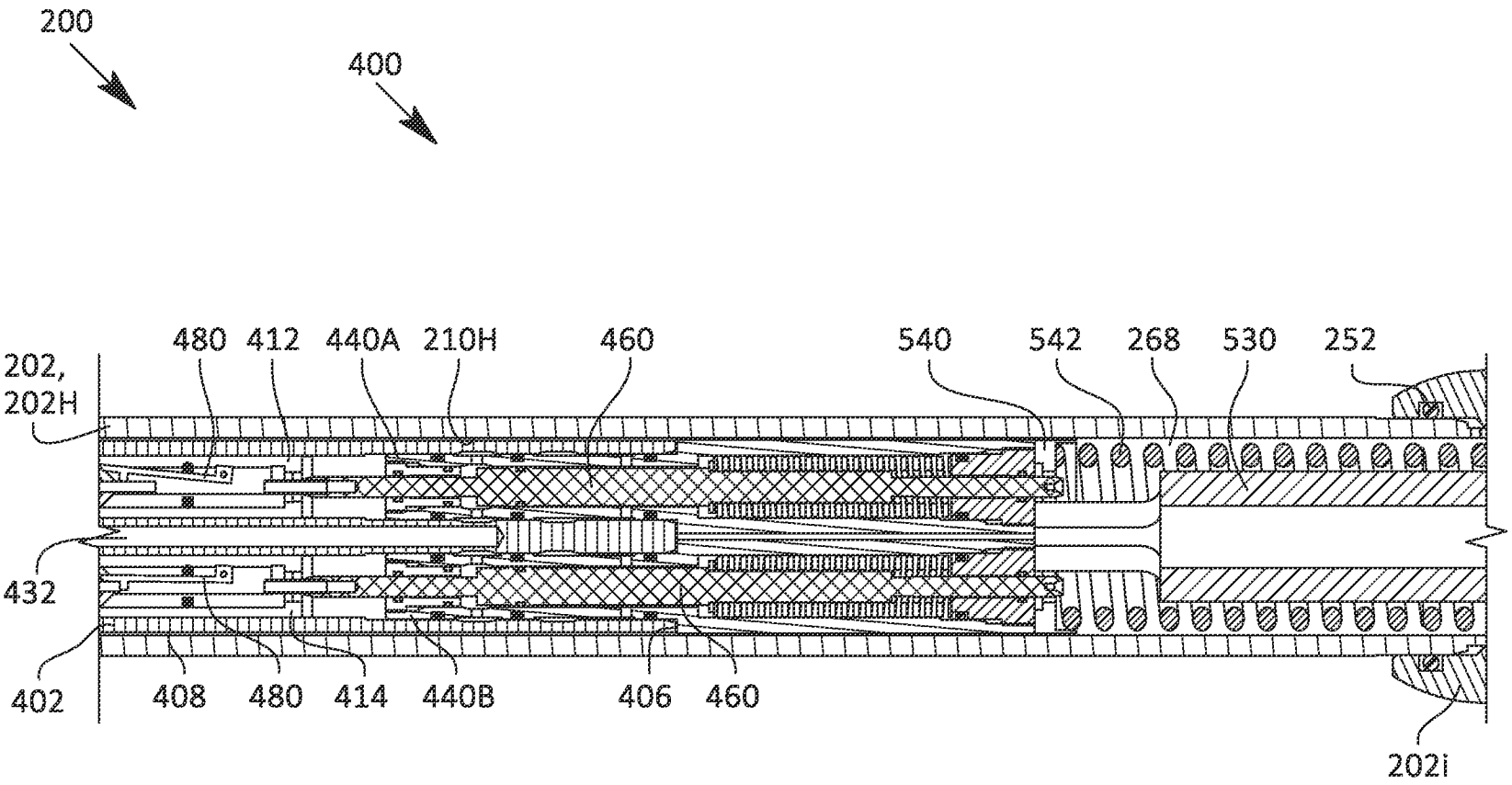
FIG. 17D is a section view of another intermediate section of the obturating tool shown in FIG. 17A.

As shown particularly in FIG. 7, in this embodiment, valve assemblies 440A and 440B each generally include a housing 442, a piston assembly 460, and a check valve assembly 490. Housing 442 of first valve assembly 440A couples with the inner surface of first valve bore 412 proximal lower end 406 of valve body 402 while housing 442 of second valve assembly 440B couples with the inner surface of second valve bore 414 proximal second end 406 of valve body 402. Housing 442 of each valve assembly 440A and 440B includes a first or upper chamber 444 and a second or lower chamber 446. Housing 442 of each valve assembly 440A and 440B additionally include annular seals 448A and 448B, which may comprise T-seals in some embodiments. Additionally, the piston assembly 460 of each valve assembly 440A and 440B includes a piston 462 slidably disposed in its corresponding housing 442, piston 462 including an annular seal 464 (such as a T-seal), disposed in an outer surface thereof. Additionally, each piston assembly 460 includes a piston retainer 466 coupled to a lower terminal end of housing 442, where piston retainer 466 includes an annular first or outer seal 468A that sealingly engages an inner surface of housing 442 and an annular second or inner seal 468B that sealingly engages an outer surface of piston 462. In some embodiments, housing 442 and piston retainer 466 may comprise a single, unitary component. Seals 448A of the housing 442 of first valve assembly 440A sealingly engage the inner surface of first valve bore 412 of valve body 402 while seal 448B sealingly engages the outer surface of piston 462 and seal 464 of piston 462 sealingly engages the inner surface of housing 442. Similarly, seals 448A of the housing 442 of second valve assembly 440B sealingly engage the inner surface of second valve bore 412 of valve body 402 while seal 448B sealingly engages the outer surface of piston 462 and seal 464 of piston 462 sealingly engages the inner surface of housing 442.

In this arrangement, fluid communication is provided between the upper chamber 444 of each valve assembly 440A and 440B and sixth radial passage 438 (and, in-turn, core passage 432) via a plurality of circumferentially spaced first or upper housing ports 450, while fluid communication is provided between the lower chamber 446 of each valve assembly 440A and 440B and fifth radial passage 430 (and, in-turn, upper actuation chamber 266) via a plurality of circumferentially spaced second or lower housing ports 452. Conversely, fluid communication is restricted between the upper chamber 444 of valve assemblies 440A and 440B and fifth radial passage 430, and fluid communication is restricted between the lower chamber 446 of valve assemblies 440A and 440B and sixth radial port 438. Housing 442 of each valve assembly 440A and 440B includes a biasing member 454 received within upper chamber 444 for providing a biasing force against the corresponding piston assembly 460 in the direction of the upper end 404 of valve body 402. In certain embodiments, the biasing member 454 of the first valve assembly 440A provides a greater biasing force than the biasing member 454 of second valve assembly 440B.

In this embodiment, the piston assembly 460 of each valve assembly 440A and 440B generally includes piston 462 and a flapper assembly 480 coupled to an upper end of piston 462. Piston 462 of each valve assembly 440A and 440B includes an annular shoulder 470 disposed in the upper chamber 444 of the corresponding housing 442. In this arrangement, the annular shoulder 470 of piston 462 receives fluid pressure from bore 308 of core 300 via core passage 432 of valve body 402. As described above, bore 308 of core 300 is in fluid communication with the surrounding environment (i.e., bore 4B of well string 4) disposed above piston rings 260, and thus, fluid pressure from axially above obturating tool 200 in the string or wellbore in which it is deployed may be communicated to shoulder 470 of piston 462. In this arrangement, the pressure force applied to shoulder 470 of piston 462 by fluid pressure in upper chamber 444 resists the biasing force applied to piston 462 from biasing member 454. Thus, a sufficient or threshold pressure force, provided via a sufficient or threshold fluid pressure in upper chamber 444, applied to shoulder 470 of piston 462 may axially displace piston 462 in housing 442, thereby compressing biasing member 454.

In this embodiment, the flapper assembly 480 each valve assembly 440A and 440B includes a housing or carrier 482 coupled to an upper terminal end of piston 470, and a flapper 484 pivotably coupled to carrier 482 via a biased hinge 486, where the flapper 482 includes a radially extending engagement shoulder 488. The biased hinge 486 includes a biasing member configured to bias flapper 484 into engagement with an inner surface of carrier 482, or in other words, out of alignment with a central or longitudinal axis of the piston assembly 460. The check valve assembly 490 of first valve assembly 440A is slidably disposed in the first valve bore 412 of valve body 402 while the check valve assembly 490 of the second valve assembly 440B is slidably disposed in the second valve bore 414.

In this embodiment, the check valve assembly 490 of each valve assembly 440A and 440B includes a check valve housing 492 comprising a stem 494 extending towards flapper assembly 480, and a ball or obturating member 496 disposed in the check valve housing 492. In addition, the check valve assembly 490 of each valve assembly 440A and 440B includes a biasing member 498 for applying a biasing force against check valve housing 492 in the direction of the lower end 406 of valve body 402. Additionally, each valve assembly 440A and 440B includes an annular plug 500 coupled to valve body 402 and disposed axially between the flapper assembly 480 and check valve assembly 490. The lower end of each plug 500 includes a generally frustoconical surface 502 for engaging the terminal end of the corresponding flapper 482. In this arrangement, the biasing member 498 of the check valve assembly 490 of first valve assembly 440A biases check valve housing 492 into a lower position with ball 496 restricting fluid communication between first valve bore 412 and first radial passage 416. Similarly, the biasing member 498 of the check valve assembly 490 of second valve assembly 440B biases check valve housing 492 into a lower position with ball 496 restricting fluid communication between second valve bore 414 and second radial passage 418. In other words, valve assemblies 440A and 440B are each biased towards a closed position.

In this embodiment, third valve assembly 510 of actuation assembly 400 generally includes an elongate seal member or plug 512 and an extension rod 514 pivotally coupled to the plug 512 via a rotatable or ball joint 516 formed between a lower end of the plug 512 and an upper end of the extension rod 514. The plug 512 of third valve assembly 510 includes an annular seal 518 disposed in a frustoconical outer surface of plug 512. Plug 512 of third valve assembly 510 is slidably disposed in third valve bore 420 of valve body 402 and seal 518 of third valve assembly 510 is configured to sealingly engage sealing surface 420S of third valve bore 420 when third valve assembly 510 is in a closed position to restrict fluid communication between third valve bore 420 and third radial passage 422.

The extension rod 514 of third valve assembly 510 includes a telescoping axial length adjuster 520 configured to adjust an axial length of the extension rod 514 via relative rotation between upper and lower ends of extension rod 514. Additionally, a biasing member 522 is disposed about an outer surface of extension rod 522 and axially located the lower end of extension rod 514, which comprises a ball connector 524. As shown particularly in FIG. 4B, the lower end of the extension rod 514 of third valve assembly 510 is slidably received in one of a plurality of passages 532 extending axially through a generally cylindrical first spring retainer 530 disposed in lower actuation chamber 268. Particularly, passages 532 extend axially into first spring retainer 530 from a first or upper end thereof, where a second or lower end of first spring retainer 530 is directly adjacent the terminal lower end of bore 208 of housing 202. A biasing member 534 is disposed within each passage 532 of first spring retainer 530. Particularly, a first biasing member 534 of first spring retainer 530 physically engages the ball connector 524 of the extension rod 514 of third valve assembly 510, biasing plug 512 of third valve assembly 510 towards the sealing surface 420S of third valve bore 420.

The biasing member 522 of third valve assembly 510 is also received in a corresponding passage 532 of first spring retainer 530, where biasing member 522 is configured to cushion the impact of plug 512 of the third valve assembly 510 when plug 512 contacts sealing surface 420S when third valve assembly 510 is actuated into the closed positions. In this embodiment, actuation assembly 400 of obturating tool 200 additionally includes a second spring retainer 540, and a biasing member 542 retained by second spring retainer 540 that is configured to apply a biasing force against valve body 402 (and, in-turn, core 300) in the axial direction of the upper end 204 of the housing 202 of obturating tool 200.

Referring to FIGS. 1, 3A-3E, and 6, and 15A-20, having described the structural features of the embodiment of obturating tool 200, the operation of obturating tool 200 will now be described herein. FIGS. 3A-3E and 6 illustrate obturating tool 200 in the run-in position as obturating tool 200 is pumped through the wellbore 3 shown in FIG. 1. In the run-in position, upper keys 274, lower keys 220, and bore sensor 226 are each in a radially outer position. Additionally, the first and second valve assemblies 440A and 440B of actuation assembly 300 are both in a closed position while the third valve assembly 510 is in an open position. In this arrangement, fluid flow from upper actuation chamber 266 to lower actuation chamber 268 is permitted via bypass passage 437 while fluid flow from lower actuation chamber 268 to upper actuation chamber 266 is restricted by check valve 439. Thus, when obturating tool 200 is in the run-in position, hydraulic lock within lower actuation chamber 268 also prevents core 300 from travelling downwards through bore 208 of housing 202.

As obturating tool 200 is pumped through bore 4B of well string 4, obturating tool 200 will enter the bore 18 of an uppermost sliding sleeve valve 10 (e.g., the sliding sleeve valve 10 of production zone 3E) of the well system 1. As obturating tool 200 enters bore 18, lower keys 220 (disposed in radially outer or locked positions) are permitted to pass through the upper shoulder 62 of carrier member 50, whereas the engagement shoulder 276 of each upper key 274 (disposed in a radially outer or locked position) subsequently engages the upper shoulder 62 of the carrier member 50 and thereby locks carrier member 50 with housing 202 of obturating tool 200.

With housing 202 of obturating tool 200 is axially locked to carrier member 50, obturating tool 200 continues to travel axially through bore 18 of the sliding sleeve valve 10 of production zone 3E, thereby forcibly displacing or dragging carrier member 50 axially through bore 18. Particularly, the pressure force pumping obturating tool 200 through the bore 4B of well string 4 elastically deforms detent ring 32 into the radially expanded position, thereby permitting carrier member 50 to move axially relative to housing 12 of the sliding sleeve valve 10 of production zone 3E. Carrier member 50 and obturating tool 200 then travel axially through bore 18 of sliding sleeve valve 10 until lower keys 220 physically engage the intermediate shoulder 30 of housing 12, thereby arresting the downward axial motion of both obturating tool 200 and carrier member 50 through bore 18. Once lower keys 220 (disposed in radially outer or locked positions) have contacted landing profile 29, arresting the downward travel of carrier member 50 and obturating tool 200, the sliding sleeve valve 10 of production zone 3E is fully actuated from the upper-closed position to the open position. In this position, seals 242 and 244 of obturating tool 200 sealingly engage the seal bore 28 of housing 12, preventing fluid flow between the upper and lower ends of housing 12 through bore 18.

In this embodiment, following the actuation of the sliding sleeve valve 10 of production zone 3E to the open position, hydraulic pressure in the portion of bore 4B of well string 4 located above obturating tool 200 may be increased to hydraulically fracture the area of subterranean formation 6 disposed adjacent the sliding sleeve valve 10 of production zone 3E. Hydraulic lock formed in lower actuation chamber 268 restricts core 300 from travelling downwards through bore 208 of housing 202. Thus, obturating tool 200 is configured to actuate sliding sleeve valve 10 from the upper-closed position to the open position with core 300 disposed in a first or initial position in housing 202. Additionally, the increased pressure in bore 4B during hydraulic fracturing is communicated to core passage 432 and the upper chamber 444 of each valve assembly 440A and 440B via sixth radial passage 438 formed in valve body 402. Increased pressure in each upper chamber 444 displaces the piston 462 of each valve assembly 440A and 440B downwards, thereby axially spacing the flapper 484 of each valve assembly 440A and 440B from its corresponding stem 494. In some embodiments, the increased pressure used to displace the piston 462 of each valve assembly 440A and 440B downwards may be created by controlling the rate of fluid flow into the bore 4B of well string 4. For instance, the passages 104 of the planar members 100 of the sliding sleeve valve 10 may be sized to create a fluid flow restriction therethrough that results in increased pressure in the portion of the bore 4B of well string 4 extending above obturating tool 200. Thus, actuation of obturating tool 200 may be controlled by controlling either fluid pressure or fluid flow rate in the bore 4B of well string 4.

Once the portion of subterranean formation 6 disposed adjacent the sliding sleeve valve 10 of production zone 3E is sufficiently fractured, obturating tool 200 may be operated to actuate sliding sleeve valve 10 from the open position to the lower-closed position. Particularly, fluid pressure in the portion of bore 4B of well string 4 located above obturating tool 200 may be reduced, with the reduction in fluid pressure being communicated to the upper chamber 444 of each valve assembly 440A and 440B via core passage 432 and sixth radial passage 438 formed in valve body 302. The reduction in fluid pressure in upper chamber 444 reduces, in-turn, the pressure force acting against shoulder 470 of the piston 462 of each valve assembly 440A and 440B, causing the biasing member 454 of each valve assembly 440A and 440B to axially displace each piston 462 axially towards its respective check valve assembly 490.

In this embodiment, the stem 494 of first valve assembly 440A is greater in axial length than the stem 494 of second valve assembly 440B, and thus, flapper 484 of first valve assembly 440A contacts its corresponding stem 494 before the flapper 484 of second valve assembly 440B may contact its corresponding stem 494. In this configuration, reduction in fluid pressure in the upper chamber 444 of first valve assembly 440A causes flapper 484 to engage stem 494 and axially displace obturating member 496 out of sealing contact with first radial passage 416 (shown in FIG. 16). With obturating member 496 of first valve assembly 440A out of sealing contact with first radial passage 416, fluid previously trapped in lower actuation chamber 268 is permitted to flow into upper actuation chamber 266. Thus, first valve assembly 440A actuates in response to actuation assembly 300 sensing a predetermined first pressure differential between the upper and lower ends of obturating tool 200.

With fluid communication reestablished between actuation chambers 266 and 268, core 300 is permitted to travel axially downwards through bore 208 of housing 202 until plug 512 of third valve assembly 510 seals against the sealing surface 420S of third valve bore 420 (shown in FIG. 16), thereby restricting fluid flow from lower actuation chamber 268 to upper actuation chamber 266 and reestablishing hydraulic lock in lower actuation chamber 268. Particularly, the pressure applied to the upper end 302 of core 300 produces an axially downwards directed force against core 300, where the amount of force applied to core 300 is determined by the amount of pressure applied to upper end 302 and the diameter of annular seal 336.

Following the downward displacement of core 300 through bore 208 of housing 100, lower keys 220 are permitted to actuate into a radially inwards or unlocked positions received in intermediate groove 324 of core 300 (shown in FIG. 15B), thereby unlocking obturating tool 200 from the housing 12 of the sliding sleeve valve 10 of production zone 3E. With obturating tool 200 unlocked from housing 12, the remaining pressure differential across seals 242 and 244 of housing 202 displaces obturating tool 200 and carrier member 50 (locked to housing 202 by upper keys 274) downwards through bore 18 of housing 12 until the lower end of carrier member 50 engages landing profile 29 of housing 12, disposing the sliding sleeve valve 10 of production zone 3E in the lower-closed position. Thus, obturating tool 200 is configured to actuate sliding sleeve valve 10 from the open position to the lower-closed position in response to the core 300 being displaced in a first axial direction from the first position in housing 202 to a second position in housing 202 that is axially spaced from the first position.

Once sliding sleeve valve 10 is disposed in the lower-closed position, obturating tool 200 may be released from the sliding sleeve valve 10 of production zone 3E such that obturating tool 200 may be flow transported downhole through bore 4B of well string 4 to the next sliding sleeve valve 10 of well string 4 (e.g., the sliding sleeve valve 10 of production zone 3F). Particularly, as the sliding sleeve valve 10 of production zone 3E enters the lower-closed position, bore sensor 226 of obturating tool 200 engages landing profile 29 of sliding sleeve valve 10, forcing bore sensor 226 into the radially inner position (shown in FIG. 15B). The actuation of bore sensor 226 into the radially inner position centralizes interrupt ring 290 within the bore 208 of housing 202.

Following the actuation of bore sensor 226 into the radially inner position, hydraulic pressure acting against the upper end 302 of core 300 is further reduced to axially transport core 300 farther downwards through bore 208 of housing 102 from the second position to a third position that is axially spaced from the second position. Particularly, the additional reduction in hydraulic pressure is communicated to upper chamber 444 of second valve assembly 440B, permitting the biasing member 454 of valve assembly 440B to displace piston 462 axially upwards such that flapper 484 engages stem 494 and displaces obturating member 496 out of sealing engagement with second radial passage 418. Thus, second valve assembly 440B actuates in response to actuation assembly 400 sensing a predetermined second pressure differential between the upper and lower ends of obturating tool 200, where the second pressure differential is less than the first pressure differential that triggers the actuation of first valve assembly 440A.

With second valve assembly 440B now in the open position, fluid previously trapped in lower actuation chamber 268 may be communicated to upper actuation chamber 268 via bypass passage 437, sixth radial passage 443, second valve bore 414, and second radial passage 418 formed in valve body 402. Following the opening of second valve assembly 440B, core 300 is permitted to travel axially downwards through bore 208 of housing 202 until upper keys 274 are permitted to actuate into radially inwards or unlocked positions received in upper groove 318 of core 300, where core 300 is disposed in the third position. Particularly, with bore sensor 226 in the radially inner position and interrupt ring 290 in the centralized position, intermediate shoulder 328 is permitted to pass axially through the central passage 292 of interrupt ring 290. With core 300 disposed in the third position, upper keys 274 may pass through seal bore 28 of the housing 12 of the sliding sleeve valve 10 of production zone 3E, thereby allowing obturating tool 200 to pass completely through the bore 18 of housing 12 as obturating tool 200 flows towards the next sliding sleeve valve 10 of well string 4 (e.g., the sliding sleeve valve 10 of production zone 3F). Once obturating tool 200 is released from sliding sleeve valve 10, fluid disposed in upper actuation chamber 266 is permitted to return to lower actuation chamber 268 via bypass passage 437 as core 300 returns to its original or first position shown in FIGS. 3A-14 via the upwardly directed biasing force applied against core 300 by biasing member 542.

Figure 18:
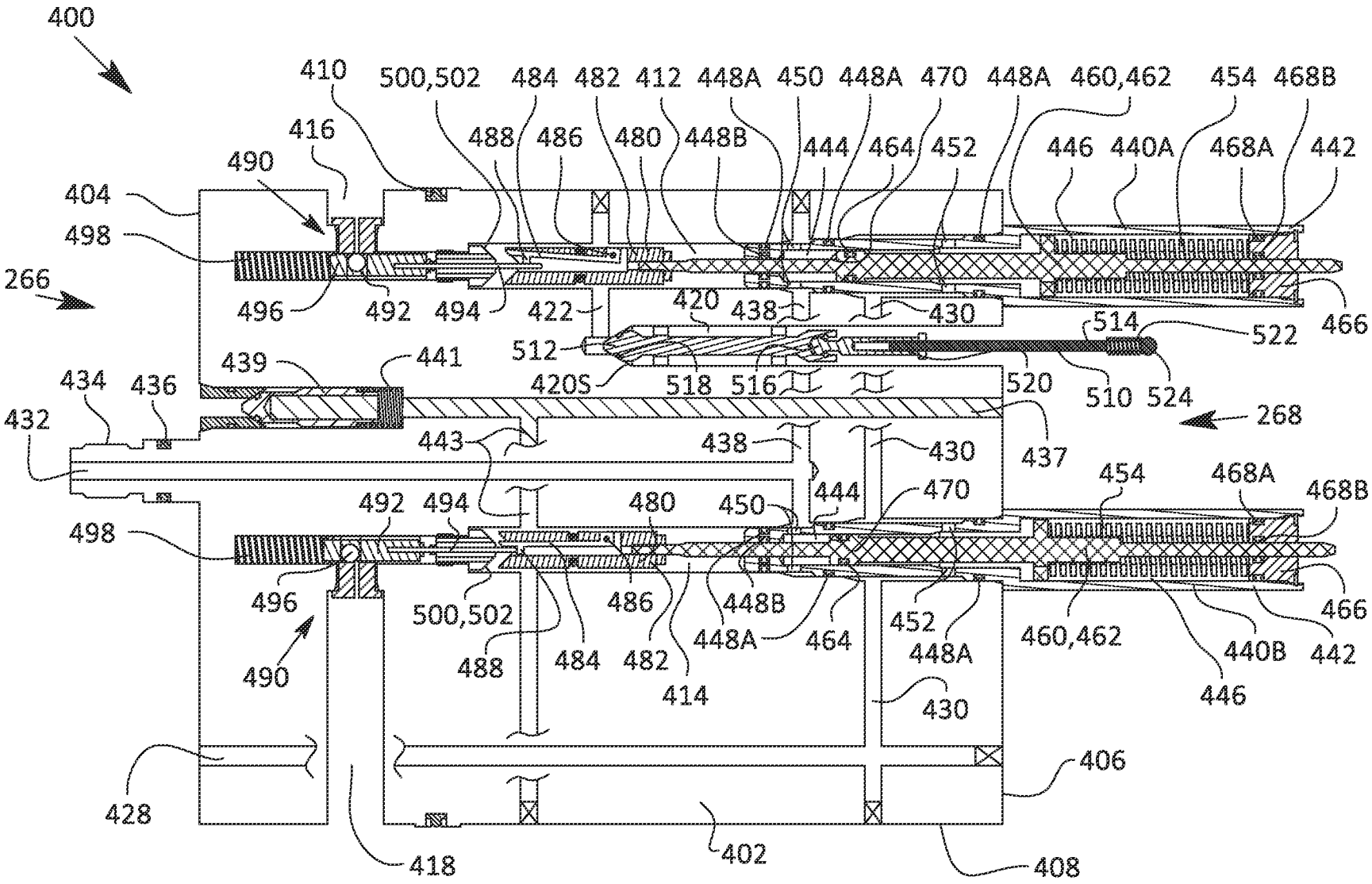
FIG. 18 is a top view of an actuation assembly of the obturating tool of FIG. 17A (shown as unrolled for clarity)
Figure 19A:
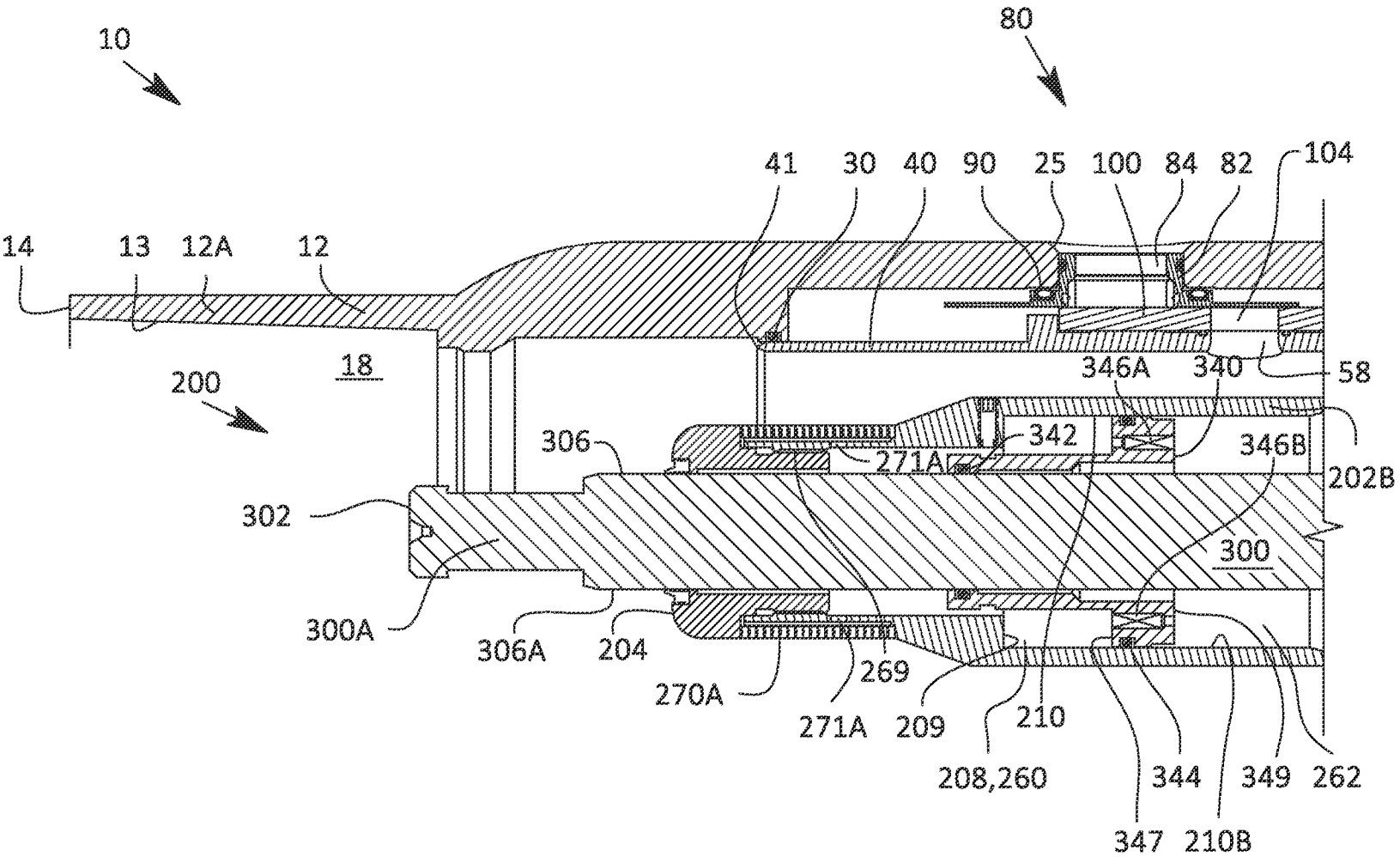
FIG. 19A is a section view of an uppermost end of the obturating tool of FIG. 3A disposed in a fourth position.
Figure 19B:
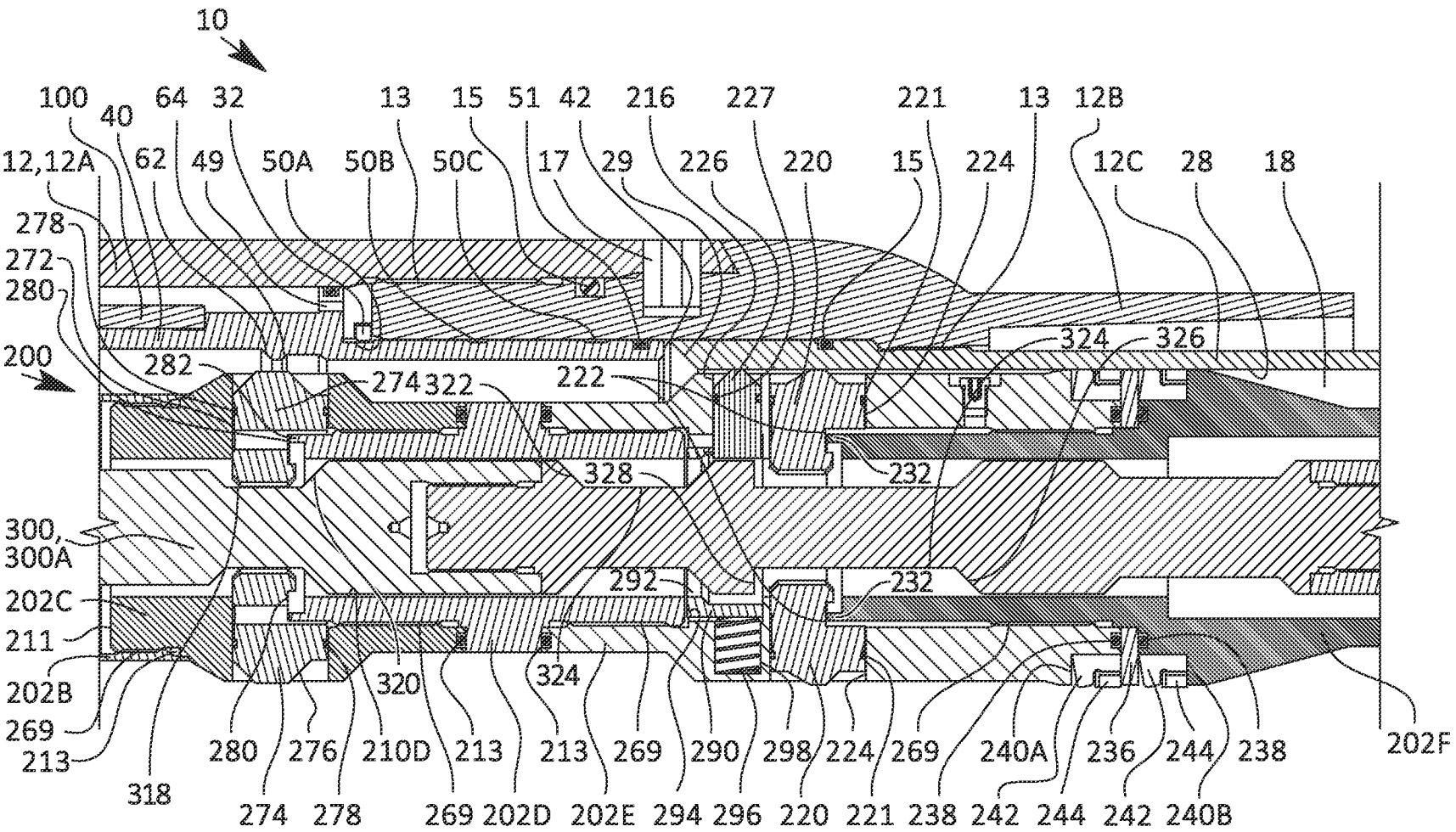
FIG. 19B is a section view of an intermediate section of the obturating tool shown in FIG. 19A.
Figure 19C:
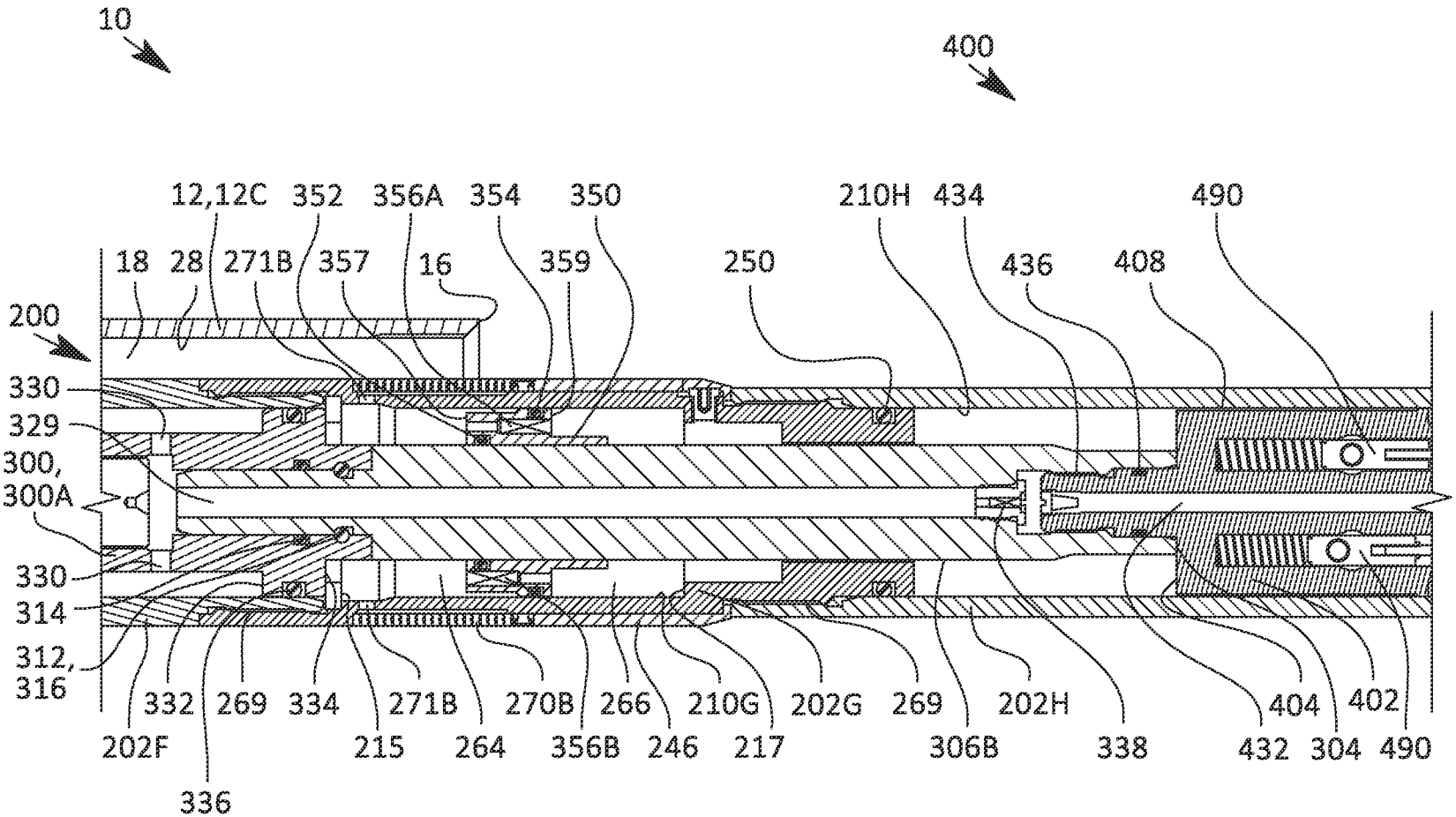
FIG. 19C is a section view of another intermediate section of the obturating tool shown in FIG. 19A.
Figure 19D:
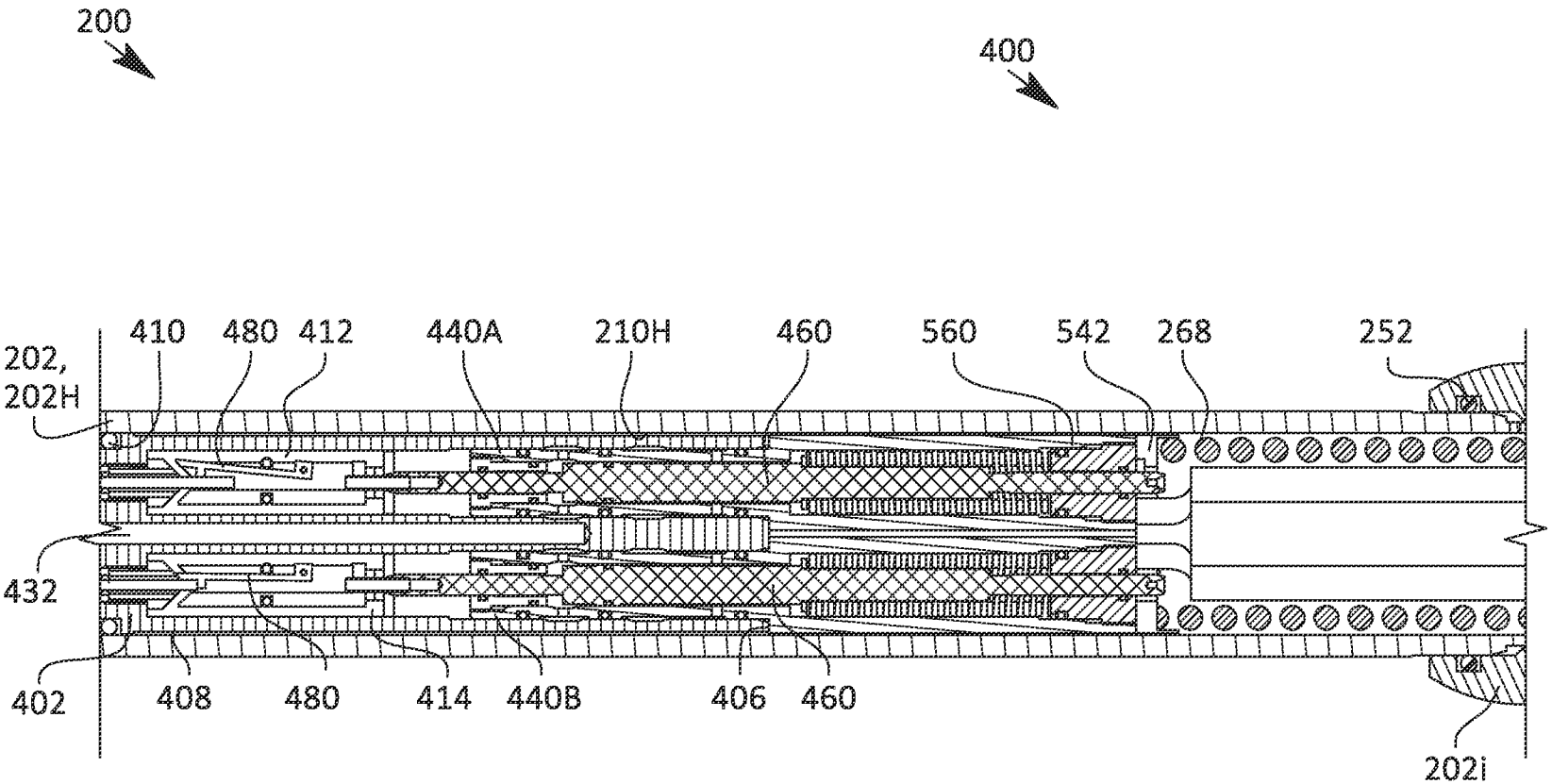
FIG. 19D is a section view of another intermediate section of the obturating tool shown in FIG. 19A.
Figure 20:
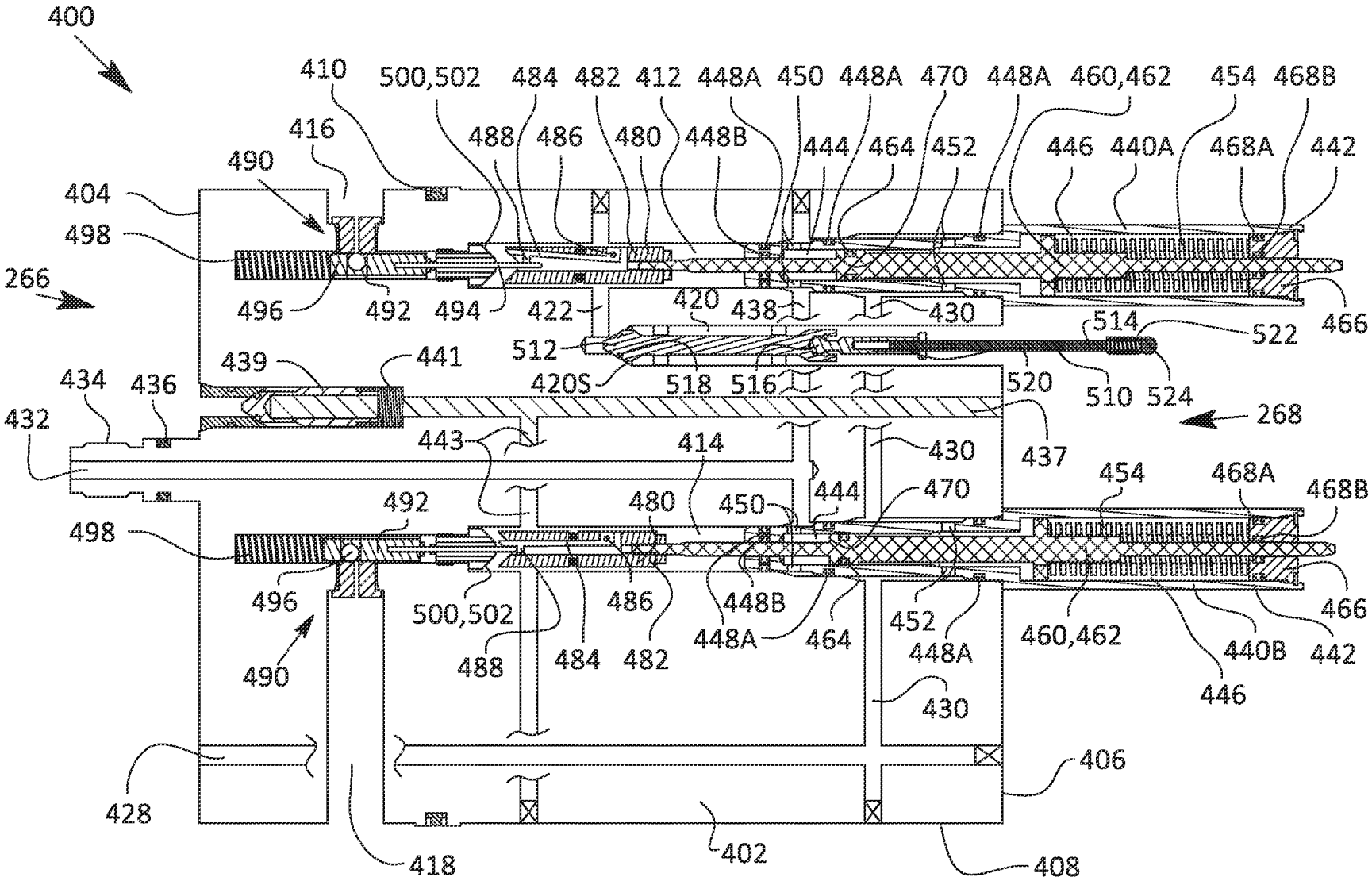
FIG. 20 is a top view of an actuation assembly of the obturating tool of FIG. 19A (shown as unrolled for clarity)
Figure 21A:
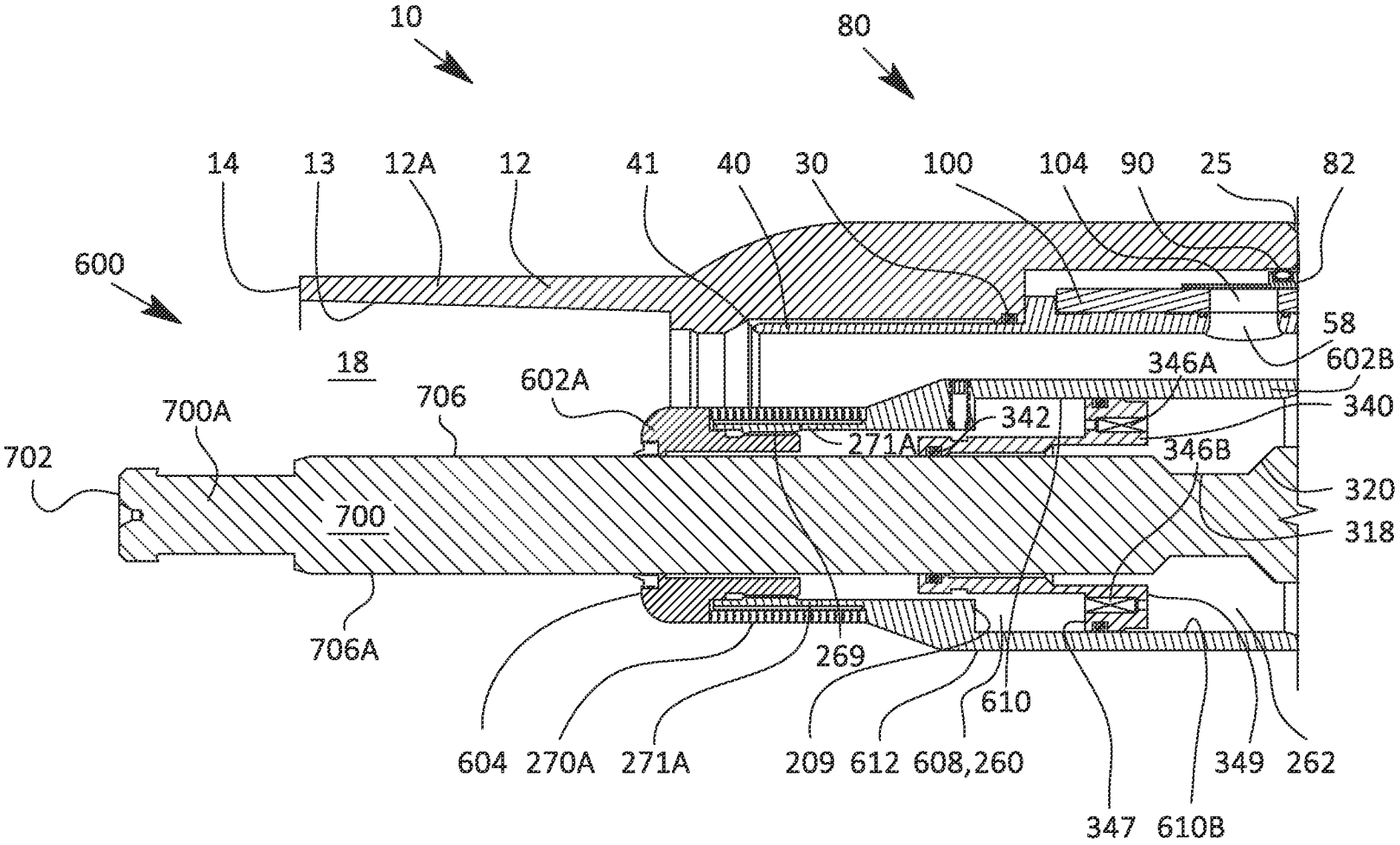
FIG. 21A is a section view of an uppermost end of another embodiment of a flow transported obturating tool for actuating the sliding sleeve valve shown in FIGS. 2A, 2B in accordance with principles disclosed herein.
Figure 21B:
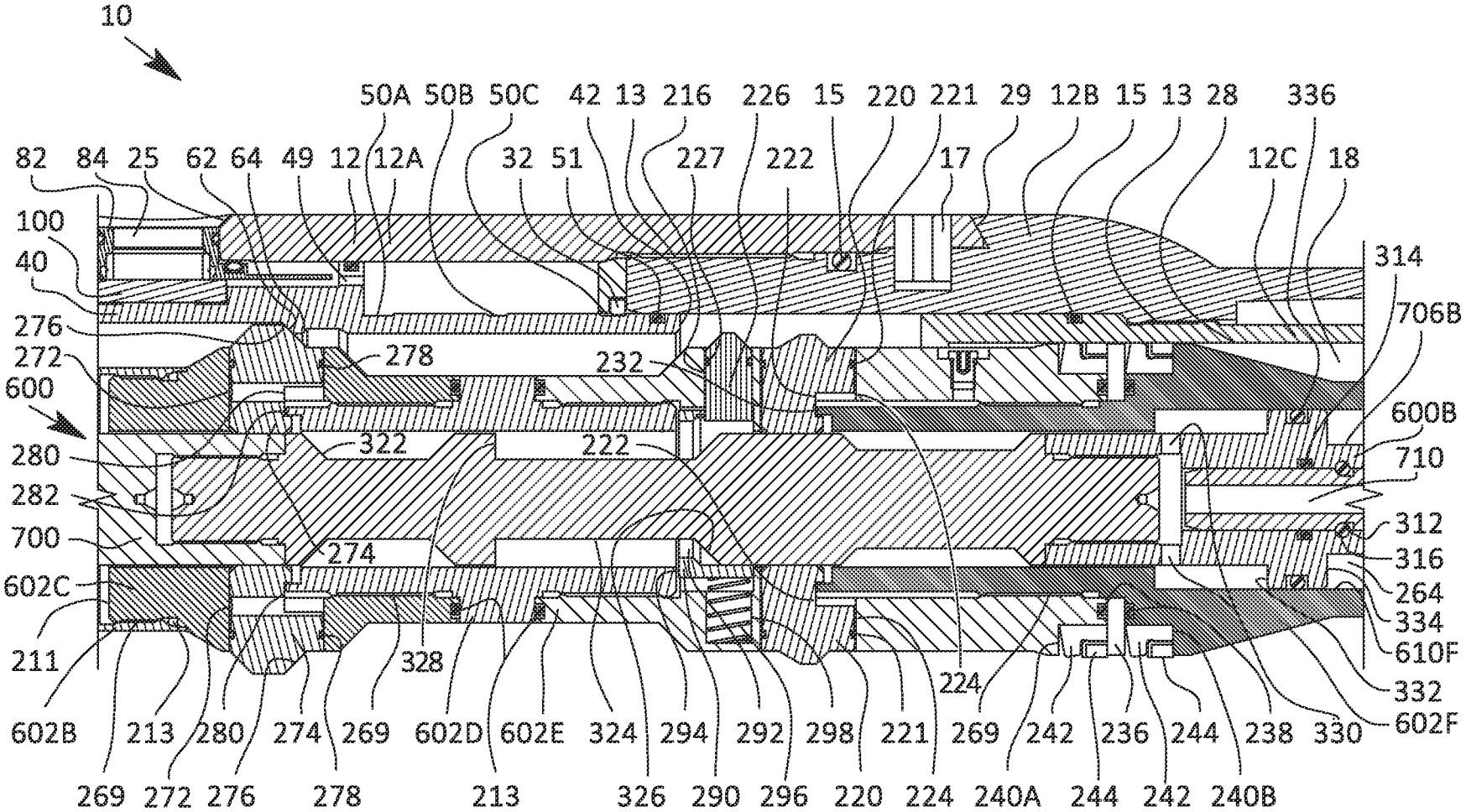
FIG. 21B is a section view of an intermediate section of the obturating tool shown in FIG. 21A.
Figure 21C:
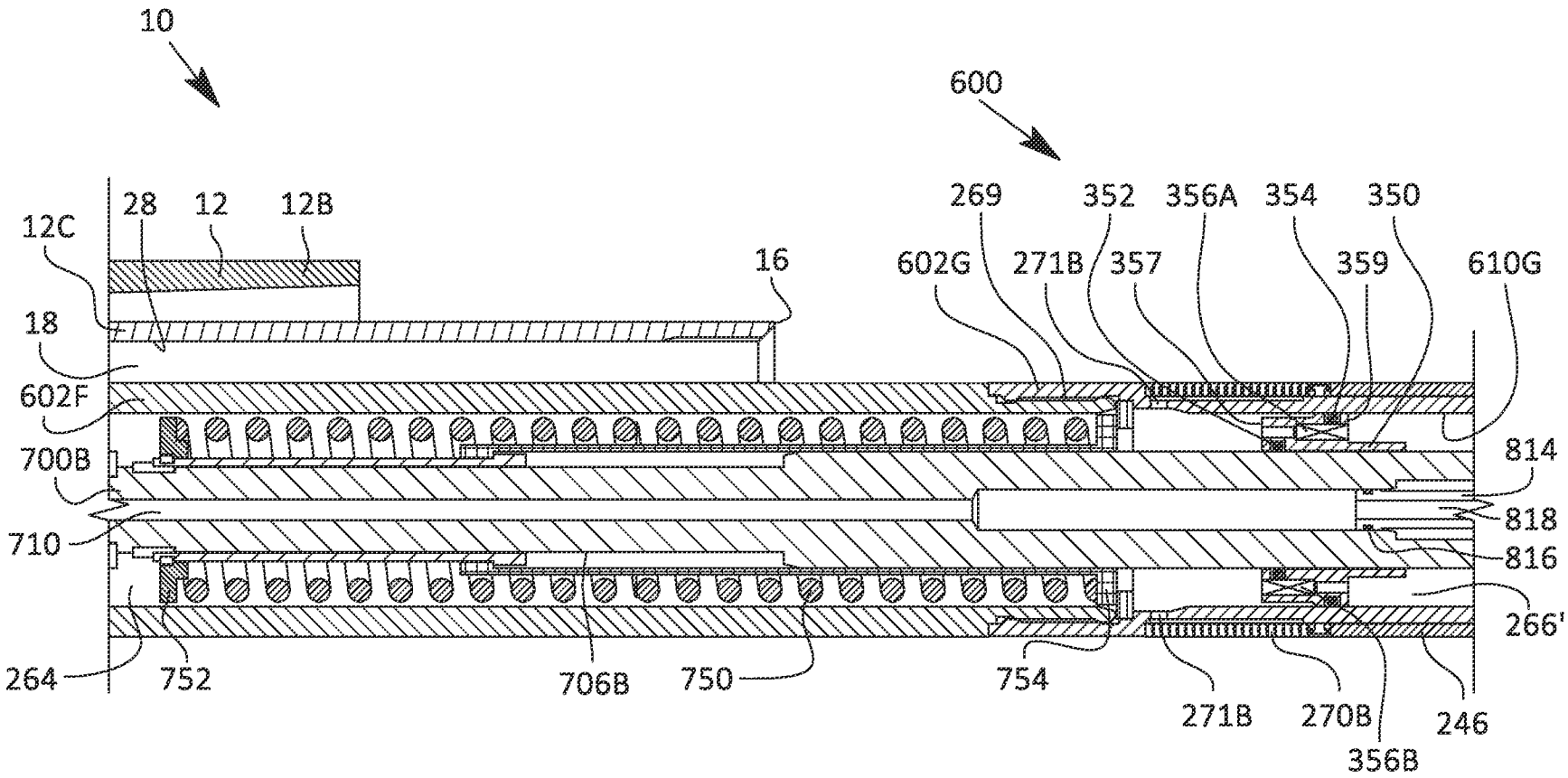
FIG. 21C is a section view of another intermediate section of the obturating tool shown in FIG. 21A.
Figure 21D:
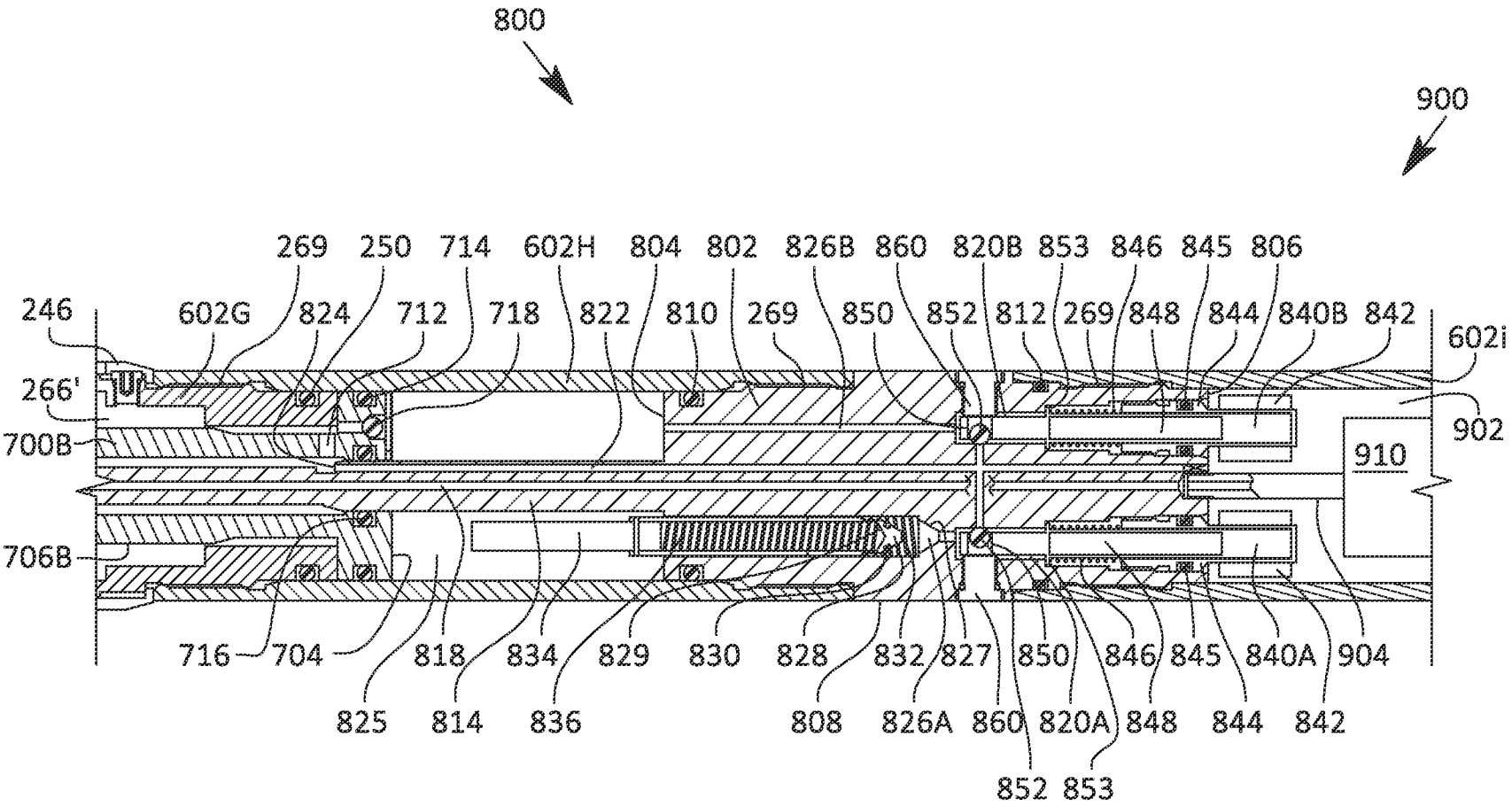
FIG. 21D is a section view of another intermediate section of the obturating tool shown in FIG. 21A.
Figure 21E:
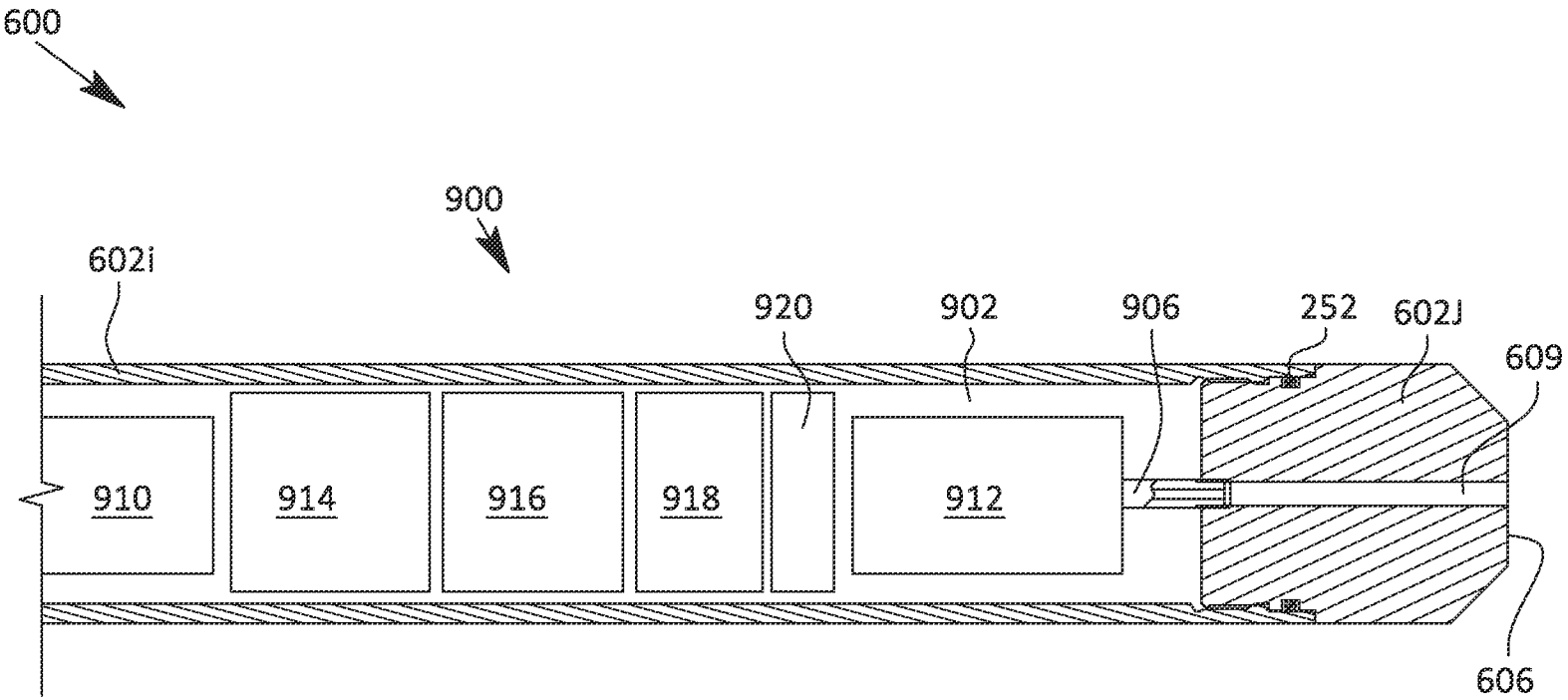
FIG. 21E is a section view of the lowermost end of the obturating tool shown in FIG. 3A.

During the hydraulic fracturing of formation 6, obturating tool 200 may encounter a portion of the formation 6 having excessively high fluid conductivity (sometimes referred to as a "thief zone") that does not provide sufficient backpressure to permit the formation of hydraulic fracturing pressure within well string 4. In other words, the thief zone of formation 6 surrounding the sliding sleeve valve 10 in which obturating tool 200 is disposed prevents the formation of hydraulic fracturing pressure within well string 4 irrespective of the actuation of surface pumps of well system 1. In some instances, the inability of building sufficient fracturing pressure within well string 4 may prevent the flapper 484 of the first valve assembly 440A from clearing stem 494, as shown in FIG. 18, which in-turn prevents flapper 484 of first valve assembly 440A from displacing stem 494 and obturating member 496 out of sealing contact with first radial passage 416 when fluid pressure is decreased within well string 4. In other words, the actuation of first valve assembly 440A may be prevented by the failure to build sufficient fracturing pressure within well string 4, the failure due to the presence of a thief zone in the portion of formation 6 proximal obturating tool 200.

As described above, the actuation of first valve assembly 440A permits displacement of the core 300 of obturating tool 200 from the first position to the second position, where obturating tool 200 is configured to actuate sliding sleeve valve 10 from the open position to the lower-closed position in response to the core 300 being displaced from the first position to the second position. In this embodiment, in situations where first valve assembly 440A is prevented from fully actuating (due to, e.g., a nearby thief one in the formation 6), interrupt ring 290 prevents obturating tool 200 from inadvertently releasing from sliding sleeve valve 10 before sliding sleeve valve 10 has actuated fully into the lower-closed position.

In this embodiment, following the actuation of second valve assembly 400B (shown in FIG. 18), obturating tool 200 is prevented from releasing from sliding sleeve valve 10 via engagement between bore sensor 226 of obturating tool 200 and the landing profile 29 of sliding sleeve valve 10. Particularly, engagement between bore sensor 226 and landing profile 29 (shown in FIG. 17B) prevents upper keys 274 from actuating into the radially inner positions and unlocking from carrier member 50. Upper keys 274 are prevented from actuating into the radially inner positions due to engagement between the interrupt shoulder 408 of interrupt ring 290 and the intermediate shoulder 328 of core 300, which restricts further downward axial travel of core 300 relative to housing 202.

During this process obturating tool 200 continues travelling axially through sliding sleeve valve 10, forcing carrier member 50 of sliding sleeve valve 10 axially through housing 12. Upper keys 274 remain locked to carrier member 50 until bore sensor 226 passes through landing profile 29 and enters seal bore 28 of sliding sleeve valve 10 (shown in FIG. 19B). As bore sensor 226 enters seal bore 28, bore sensor 226 is forced into the radially inner position and interrupt ring 290 is forced into the centralized position (shown in FIG. 19B). With interrupt ring 290 disposed in the centralized position, intermediate shoulder 328 is permitted to pass through the bore 292 of interrupt ring 290, thereby permitting upper keys 274 to enter into groove 318 of core 300 and actuate into the radially inner position. With each upper key 274 disposed in the radially inner position, upper keys 274 unlock from the carrier member 50 of sliding sleeve valve 10, permitting obturating tool 200 to detach from sliding sleeve valve 10 and exit downwardly therefrom. Additionally, as bore sensor 226 enters seal bore 28 of sliding sleeve valve 10, sliding sleeve valve 10 is fully actuated into the lower-closed position prior to the unlocking of upper keys 274 from carrier member 50. Thus, bore sensor 226 and interrupt ring 290 ensure that sliding sleeve valve 10 is fully actuated into the lower-closed position prior to the releasing of obturating tool 200 from sliding sleeve valve 10. Ensuring the full closure of sliding sleeve valve 10 prior to releasing obturating tool 200 restricts fluid communication between well string 4 and the thief zone of the formation 6, thereby permitting the hydraulic fracturing of formation 6 at locations downhole from the thief one of formation 6.

Referring to FIGS. 21A-21E, an embodiment of a continuous flow, flow transported obturating tool 600 is shown. Continuous flow obturating tool 600 is configured to selectably actuate sliding sleeve valve 10 of FIGS. 2A, 2B between the upper-closed, open, and lower-closed positions. As with the obturating tool 200 described above, the continuous flow obturating tool 600 can be disposed in the bore 4B of well string 4 at the surface of wellbore 3 and pumped downwards through wellbore 3 towards the heel of wellbore 3, where continuous flow obturating tool 600 can selectively actuate one or more three-position sliding sleeve valves 10 moving from the heel 3*h* of wellbore 3 to the toe of wellbore 3.

Continuous flow obturating tool 600 is configured to actuate each three-position sliding sleeve valve 10 of well string 4 as part of a hydraulic fracturing operation without ceasing pumping of fluid into the bore 4B of well string 4, or the shutting down of the surface pumps of well system 1. In this manner, continuous flow obturating tool 600 allows for a continuous flow of fluid into bore 4B of well string 4 as continuous flow obturating tool 600 actuates each sliding sleeve valve 10, and in turn, hydraulically fractures each production zone (e.g., production zones 3E, 3F, etc.) of the wellbore 3. Allowing for a continuous flow of fluid into bore 4*b* of well string 4 as the formation 6 is hydraulically fractured may decrease the overall time required for hydraulically formation 6 of well system 1. The decrease in time required for fracturing formation 6 of well system 1 may in turn reduce the overall costs for fracturing formation 6 of well system 1 via continuous flow obturating tool 600.

Continuous flow obturating tool 600 shares many structural and functional features with obturating tool 200 described above and illustrated in FIGS. 3A-20, and shared features have been numbered similarly. In the embodiment of FIGS. 21A-21E, continuous flow obturating tool 600 includes a generally tubular housing 602, a core 700 slidably disposed therein, an actuation assembly 800 configured to control the actuation or displacement of core 700 in housing 602, and an electronics module 900. Housing 602 includes a first or upper end 604, a second or lower end 606, and a throughbore 608 extending between upper end 604 and lower end 606, where throughbore 608 is defined by a generally cylindrical inner surface 610. Housing 602 also includes a generally cylindrical outer surface 612 extending between upper end 604 and lower end 606. Housing 602 is made up of a series of segments including a first or upper segment 602A, intermediate segments 602B-602H, and a lower segment 602J, where segments 602A-802J are releasably coupled together via threaded couplers 269. The connections formed between each segment 602A-602J of housing 602 is sealed via one or more annular seals, including annular seals 213 positioned between intermediate segments 602B and 602C, 602C and 602D, and 602D and 602E of housing 602, annular seal 214 positioned between intermediate segments 602C and 602D, annular seal 250 positioned between intermediate segments 602G and 602H, and annular seal 252 positioned between intermediate segment 602H and lower segment 602J. Further, lower segment 602J of housing 602 includes a throughbore 609 extending axially therethrough.

Core 700 of obturating tool 600 is disposed coaxially with the longitudinal axis of housing 602 and includes a first or upper end 702, second or a lower end 704, a generally cylindrical outer surface 706 extending between ends 702 and 704, and a central passage 710 extending between ports 330 and lower end 704. In this embodiment, core 700 comprises a first or upper segment 700A and a second or lower segment 700B, where segments 700A and 700B are releasably connected at a shearable coupling 312. Each segment 700A and 700B of core 700 may comprise multiple segments releasably coupled together or unitary members. In this embodiment, the lower end 704 of core 700 includes a plurality of circumferentially spaced lower ports 712 extending between outer surface 706 and central passage 710, an annular outer seal 714, an annular inner seal 716, and a check valve 718.

In this embodiment, obturating tool 600 includes a biasing member 750 disposed about core 700. A first or upper retainer 752 engages an upper end of biasing member 750 while a second or lower retainer 754 engages a lower end of biasing member 750. Upper retainer 752 engages the outer surface 708 of core 700 while lower retainer 754 engages the inner surface 610G of the intermediate segment 602G of housing 602. In this configuration, biasing member 750 provides an upwardly directed biasing force against core 700. In other words, biasing member 750 biases core 700 towards a first position of core 700 that is similar in configuration to the first position of the core 300 of the obturating tool 200 shown in FIGS. 3A-20.

In this embodiment, the actuation assembly 800 of obturating tool 600 generally includes a cylindrical valve block or body 802, a first solenoid valve 840A coupled to valve body 802, and a second solenoid valve 840B coupled to valve body 802. The valve body 802 of actuation assembly 800 includes a first or upper end 804, a second or lower end 806, and a generally cylindrical outer surface 408 extending between ends 804 and 806. The outer surface 808 of valve body 802 includes an annular upper seal 810 and an annular lower seal 812. In this embodiment, the upper end 804 of valve body 802 is coupled to the lower end of intermediate segment 602H of housing 602 via a threaded coupler 269, and the lower end 806 of valve body 802 is coupled to intermediate segment 602I of housing 602 via a threaded coupler 269. The upper seal 810 of valve body 802 seals the connection formed between intermediate segment 602H and valve body 802 while lower seal 812 seals the connection formed between valve body 802 and intermediate segment 602I.

In this embodiment, valve body 802 of actuation assembly 800 includes a neck 814 that extends upwards from upper end 804 and is received in a lower end of the central passage 710 of core 700. Neck 814 includes an annular seal 816 which sealingly engages an inner surface of the passage 710 of core 700. Additionally, valve body 802 includes a central passage 818 extending between an upper end of neck 814 and lower end 806, where central passage 818 is in fluid communication with the central passage 710 of core 700. The inner seal 716 of core 700 sealingly engages the outer surface 808 of neck 814 while the outer seal 714 of core 700 sealingly engages the inner surface 610H of the intermediate segment 602H of housing 602. In this arrangement, an annular lower actuation chamber 825 is formed in the throughbore 608 of housing 602, lower actuation chamber 825 extending between the seals 714, 716 of core 700 and the upper seal 810 of valve body 802. Check valve 718 permits fluid flow from upper actuation chamber 266' to lower actuation chamber 825 (such as when obturating tool 600 is reset following the actuation of a sliding sleeve valve 10 to the lower-closed position) but restricts direct fluid flow from lower actuation chamber 825 to upper actuation chamber 266'.

In this embodiment, valve body 802 of actuation assembly 800 also includes a pair of solenoid chambers 820A, 820B, and an upper conduit or passage 822 that extends between an upper terminal end or port 824 and solenoid chambers 820A, 820B. Each solenoid chamber 820A and 820B of valve body 802 is radially offset from the longitudinal axis of obturating tool 600. In this embodiment, solenoid chambers 820A and 820A are circumferentially spaced approximately 180 degrees apart; however, in other embodiments solenoid chambers 820A and 820B may be circumferentially spaced at varying angles. Upper passage 822 of valve body 802 is in fluid communication with upper actuation chamber 266' of obturating tool 600 but is fluidically isolated from both the central passage 710 of core 700 and the central passage 818 of valve body 802. Valve body 802 further includes a first lower conduit or passage 826A and a second lower conduit or passage 826B. First lower passage 826A of valve body 802 extends between upper end 804 of valve body 802 and the first solenoid chamber 820A while second lower passage 826B extends between upper end 804 and the second solenoid chamber 820B. Each lower passage 826A, 826B is in fluid communication with lower actuation chamber 825.

A plug 828 is slidably disposed in the first lower passage 826A of valve body 802, where plug 828 includes an annular seal 830 configured to sealingly engage a shoulder 827 of first lower passage 826A when plug 828 contacts or physically engages shoulder 827. A first or outer biasing member 832 biases plug 828 in an upwards direction towards the upper end 804 of valve body 802. In other words, outer biasing member 832 biases plug 828 out of sealing engagement with the shoulder 827 of first lower passage 826A. An upper end of plug 828 is slidably coupled to a stem 834 that projects upwardly from the upper end 804 of valve body 802 and a second or inner biasing member 836 extends between a lower end of stem 834 and an internal shoulder 829 formed within plug 828. Inner biasing member 836 biases stem 834 upwards in the direction of the lower end 704 of core 700.

In this embodiment, each solenoid valve 840A, 840B generally includes a coil 842, a cylinder 844, a biasing member 846, and a piston 848. Particularly, the cylinder 844 of the first solenoid valve 840A received in first solenoid chamber 820A is threadably coupled to an inner surface of first solenoid chamber 820A while the cylinder 844 of the second solenoid valve 840A received in second solenoid chamber 820B is threadably coupled to an inner surface of second solenoid chamber 820B. The cylinder 844 of each solenoid valve 840A, 840B includes an annular seal 845 configured to sealingly engage the inner surface of the corresponding solenoid chamber 820A, 820B. The piston 848 of each solenoid valve 840A, 840B is slidably disposed within the corresponding cylinder 844 and includes a receptacle 850 disposed at an upper end of piston 848, where receptacle 850 extends radially into piston 848 and receives a ball 852 disposed therein. Piston 848 of each solenoid valve 840 comprises a magnetic material and includes an air filled chamber configured decrease the density of piston 848 such that the density of the piston 848 of each solenoid valve 840 is roughly equivalent to the density of the fluid disposed in actuation chambers 266' and 895.

The piston 848 of each solenoid valve 840 also includes a radially extending flange 853 disposed distal the upper end of piston 848, where flange 853 is configured to physically engage a corresponding annular shoulder of the respective solenoid chamber 820A, 820B for limiting the maximum upward displacement of piston 848 within valve body 802. The biasing member 846 of each solenoid valve 840A, 840B extends between flange 853 of piston 848 and an upper end of cylinder 844, and is configured to apply an upwards biasing force against piston 848 such that flange 853 engages the shoulder of the respective solenoid chamber 820A, 820B. The ball 852 of each solenoid valve 840A, 840B may be installed in the respective solenoid chamber 820A, 820B via a pair of corresponding radial bores that are sealed via a pair of endcaps 828 (one endcap 860 for each radial bore) that threadably connect with valve body 802.

Plug 828 of actuation assembly 800 includes a first or open position (shown in FIG. 21D) providing for fluid communication between the first solenoid chamber 820A and the lower actuation chamber 825, and a second or closed position in which sealing engagement between the annular seal 830 of plug 828 and the shoulder 827 of first lower passage 826A restrict fluid communication between first solenoid chamber 820A and lower actuation chamber 825. Additionally, each solenoid valve 840A, 840B includes a first or closed position (shown in FIG. 21D) where the flange 853 of piston 848 engages the shoulder of the corresponding solenoid chamber 820A, 820B in response to the biasing force provided by biasing member 846, and a second or open position where piston 848 is displaced axially downwards such that flange 853 is disposed distal the shoulder of the corresponding solenoid chamber 820A, 820B. Particularly, in the closed position the ball 852 disposed in receptacle 850 is aligned with a corresponding upper passage 822. Thus, when the first solenoid valve 840A is in the closed position, ball 852 restricts fluid communication between upper passage 822 and the first lower passage 826A, and in turn, lower actuation chamber 825. Similarly, when the second solenoid valve 840B is in the closed position, ball 852 of second solenoid valve 840B restricts fluid communication between upper passage 822 and the second lower passage 826B, and in turn, lower actuation chamber 825.

Further, when the first solenoid valve 840A is in the open position, ball 852 is displaced downwards within receptacle 850 as piston 848 is displaced downwards, misaligning ball 852 with upper passage 822 and thereby providing for fluid communication between upper passage 822 and both the first lower passage 826A and lower actuation chamber 825. Similarly, when the second solenoid valve 840B is in the open position, ball 852 of second solenoid valve 840B is misaligned with upper passage 822, thereby providing for fluid communication between upper passage 822 and both the second lower passage 826B and lower actuation chamber 825. Solenoid valves 840A, 840B are each actuated between the closed and open positions in response to energization of their respective coil 842. Particularly, when the coil 842 of each solenoid valve 840A, 840B is energized (i.e., electrical current passes through coil 842) a magnetic force is imparted by coil 842 to piston 848 in the downwards direction opposing the upwards biasing force provided by biasing member 846. In this manner, the magnetic force provided by coil 842 displaces piston 848 downwards such that solenoid valve 840 is disposed in the open position.

In this embodiment, the energization of the coil 842 of each solenoid valve 840A, 840B is controlled by the electronics module 900 disposed within intermediate segment 602I of housing 602. In this embodiment, electronics module 900 is disposed in an atmospheric chamber 902 and includes a first or upper pressure transducer 910, a second or lower pressure transducer 912, a power source 914, a processor 916, a memory 918, and an antenna 920. Power source 914 is configured to provide electrical power to solenoid valves 840A, 840B and the electrical components of electronics module 900. Processor 916 is configured to send and receive electrical signals to control the operation of solenoid valves 840A, 840B and the electrical components of electronics module 900.

An upper conduit 904 fluidically couples upper pressure transducer 910 with the throughbore central passage 818 of valve body 802, which is in fluid communication with the throughbore 710 of core 700. Atmospheric chamber 902 is sealed from the remainder of throughbore 608 of housing 602 via the lower seal 812 of valve body 802 and the annular seal 252 positioned between intermediate segment 6021 and lower segment 602J. In this arrangement, upper pressure transducer 910 is configured to measure the pressure of fluid disposed in the bore 4B of well string 4 above piston rings 244 and elastomeric seals 244 of housing 602, which sealingly engage the inner surface of bore well string 4. A lower conduit 906 fluidically couples lower pressure transducer 912 with the throughbore 609 of the lower segment 602J of housing 602. In this arrangement, lower pressure transducer 912 is configured to measure the pressure of fluid disposed in the bore 4B of well string 4 below piston rings 244 and elastomeric seals 244 of housing 602. The pressure measurements made by upper pressure transducer 910 and lower pressure transducer 912 are stored or logged on memory 918. Antenna 920 is configured to wirelessly transmit and receive signals between electronics module 900 and other electronic components. In other embodiments, electronics module 900 may include additional components, such as radio frequency identification (RFID) tags and/or transmitters, a casing collar locator, a sensor for detecting the proximity of sliding sleeve valves 10 to obturating tool 600, sensors for identifying the position of the sliding sleeve valve 10, cameras, other forms of communication besides or in addition to antenna 920, as well as other sensors or mechanisms.

In an embodiment, antenna 920 is configured to transmit the pressure measurements recorded on memory 918 to an external electronic component. For instance, upper pressure transducer 910 and lower pressure transducer 912 may be used to measure fluid pressure in bore 4B of well string 4 during a hydraulic fracturing operation of well system 1 utilizing obturating tool 600, and these pressure measurements recorded on memory 918 may be wirelessly transmitted via antenna 920 to an external electronic component once the hydraulic fracturing operation has been completed and obturating tool 600 has been removed or fished from wellbore 3.

In this arrangement, well logging data stored on memory 918 may be communicated to an external electronic component without disassembling obturating tool 600. In this embodiment, antenna 920 comprises a Bluetooth® antenna; however, in other embodiments, antenna 920 may comprise other antennas configured for wirelessly transmitting signals, such as an inductive coupler. Further, in other embodiments, electronics module 900 may not include an antenna for wirelessly communicating signals. In this embodiment, memory 918 of electronics module 900 is also configured to store instructions for controlling the actuation of actuation assembly 800, as will be discussed further herein. Although in this embodiment electronics module 900 is described as including upper pressure transducer 910, lower pressure transducer 912, power supply 914, processor 916, memory 918, and antenna 920, in other embodiments, electronics module 900 may comprise other components. For instance, in an embodiment, electronics module 900 may comprise an analog timer for controlling the actuation of actuation assembly 800. The analog timer may be either mechanical or electrical in configuration.

Similar to core 300 of the obturating tool 200 shown in FIGS. 3A-20, core 700 of obturating tool 600 may occupy particular axial positions respective housing 602 as obturating tool 600 actuates a sliding sleeve valve 10. For instance, core 700 may occupy a first position (similar in configuration as the second position of the core 300 shown in FIGS. 3A-3E) in which obturating tool 600 is configured to actuate a sliding sleeve valve 10 from an upper-closed position to a lower closed position, a second position (similar in configuration as the second position of the core 300 shown in FIGS. 15A-15D) axially spaced from the first position in which obturating tool 600 is configured to actuate sliding sleeve valve 10 from the open position to the lower-closed position, and a third position axially spaced from the second position which permits obturating tool 600 to release from the sliding sleeve valve 10 such that obturating tool 600 may proceed to the next sliding sleeve valve 10 of well string 4.

Electronics module 900 is configured to control the actuation of core 700 between the first, second and third positions, and thus, is configured to control the actuation of sliding sleeve valve 10 from the open position to the lower-closed position, as well as the release of obturating tool 600 from the sliding sleeve valve 10. Particularly, in this embodiment, electronics module 900 is programmed to include a timer set for a predetermined fracturing time, and the timer of electronics module 900 is initiated in response to the pressure acting on the upper end 702 of core 700 being increased to the fracturing pressure, where the pressure acting on upper end 702 of core 700 is measured in real-time by upper pressure transducer 910. Thus, once the bore 4B of wellbore 602 has been pressurized to the fracturing pressure, the timer of electronics module 900 begins counting down to zero from the predetermined fracturing time, and upon reaching zero, electronics module 900 actuates core 700 from the first position to the second position.

The fracturing time of the timer programmed into electronics module 900 is set for the period of time desired for fracturing the formation 6 at each production zone (e.g., production zones 3E, 3F, etc.). Thus, the fracturing time may be altered depending upon the particular application. Further, multiple fracturing times may be stored on the memory 918 such that the formation 6 at each production zone is fractured for different predetermined periods of time. In other words, the formation 6 at production zone 3E may be hydraulically fractured for a first fracturing time, while the formation 6 at production zone 3F may be hydraulically fractured at a second fracturing time. In this manner, core 700 is actuated from the first position to the second position without ceasing the pumping of fluid (i.e., shutting down the pumps at the surface of well system 1) into the bore 4B of well string 4. Instead of ceasing pumping of fluid into bore 4B of well string 4 to actuate core 700 from the first position to the second position, core 700 is actuated by actuation assembly 800 as controlled by electronics module 900.

Moreover, in this embodiment, the countdown of the timer is suspended in the event that the pressure acting on the upper end 702 of core 700 falls below the fracturing pressure sufficient to maintain core 700 in the first position, and resumed once the pressure acting on upper end 702 returns to the fracturing pressure. For instance, if the fracturing time is set for one hour, and thirty minutes following the initiation of the timer the pressure acting on upper end 702 is reduced below the fracturing pressure, the timer will be suspended with thirty minutes remaining. The timer will remain at thirty minutes until the pressure in bore 4B of well string 4 is increased to the fracturing pressure, and at that time, the timer resumes counting down to zero from thirty minutes, and upon reaching zero, the electronics module 900 automatically actuates core 700 from the first position to the second position.

Although in this embodiment electronics module 900 is programmed with a timer for controlling the actuation of core 700 from the first position to the second position, in other embodiments, electronics module 900 may trigger the actuation of core 700 into the second position in response to a decrease in pressure acting on the upper end 702 of core 700. For instance, once the formation 6 has been sufficiently fractured at production zone 3E, personnel of well system 1 may reduce the rate of fluid flow into bore 4B of well string 4, thereby decreasing the pressure acting against upper end 702 of core 700. The decrease in pressure is measured in real-time by upper pressure transducer 910, and in response to the measurement of the decreased pressure, electronics module 900 actuates core 700 from the first position to the second position. Alternatively, in other embodiments, electronics module 900 may be configured to actuate core 700 from the first position to the second position in response to pressure measurements from the upper pressure transducer 910 and lower pressure transducer 912. For instance, electronics module 900 may comprise an algorithm or model configured to actuate core 700 in response to measurements from pressure transducers 910 and 912. In still other embodiments, electronics module 900 may actuate core 700 in response to an actuation signal received by antenna 920 from an external source.

In this embodiment, once the timer of electronics module 900 reaches zero, electronics module 900 actuates the first solenoid valve 840A from the closed position to the open position by energizing coil 842 of the first solenoid valve 840A. With first solenoid valve 840A in the open position, fluid disposed in lower actuation chamber 825 is permitted to flow into upper actuation chamber 266' via first lower passage 826A and upper passage 822 of valve body 802. The flow of fluid from lower actuation chamber 825 eliminates the hydraulic lock formed in lower actuation chamber 825, permitting core 700 to travel axially through housing 602. As core 700 travels axially through housing 602 the lower end 704 of core 700 engages stem 834, forcing stem 834 axially downwards relative to valve body 802. As core 700 and stem 834 travel axially downwards through housing 602, inner biasing member 836 forces the seal 830 of plug 828 into sealing engagement with the shoulder 827 of first lower passage 826A, thereby sealing lower actuation chamber 825 from upper actuation chamber 266' and thereby arresting the travel of core 700 through housing 602 with core 700 now disposed in the second position.

As core 700 of obturating tool 600 travels from the first position to the second position, the sliding sleeve valve 10 of production zone 3E is actuated from the open position to the lower-closed position. As described above, when shifting core 700 from the first position to the second position, fluid may flow continuously into bore 4B of well string 4. In an embodiment, the flow rate of fluid into bore 4B of well string 4 may be decreased upon shifting core 700 from the first position to the second position to prevent damaging obturating tool 600 once obturating tool 600 has unlocked from, and is displaced through, the sliding sleeve valve 10 of production zone 3E and towards the sliding sleeve valve 10 of production zone 3F.

Once sliding sleeve valve 10 of production zone 3E has been shifted from the open position to the lower-closed position as described above, core 700 may be actuated from the second position to the third position in order to release obturating tool 600 from the sliding sleeve valve 10 of production zone 3E, from where obturating tool 600 may proceed to the sliding sleeve valve 10 of production zone 3F. Particularly, in this embodiment, electronics module 950 is configured to actuate the second solenoid valve 840B after a predetermined period of time following the actuation of the first solenoid valve 840A. The predetermined period of time between the actuation of solenoid valves 840A, 840B is configured to allow core 700 to complete the process of shifting from first position to the second position prior to the release of obturating tool 600 from the sliding sleeve valve 10 of production zone 3E. In other embodiments, electronics module 950 may actuate the second solenoid valve 840B in response to pressure measurements taken by upper pressure transducer 910 and/or lower pressure transducer 912, or signals received by antenna 920.

With the second solenoid valve 840B in the open position, fluid disposed in lower actuation chamber 825 is permitted to flow into upper actuation chamber 266' via second lower passage 826B and upper passage 822 of valve body 802. The flow of fluid from lower actuation chamber 825 eliminates the hydraulic lock formed in lower actuation chamber 825, permitting core 700 to travel axially through housing 602 until core 700 reaches the third position, thereby unlocking obturating tool 600 from the sliding sleeve valve 10 of production zone 3E. Once obturating tool 600 has released from the sliding sleeve valve 10 of production zone 3E, solenoid valves 840A, 840B may each return to the closed position and biasing member 750 may act against core 700 to forcibly return core 700 to the first position. Fluid that has flowed from lower actuation chamber 825 to upper actuation chamber 266' may return to lower actuation chamber 825 via check valve 718 of core 700 to thereby reset obturating tool 600 before obturating tool 600 enters the sliding sleeve valve 10 of production zone 3F.

In further embodiments, the sliding sleeve valves and obturating tools disclosed herein (e.g., sliding sleeve valve 10 and obturating tools 200, 600) may include additional features otherwise not explicitly described above. For example, sliding sleeve valves and obturating tools described herein may include one or more of the features described in U.S. Ser. No. 15/224,345 filed Feb. 2, 2017, and entitled "Top-Down Fracturing System," and U.S. Ser. No. 15/946,471 filed Apr. 5, 2018, and entitled "Top-Down Fracturing System And Methods," each of which are hereby incorporated herein by reference in their entirety.

It should be understood by those skilled in the art that the disclosure herein is by way of example only, and even though specific examples are drawn and described, many variations, modifications and changes are possible without limiting the scope, intent or spirit of the claims listed below.

What is claimed is:

1. A flow transported obturating tool for actuating a valve in a wellbore, comprising:

a housing comprising a radially translatable engagement assembly;

a core slidably disposed in the housing;

an interrupt member disposed radially between the core and the housing;

a bore sensor disposed in the housing and in engagement with the interrupt member; and a biasing member disposed in the housing and in engagement with the interrupt member:

wherein the interrupt member includes a first position permitting relative movement between the core and the housing, and a second position that restricts relative movement between the core and the housing:

wherein a central axis of the interrupt member is offset from a central axis of the core when the interrupt member is disposed in the first position, and wherein the central axis of the interrupt member is aligned with the central axis of the core when the interrupt member is in the second position.

2. The obturating tool of claim 1, wherein the biasing member is configured to bias the interrupt member towards the first position.

3. The obturating tool of claim 1, wherein the core comprises a shoulder configured to engage a shoulder of the interrupt member when the interrupt member is in the first position.

4. The obturating tool of claim 1, wherein the interrupt member comprises an interrupt ring disposed about the core.

5. The obturating tool of claim 1, wherein:

the engagement assembly is configured to shift the valve from a first closed position to an open position when the core is in a first position relative to the housing; and the engagement assembly is configured to shift the valve from the open position to a second closed position in response to the core being displaced from the first position to a second position that is spaced from the first position in a first axial direction.

6. The obturating tool of claim 5, wherein the interrupt member is configured to prevent the obturating tool from unlocking from the valve until the valve enters the second closed position.

7. The obturating tool of claim 1, further comprising an actuation assembly configured to control the position of the core in the housing, wherein the actuation assembly comprises an electronically actuated solenoid valve.

8. The obturating tool of claim 1, wherein the interrupt member comprises a C-ring having a pair of terminal ends matingly received in slots of the bore sensor.

9. A flow transported obturating tool for actuating a valve in a wellbore, comprising:

a housing comprising a radially translatable engagement assembly;

a core slidably disposed in the housing;

an interrupt member disposed radially between the core and the housing; and a bore sensor disposed in the housing and in engagement with the interrupt member;

wherein the interrupt member includes a radially offset position permitting relative movement between the core and the housing, and a radially centralized position that restricts relative movement between the core and the housing;

wherein the core comprises a shoulder configured to engage a shoulder of the interrupt member when the interrupt member is in the radially offset position.

10. The obturating tool of claim 9, further comprising a biasing member disposed in the housing and in engagement with the interrupt member.

11. The obturating tool of claim 10, wherein the biasing member is configured to bias the interrupt member towards the radially offset position.

12. The obturating tool of claim 9, wherein a central axis of the interrupt member is offset from a central axis of the core when the interrupt member is disposed in the radially offset position, and wherein the central axis of the interrupt member is aligned with the central axis of the core when the interrupt member is in the radially centralized position.

13. The obturating tool of claim 9, wherein the interrupt member comprises an interrupt ring disposed about the core.

14. The obturating tool of claim 9, wherein:

the engagement assembly is configured to shift the valve from a first closed position to an open position when the core is in a first position relative to the housing; and the engagement assembly is configured to shift the valve from the open position to a second closed position in response to the core being displaced from the first position to a second position that is spaced from the first position in a first axial direction.

15. The obturating tool of claim 14, wherein the interrupt member is configured to prevent the obturating tool from unlocking from the valve until the valve enters the second closed position.

16. The obturating tool of claim 9, further comprising an actuation assembly configured to control the position of the core in the housing, wherein the actuation assembly comprises an electronically actuated solenoid valve.

17. The obturating tool of claim 9, wherein the interrupt member comprises a C-ring having a pair of terminal ends matingly received in slots of the bore sensor.

* * * * *